US006682864B2

(12) United States Patent
Tsunoda et al.

(10) Patent No.: US 6,682,864 B2
(45) Date of Patent: Jan. 27, 2004

(54) BULB FOR COLOR CATHODE RAY TUBE AND COLOR CATHODE RAY TUBE AND METHODS FOR PRODUCTION THEREOF

(75) Inventors: Seiichi Tsunoda, Kanagawa (JP); Masanao Uesugi, Kanagawa (JP)

(73) Assignee: Sony Corporation, Tokyo (JP)

( * ) Notice: Subject to any disclaimer, the term of this patent is extended or adjusted under 35 U.S.C. 154(b) by 535 days.

(21) Appl. No.: 09/753,770

(22) Filed: Jan. 3, 2001

(65) Prior Publication Data

US 2001/0030499 A1 Oct. 18, 2001

(30) Foreign Application Priority Data

Jan. 5, 2000 (JP) ..... P2000-000495
Jul. 3, 2000 (JP) ..... P2000-201501

(51) Int. Cl.[7] ..... H01J 9/227
(52) U.S. Cl. ..... 430/24
(58) Field of Search ..... 430/24, 25, 26; 427/68

(56) References Cited

U.S. PATENT DOCUMENTS 4,070,498 A 1/1978 Nishizawa et al. ..... 427/53
4,696,879 A * 9/1987 Yamazaki et al. ..... 430/24

FOREIGN PATENT DOCUMENTS

| | | |
|---|---|---|
| EP | 0146226 | 6/1985 |
| JP | 60109133 | 6/1985 |
| JP | 61234028 | 12/1986 |
| JP | 10162731 | 6/1998 |

* cited by examiner

*Primary Examiner*—John A. McPherson
(74) *Attorney, Agent, or Firm*—Jay H. Maioli

(57) ABSTRACT

A bulb for a color cathode ray tube having a face plate and a color selection member having a plurality of opening portions, wherein X is a nominal diagonal dimension of the bulb, P is a pitch of the opening portions along an electron beam sweep direction in the central portion of the bulb, GH is a distance between an inner surface of the face plate and the color selection member in the central portion of the bulb, and LT is a value obtained by dividing a size of the opening portion along the electron beam sweep direction in the central portion of the bulb by the pitch P and the expressions $$0.0117X-0.0457<P<0.018X-0.0771$$

and $$2.8\times10^{-2}<P\times LT\times GH^{-1/2}<4.1\times10^{-2}$$

are satisfied.

10 Claims, 53 Drawing Sheets

BULB FOR COLOR CATHODE RAY TUBE AND COLOR CATHODE RAY TUBE AND METHODS FOR PRODUCTION THEREOF

BACKGROUND OF THE INVENTION AND RELATED ART STATEMENT

The present invention relates to a bulb for a color cathode ray tube and a color cathode ray tube, and also relates to methods for the production thereof.

For example, in a bulb for a color cathode ray tube having a color selection member of aperture grille type, generally, an inner surface of a face plate has, for example, stripe-shaped fluorescent material layers for red, green and blue and a black-matrix (stripe-shaped light absorption black layer) present between one of the fluorescent material layers and another. And, an electron gun is incorporated into the above bulb, and the inside of the bulb is vacuumed, whereby a color cathode ray tube is completed. The method of forming the above stripe-shaped color fluorescent layer will be explained with reference to schematic partial end views of the face plate, etc., shown in FIGS. 47A to 47C and FIGS. 48A and 48B. The above stripe-shaped color fluorescent layer is formed by means of an opening portion, more specifically, by means of a face plate 11 to which a color selection member 13 of aperture grille type having stripe-shaped slits 14 extending in parallel with the perpendicular direction of the face plate 11 is attached. FIG. 47B alone shows the color selection member 13.

First, a light sensitive film 20 is applied to the inner surface of the face plate 11 and dried (see FIG. 47A), and then, a stripe-shaped exposed region 21 is formed in the light sensitive film 20 with an ultraviolet light which is emitted from an exposure light source (not shown) and passes through the stripe-shaped slit 14 formed in the color selection member 13 (see FIG. 47B). For forming fluorescent material layers for red, green and blue, the above exposure is carried out three times by changing the exposure light source in position for each time. Then, the light sensitive film 20 is developed and selectively removed, to retain a remaining portion (exposed and developed light sensitive film) 22 on the inner surface of the face plate 11 (see FIG. 47C). Then, a carbon agent is applied to the entire surface, and the remaining portion 22 of the light sensitive film and the carbon agent thereon are removed by a lift-off method, to form a stripe-shaped black-matrix 23 composed of the carbon agent (see FIG. 48A). Then, fluorescent material layers 24 for red, green and blue are formed on the exposed inner surfaces of the face plate (portion 11B of exposed inner surface of the face plate 11, the portion 11B being present between one black-matrix 23 and another black-matrix 23) (see FIG. 48B). Specifically, for example, a photosensitive fluorescent material slurry for red is applied to the entire surface, exposed to a light and developed, then, a photosensitive fluorescent material slurry for green is applied to the entire surface, exposed to a light and developed, and further, a photosensitive fluorescent material slurry for blue is applied, exposed to a light and developed.

In the above exposure method, an ultraviolet light emitted from one exposure light source is used. In some optical dimensions of a bulb for a color cathode ray tube, an exposure intensity of a transmitted light (exposure dosage on the light sensitive film 20) of an ultraviolet light through the slit 14 which is an opening portion formed in the color selection member 13, has a distribution of a Fresnel diffraction wave as is schematically shown in FIG. 52A. The above Fresnel diffraction is known as near-field diffraction, and generally is obtained when an observation screen is located in a finite distance from a diffraction aperture. In the graph of the exposure intensity of the transmitted light in FIG. 52A, the axis of abscissas shows the horizontal direction of the face plate and the axis of ordinates show the exposure intensity of the transmitted light. Further, the origin is the center of the stripe-shaped exposed region of the light sensitive film.

When the above light sensitive film 20 is exposed to a light, developed and selectively removed, heavy convexo-concave shapes are formed in edge portions of the remaining portion 22 of the light sensitive film (see FIG. 52B). The above phenomenon is caused by the formation of stripe-shaped edge portions of the exposed region 21 on the basis of an area of a transmitted-light strength in which area the derivative of the first order ($\partial I/\partial x$) of the transmitted-light strength on the light sensitive film 20 has an extremely small value. In the above expression, "I" stands for a transmitted-light intensity (in other words, exposure dosage on the light sensitive film 20) and "x" stands for an electron beam sweep direction, specifically, the horizontal direction of the face plate 11. If the derivative of the first order ($\partial I/\partial x$) of the transmitted-light strength on the light sensitive film 20 comes to be an extremely small value, the value of the derivative of the first order of crosslinking degree distribution of the light sensitive film 20 comes to be small (that is, the crosslinking degree distribution of the light sensitive film 20 in the horizontal direction of the face plate 11 loses steepness), so that the heavy convexo-concave shapes are formed in the edge portions of the remaining portion 22 of the light sensitive film. As a result, the edge portions of the stripe-shaped fluorescent material layer 24 cause heavy convexo-concave shapes, macroscopically, an image display non-uniformity is caused in a color cathode ray tube, and the color cathode ray tube is extremely deteriorated in quality.

JP-A-60-84738 discloses a method for avoiding the above phenomenon. In the method disclosed in the above Laid-Open publication, a plurality of exposure light sources are arranged in different positions along the horizontal direction of the face plate, and a light sensitive film formed on an inner surface of a face plate is exposed to a predetermined stripe width using a transmitted-light strength distribution of superposed Fresnel diffraction waves. And, a correction lens system for correcting Fresnel diffraction conditions of each is selected depending upon an exposure light in the position of each exposure light source, and a plurality of exposure lights emitted from a plurality of the exposure light sources are adjusted such that Fresnel diffraction waves are superposed on the light sensitive film through the correction lens system and the color selection member for one stripe having a predetermined width. Further, a plurality of the exposure lights are adjusted such that the transmitted-light strength distribution is nearly constant on the entire surface of the light sensitive film formed on the inner surface of the face plate, and further that exposure is effected in a state where a differential value ($\partial i/\partial x$) of the transmitted-light strength distribution on a position corresponding to the edge of the stripe width is a value near a peak of the distribution of the differential value ($\partial i/\partial x$) or a value that has a certain level sufficient for preventing an edge non-uniformity of the stripe width.

The method disclosed in the above Laid-Open publication is effective for preventing the heavy convexo-concave shapes which occur in the edges of the remaining portion of the light sensitive film. It is remarkably suitable for producing a so-called commercial color cathode ray tube in which slits of a color selection member in a central portion of a bulb for a color cathode ray tube have a rough pitch or a color cathode ray tube for a computer display in which slits have a fine pitch. However, slits of a color selection member in a central portion of a bulb for a color cathode ray tube for digital broadcasting have a semi-fine pitch, and the semi-fine pitch is in an intermediate range between the pitch of slits of the color selection member in the commercial color cathode ray tube and the pitch of slits of the color selection member in the high-resolution color cathode ray tube for the computer display.

It has been found that even if the method disclosed in JP-A-60-84738 is employed for a color cathode ray tube in which the pitch of slits of the color selection member is in an intermediate range as described above, the heavy convexo-concave shapes are formed in edges of part of the light sensitive film remaining after exposure and development. As a result, the heavy convexo-concave shapes are formed in the edge portions of the stripe-shaped fluorescent material layer, and macroscopically, image display non-uniformity is caused in part of the color cathode ray tube, so that the color cathode ray tube is downgraded in quality to a great extent.

OBJECT AND SUMMARY OF THE INVENTION

Therefore, concerning a color cathode ray tube in which the pitch of the opening portions formed in a color selection member is in an intermediate range between the pitch of the opening portions formed in the color selection member in a commercial color cathode ray tube and the pitch of the opening portions formed in the color selection member in a high-resolution color cathode ray tube for a computer display, it is therefore an object of the present invention to provide a color cathode ray tube which permits the prevention of formation of convexo-concave shapes in edge portions of a fluorescent material layer, a bulb for such a color cathode ray tube and methods for the production thereof.

The method for producing a bulb for a color cathode ray tube, provided by the present invention, is a method for producing a bulb for a color cathode ray tube, said bulb comprising a face plate and a color selection member having a plurality of opening portions, and satisfying the following expression (1), wherein X is a nominal diagonal inchage of the bulb and P (unit: mm) is a pitch of the opening portions along an electron beam sweep direction in the central portion of the bulb.

Further, the method for producing a color cathode ray tube, provided by the present invention, is a method for producing a color cathode ray tube constituted of a bulb for a color cathode ray tube, said bulb comprising a face plate and a color selection member having a plurality of opening portions, and said bulb satisfying the following expression (1), wherein X is a nominal diagonal inchage of the bulb and P (unit: mm) is a pitch of the opening portions along an electron beam sweep direction in the central portion of the bulb.

In a circumferential portion of the face plate along the electron beam sweep direction, it is not necessary to satisfy the following expression (1).

$$0.0117X-0.0457<P<0.018X-0.0771 \quad (1)$$

The above methods includes the step of exposing a light, sensitive film formed on an inner surface of the face plate on the basis of a transmitted-light strength distribution of superposed Fresnel diffraction waves of exposure lights which are emitted from a plurality of exposure light sources arranged in different positions along the electron beam sweep direction and pass through the opening portions formed in the color selection member, to form exposed regions in the light sensitive film which regions correspond to the opening portions, in which a transmitted-light strength of superposed Fresnel diffraction waves of the two exposure lights (to be sometimes referred to as "superposed transmitted-light strength" hereinafter), out of a plurality of the exposure lights, which are emitted from the two exposure light sources contributing to the exposure of edge portions of the light sensitive film corresponding to each opening portion satisfies the following requirements (A) and (B);

(A) in an area of the superposed transmitted-light strength in which area the superposed transmitted-light strength on the light sensitive film decreases along the electron beam sweep direction (x direction) from a central portion of the exposed region of the light sensitive film corresponding to each opening portion, the derivative of the first order ($\partial i/\partial x$) of the superposed transmitted-light strength has at least one upward-convex area, and (B) the edge portions of the exposed light sensitive film corresponding to each opening portion are included in an area of the superposed transmitted-light strength which area corresponds to the upward-convex area which appears first along the electron beam sweep direction (x direction) from the central portion of the exposed region corresponding to each opening portion, out of the upward-convex areas of the derivative of the first order ($\partial i/\partial x$) of the superposed transmitted-light strength.

The above "two exposure lights which are emitted from the two exposure light sources contributing to the exposure of edge portions of the light sensitive film corresponding to each opening portion" means the following. When the exposure light sources are individually operated to expose the light sensitive film formed on the inner surface of the face plate, each of the above exposure lights is an exposure light which satisfies $I_{MIN} \leqq I_1$ wherein $I_1$ is a transmitted-light strength in the edge portion of the light sensitive film corresponding to each opening portion and $I_{MIN}$ is a lowest transmitted-light strength required for exposure of the light sensitive film.

Of upward-convex areas of the derivative of the first order ($\partial I/\partial x$) of the above superposed transmitted-light strength, the upward-convex area which appears first along the electron beam sweep direction from the central portion of the exposed region will be referred to as a first wave, and the upward-convex area which appears thereafter will be referred to as a second wave, for the convenience.

In the method for producing a bulb for a color cathode ray tube or the method for producing a color cathode ray tube, provided by the present invention (these methods will be sometimes generally referred to as "method of the present invention" hereinafter), preferably, the following expression (2) is satisfied. In the expression (2), GH (unit: mm) is a distance between the inner surface of the face plate and the color selection member in the central portion of the bulb and LT (corresponding to a so-called opening rate) is a value obtained by dividing a size (unit: mm) of the opening portion along the electron beam sweep direction in the central portion of the bulb by the pitch P (unit: mm). In a circumferential portion of the face plate along the electron beam sweep direction, it is not required to satisfy the following expression (2).

$$2.8\times10^{-2}<P\times LT\times GH^{-1/2}<4.1\times10^{-2} \quad (2)$$

After the formation of the exposed regions in the light sensitive film formed on the inner surface of the face plate which regions correspond to the openings, the method of the present invention may further includes the steps of selectively removing the light sensitive film by development, forming a light-absorption layer (for example, black-matrix) on the exposed inner surface of the face plate and removing the remaining portion of the light sensitive film, and then, forming a fluorescent material layer on the exposed inner surface of the face plate. For reliably forming the exposed regions having a proper size, preferably, a correction lens system is disposed between the exposure light sources and the color selection member. In the method for producing a bulb for a color cathode ray tube, provided by the present invention, the face plate and a funnel, etc., are assembled to complete the bulb for a color cathode ray tube. In the method for producing a color cathode ray tube, provided by the present invention, an electron gun is incorporated into the obtained bulb for a color cathode ray tube, and the inside of the bulb is vacuumed, to complete the color cathode ray tube.

The method of the present invention may employ a constitution in which the number of the exposure light sources is 2. In this case, the two exposure light sources correspond to "the two exposure light sources contributing to the exposure of edge portions of the light sensitive film corresponding to each opening portion". There may be also employed a constitution in which the number of the exposure light sources is 3 or more and the transmitted-light strength of superposed Fresnel diffraction waves of the exposure lights from all of the exposure light sources satisfies $I_{CENTER}/I_{EDGE} \geqq 1.2$, wherein $I_{CENTER}$ is a transmitted-light strength in the central portion of the exposed region corresponding to each opening portion and IEDGE is a transmitted-light strength in the edge portion of the light sensitive film corresponding to each opening portion. In the above constitution, reliable exposure is secured particularly in the central portion of the light sensitive film corresponding to each opening portion. In this case, two exposure light sources out of the three or more exposure light sources correspond to "the two exposure light sources contributing to the exposure of edge portions of the light sensitive film corresponding to each opening portion", and the remaining exposure light source or sources contribute, for example, to the exposure of the central portion of the exposed region corresponding to each opening portion. When three or more exposure light sources are used, preferably, the remaining exposure light source or sources (to be sometimes referred to as "exposure light source for exposing a central portion" hereinafter) are disposed between the two exposure light sources contributing to the edge portion of the light sensitive film corresponding to each opening portion (to be sometimes referred to as "exposure light source for exposing an edge portion" hereinafter). However, the light source or sources for exposing a central portion may be disposed outside the two exposure light sources for exposing an edge portion. Further, when four or more exposure light sources are used, preferably, the exposure light sources for exposing a central portion are disposed between the two exposure light sources for exposing an edge portion. Alternatively, the exposure light sources for exposing a central portion may be disposed outside the two exposure light sources for exposing an edge portion, or the exposure light sources for exposing a central portion may be disposed between and outside the two exposure light sources for exposing an edge portion. Each exposure light source may be constituted, for example, of an ultraviolet light source.

The bulb for a color cathode ray tube provided by the present invention for achieving the above object is a bulb comprising a face plate and a color selection member having a plurality of opening portions.

The color cathode ray tube of the present invention for achieving the above object is a color cathode ray tube constituted of a bulb for a cathode ray tube, said bulb comprising a face plate and a color selection member having a plurality of opening portions.

The bulb for a color cathode ray tube or the color cathode ray tube provided by the present invention satisfies the following expressions (1) and (2), wherein X is a nominal diagonal inchage of the bulb, P (unit: mm) is a pitch of the opening portions along an electron beam sweep direction in the central portion of the bulb, GH (unit: mm) is a distance between an inner surface of the face plate and the color selection member in the central portion of the bulb, and LT (corresponding to a so-called opening rate) is a value obtained by dividing a size (unit: mm) of the opening portion along the electron beam sweep direction in the central portion of the bulb by the pitch P (unit: mm).

$$0.0117X-0.0457<P<0.018X-0.0771 \quad (1)$$

$$2.8\times10^{-2}<P\times LT\times GH^{-1/2}<4.1\times10^{-2} \quad (2)$$

In a circumferential portion of the face place along the electron beam sweep direction, it is not required to satisfy the above expressions (1) and (2).

The pitch of the opening portions may be constant toward the circumferential portion of the face plate along the electron beam sweep direction. Alternatively, the above pitch may be broadened toward the circumferential portion along the electron beam sweep direction, whereby the color purity in the circumferential portion of the color cathode ray tube can be improved to a great extent. The size of the opening portions may be constant toward the circumferential portion along the electron beam sweep direction or may be broadened toward the circumferential portion along the electron beam sweep direction.

The edge portion of the exposed light sensitive film is included in the area of the superposed transmitted-light strength which area corresponds to the first wave of the derivative of the first order ($\partial I/\partial x$). However, it is not much desirable that the edge portion of the exposed light sensitive film is included in the area of the superposed transmitted-light strength which area corresponds to the first wave near a transition area from the first wave to the second wave of the derivative of the first order ($\partial I/\partial x$). Therefore, preferably, the following $\alpha$, $\beta$ and $\gamma$ satisfy the following expression (3), wherein $\alpha$ is a peak value of the first wave of the derivative of the first order ($\partial I/\partial x$), $\beta$ is a value of the derivative of the first order ($\partial i/\partial x$) in the transition area from the first wave to the second wave, and $\gamma$ is a value of the derivative of the first order ($\partial i/\partial x$) in the area (portion) of the superposed transmitted-light strength in which the edge portion of the exposed light sensitive film is included.

$$\gamma \geqq \beta+0.1(\alpha-\beta) \quad (3)$$

FIGS. 49A and 49B show layouts of the color selection member and the fluorescent material layers when the color selection member is of aperture grille type. FIG. 49A also shows the pitch P of the opening portions along the electron beam sweep direction in the central portion of the bulb. In the color selection member of aperture grille type, a plurality of slits corresponding to the opening portions are arranged in parallel. The pitch P corresponds to a distance from the center of one slit to the center of a neighboring slit.

FIGS. 50A and 50B show layouts of the color selection member and the fluorescent material layers when the color selection member is of dot-type shadow mask type. FIG. 50A also shows the pitch P of the opening portions along the electron beam sweep direction in the central portion of the bulb. In the color selection member of dot-type shadow mask type, a plurality of circular through holes corresponding to the opening portions are arranged in apexes of triangles. The pitch P corresponds to a distance from the center of one through hole to the center of a neighboring through hole along the electron beam sweep direction.

FIGS. 51A and 51B show layouts of the color selection member and the fluorescent material layers when the color selection member is of slot-type shadow mask type. FIG. 51A also shows the pitch P of the opening portions along the electron beam sweep direction in the central portion of the bulb. In the color selection member of slot-type shadow mask type, a plurality of short slits corresponding to the opening portions are arranged in one direction (at right angles with the electron beam sweep direction), and these slits are arranged in parallel with one another. The pitch P corresponds to a distance from the center of one short slot to the center of a neighboring short slot along the electron beam sweep direction.

In FIGS. 49B, 50B and 51B, symbols "R", "G" and "B" stand for a fluorescent material layer for emitting a light in red, a fluorescent material layer for emitting a light in green and a fluorescent material layer for emitting a light in blue, respectively. In FIGS. 49A and 49B, the opening portions and the fluorescent material layers are provided with slanting lines for clarification thereof.

The face plate may have a lateral dimension:vertical dimension ratio of nominal 16:9 or 4:3. Although not specially limited, the structure of the face plate includes a structure in which the outer surface of effective screen field of the face plate may be spherical or curved, a structure in which the outer surface of the effective screen field of the face plate is substantially flat and the thickness of the circumferential portions of the effective screen filed in the horizontal direction is larger than the thickness of the central portion of the effective screen field, and a structure in which the face plate in the effective screen field has a substantially uniform thickness. The structure of the color cathode ray tube includes a structure having a bulb for a color cathode ray tube in which the outer surface of the effective screen field of the face plate is substantially flat and a color selection member which is disposed to face the inner surface of the face plate inside the bulb and has a convex curvature toward the face plate. In this case, there may be employed a constitution in which the inner surface of the face plate has a concave curvature toward the color selection member and the curvature of the color selection member is greater than the curvature of the inner surface of the face plate or a constitution in which the inner surface of the face plate has a concave curvature toward the color selection member and the curvature of the color selection member is nearly equal to the curvature of the inner surface of the face plate. However, the above members shall not be limited to the above structures or constitutions. The above effective screen field refers to a face plate region where images are actually displayed when the bulb is incorporated into the color cathode ray tube. That the effective screen field of the face plate is substantially flat means that the effective screen field is flat within the production tolerance of the face plate. For example, in the face plate for a 28-inch bulb in which X=28, the production tolerance is approximately 1 to 2 mm or less. In the above case, the effective screen field appears to be substantially completely flat when visually observed. Further, a change in the thickness of the effective screen field from the central portion of the effective screen field to the circumferential portions in the horizontal direction can be expressed by an arc or a multinomial. When it is assumed that the bulb for a color cathode ray tube is held in a horizontal position and that the face plate is cut with a vertical plane, the curve drawn by the inner surface of the face plate may be a straight line, an arc, or a curve expressed by a multinomial. If the circumferential portions of the effective screen field in the horizontal direction has a thickness T and if the central portion of the effective screen field has a thickness of To, preferably, $T=1.2T_0$ to $1.3T_0$. The curvature of the inner surface of the face plate and the curvature of the color selection member refer to average values of curvatures of curves drawn by the cross section of the inner surface of the face plate and the cross section of the color selection member when it is assumed that the bulb is held in a horizontal position and that the face plate and the color selection member are cut with a horizontal plane. The above curves are preferably of an arc. In these cases, the curvature of the inner surface of the face plate and the curvature of the color selection member correspond to reciprocals of radii of the above arcs.

The material for constituting the light sensitive film includes, for example, PVP (polyvinyl pyrrolidone) and PVA (polyvinyl alcohol).

In designing the bulb for a color cathode ray tube or the color cathode ray tube, parameters such as the pitch of the opening portions and the size of the opening portions can be determined with a freedom to some extent although a certain limitation is imposed thereon. In the method of the present invention, the above expression (1) is satisfied and the edge portions of the exposed light sensitive film are included in the area of the superposed transmitted-light strength which area corresponds to the first wave in the derivative of the first order of the superposed transmitted-light strength, so that the edge portions of the light sensitive film remaining after exposure and development have no convexo-concave shapes. In the bulb for a color cathode ray tube or the color cathode ray tube provided by the present invention, the above expressions (1) and (2) are satisfied, so that the edge portions of the fluorescent material layer have no convexo-concave shapes.

BRIEF DESCRIPTION OF THE DRAWINGS

The present invention will be explained on the basis of Examples with reference to drawings hereinafter.

FIG. 47C, are schematic partial end views of the face plate, etc., for explaining the steps of producing the bulb for a color cathode ray tube.

DESCRIPTION OF THE PREFERRED EMBODIMENTS

EXAMPLE 1

A bulb 10 for a color cathode ray tube in Example 1 comprises a face plate 11 and a color selection member 13 of aperture grille type having stripe-shaped slits 14 (corresponding to a plurality of the opening portions) extending in parallel with the vertical direction (y-direction) of the face plate 11. The basic structure of the bulb 10 in Example 1 is the same as the structure of a conventional bulb for a color cathode ray tube. The color cathode ray tube of Example 1 is constituted of the bulb for a color cathode ray tube in Example 1 and has an electron gun, and the basic structure thereof is the same as the structure of a conventional color cathode ray tube.

Figure 9:
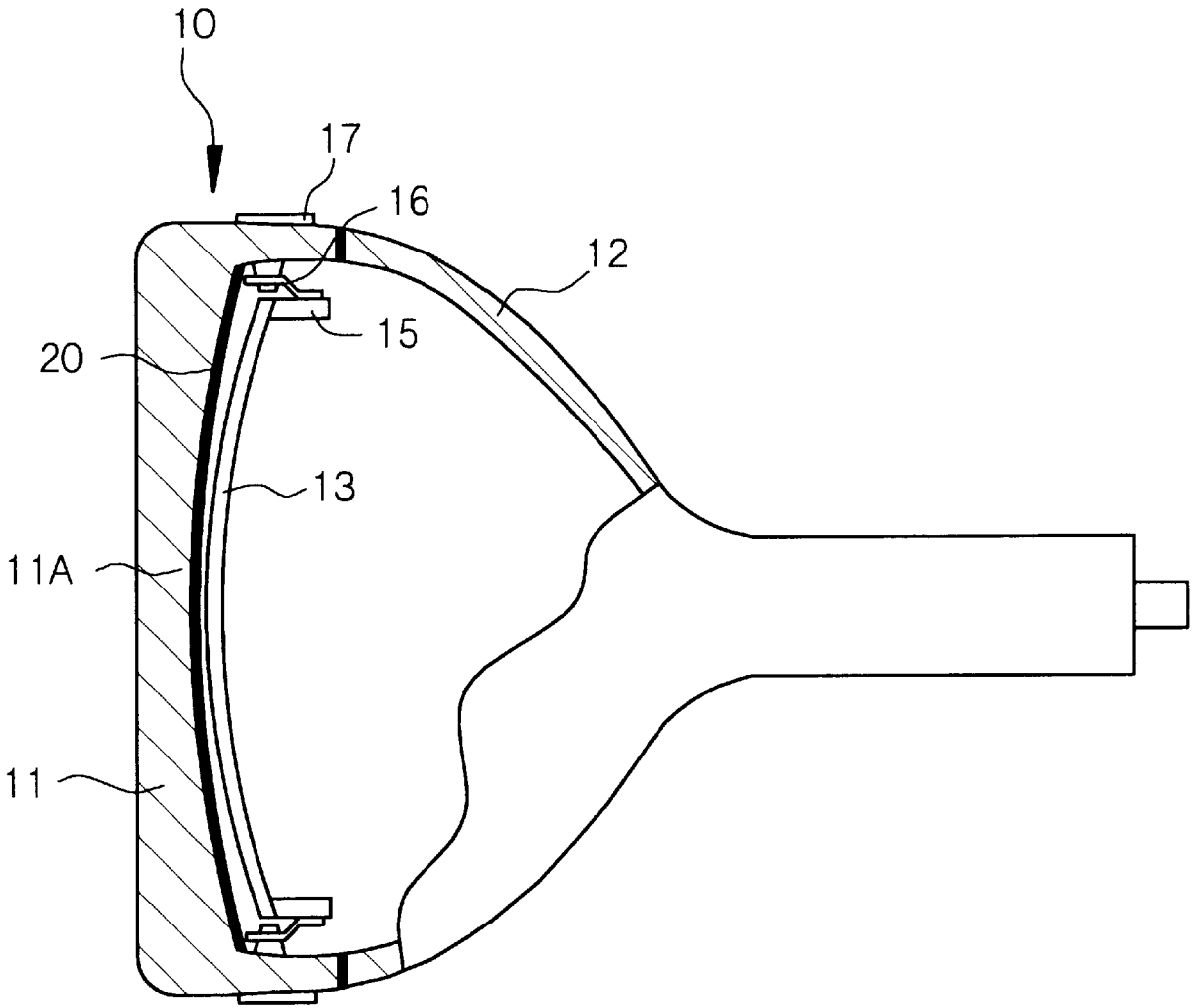
FIG. 9 is schematic partial exploded drawing of a bulb for a color cathode ray tube.
Figure 10A:
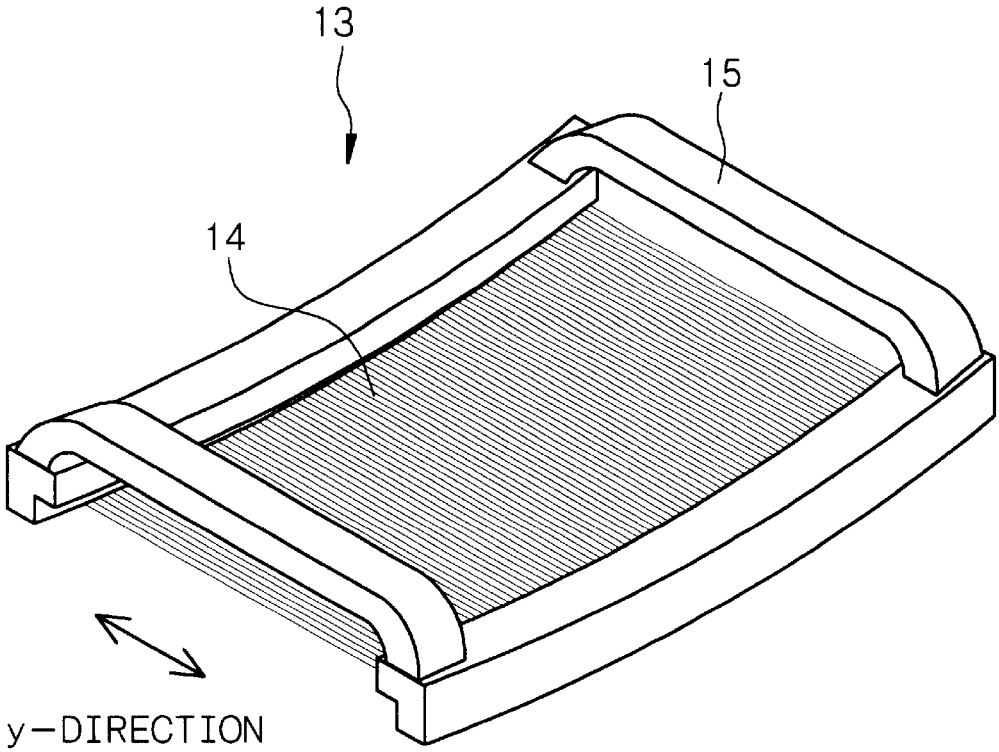
FIGS. 10A and 10B are a schematic perspective view of a color selection member of aperture grille type and an enlarged view of part of the color selection member, respectively.
Figure 10B:
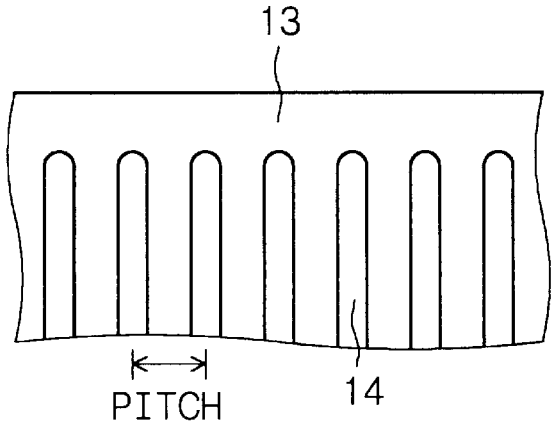
Figure 11:
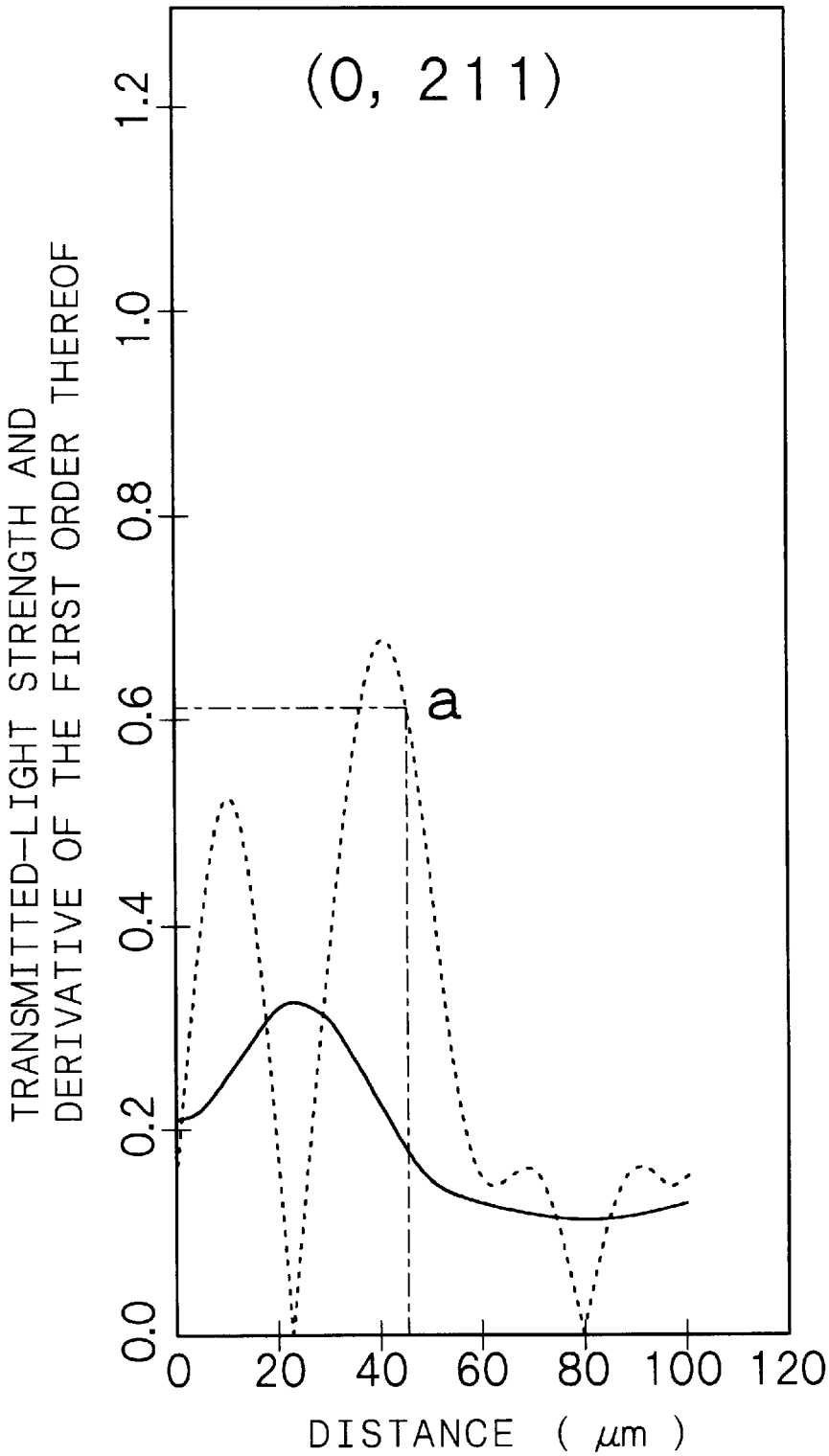
FIG. 11 is a graph showing a transmitted-light strength distribution of superposed Fresnel diffraction waves of exposure lights which pass through a slit in a coordinate of (0,211) in the bulb for a color cathode ray tube in Example 1 of the present invention and a derivative of the first order (∂I/∂x) thereof.
Figure 12:
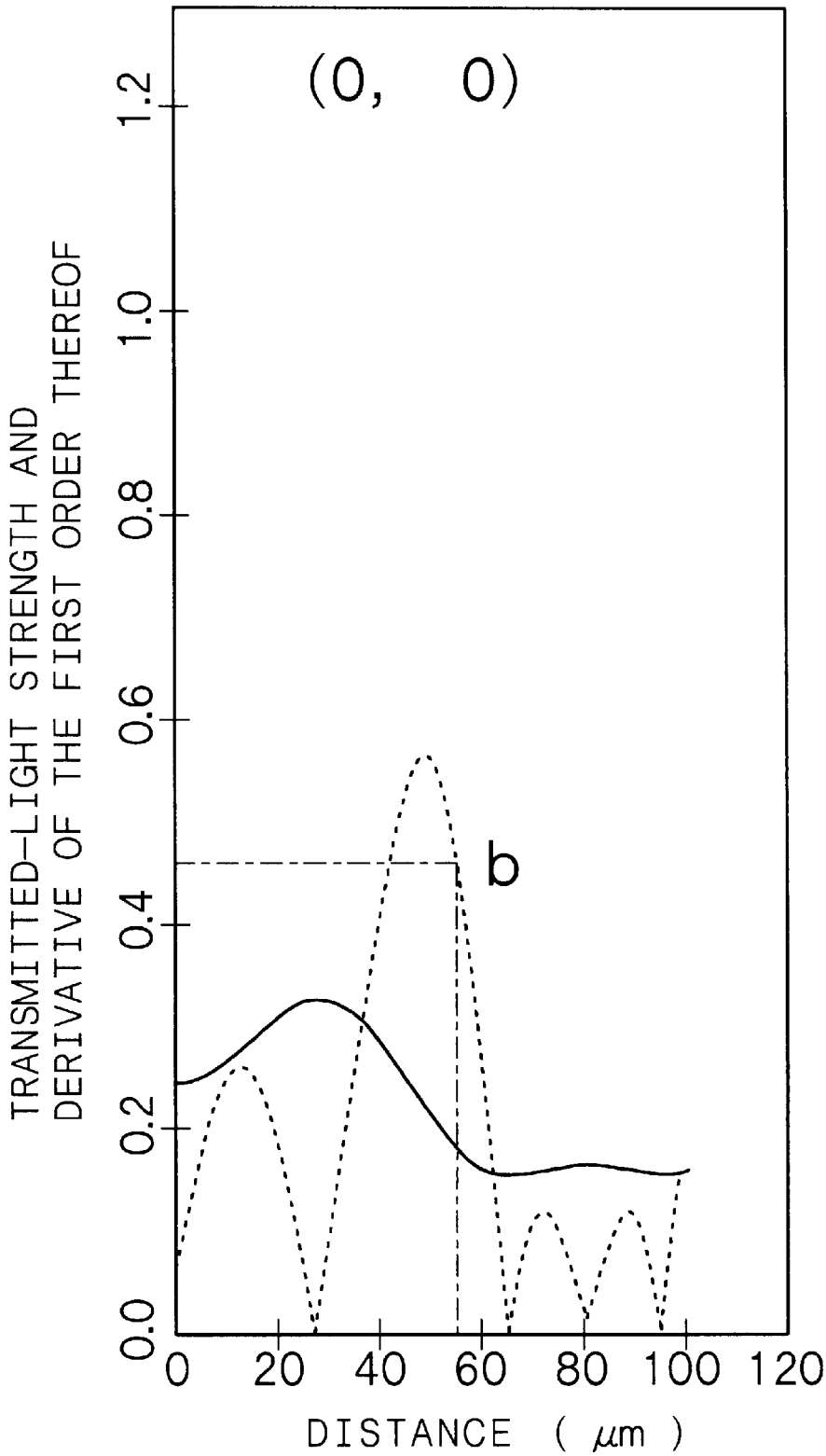
FIG. 12 is a graph showing a transmitted-light strength distribution of superposed Fresnel diffraction waves of exposure lights which pass through a slit in a coordinate of (0,0) in the bulb for a color cathode ray tube in Example 1 of the present invention and a derivative of the first order (∂i/∂x) thereof.
Figure 13:
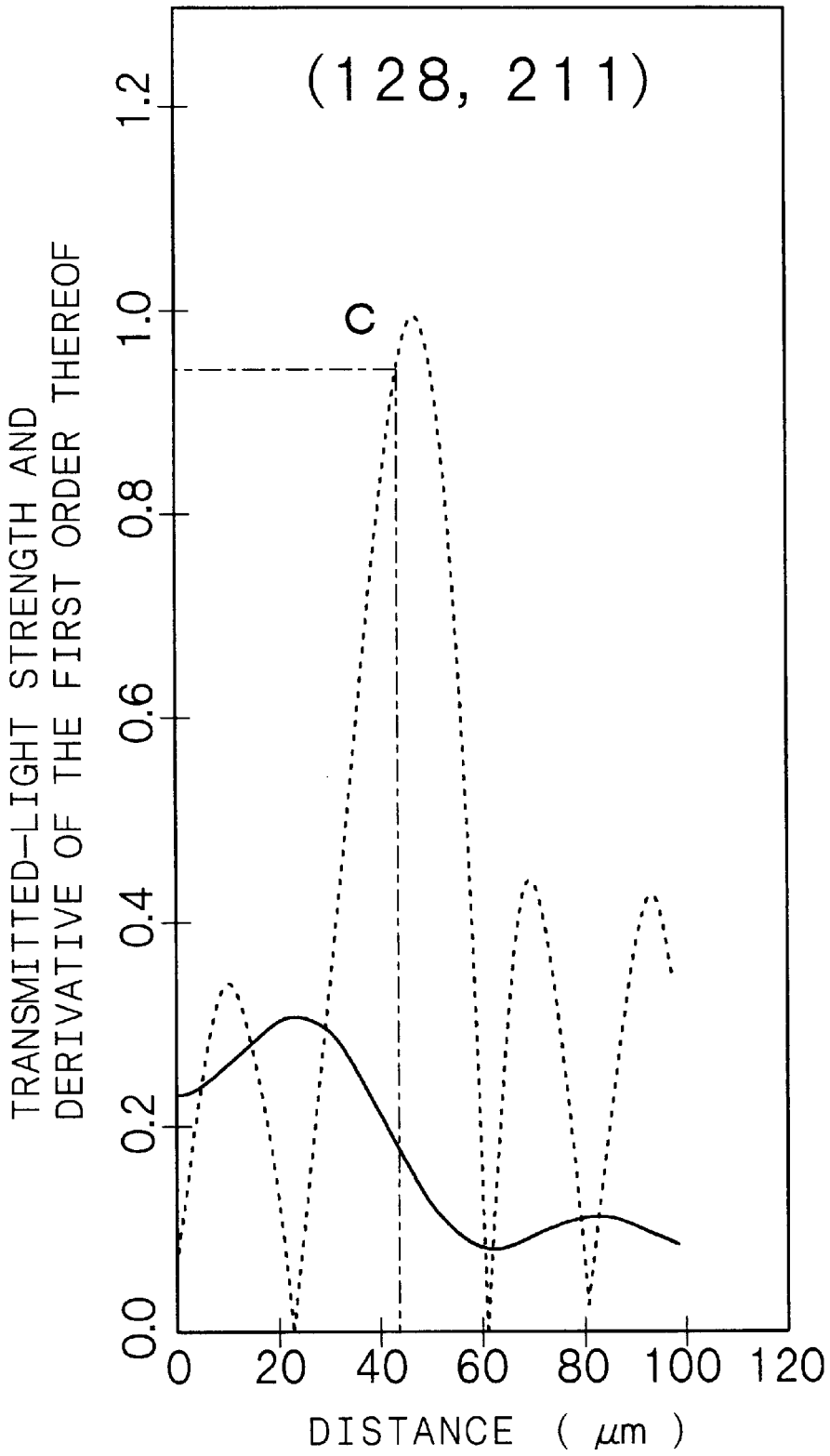
FIG. 13 is a graph showing a transmitted-light strength distribution of superposed Fresnel diffraction waves of exposure lights which pass through a slit in a coordinate of (128,211) in the bulb for a color cathode ray tube in Example 1 of the present invention and a derivative of the first order (∂i/∂x) thereof.
Figure 14:
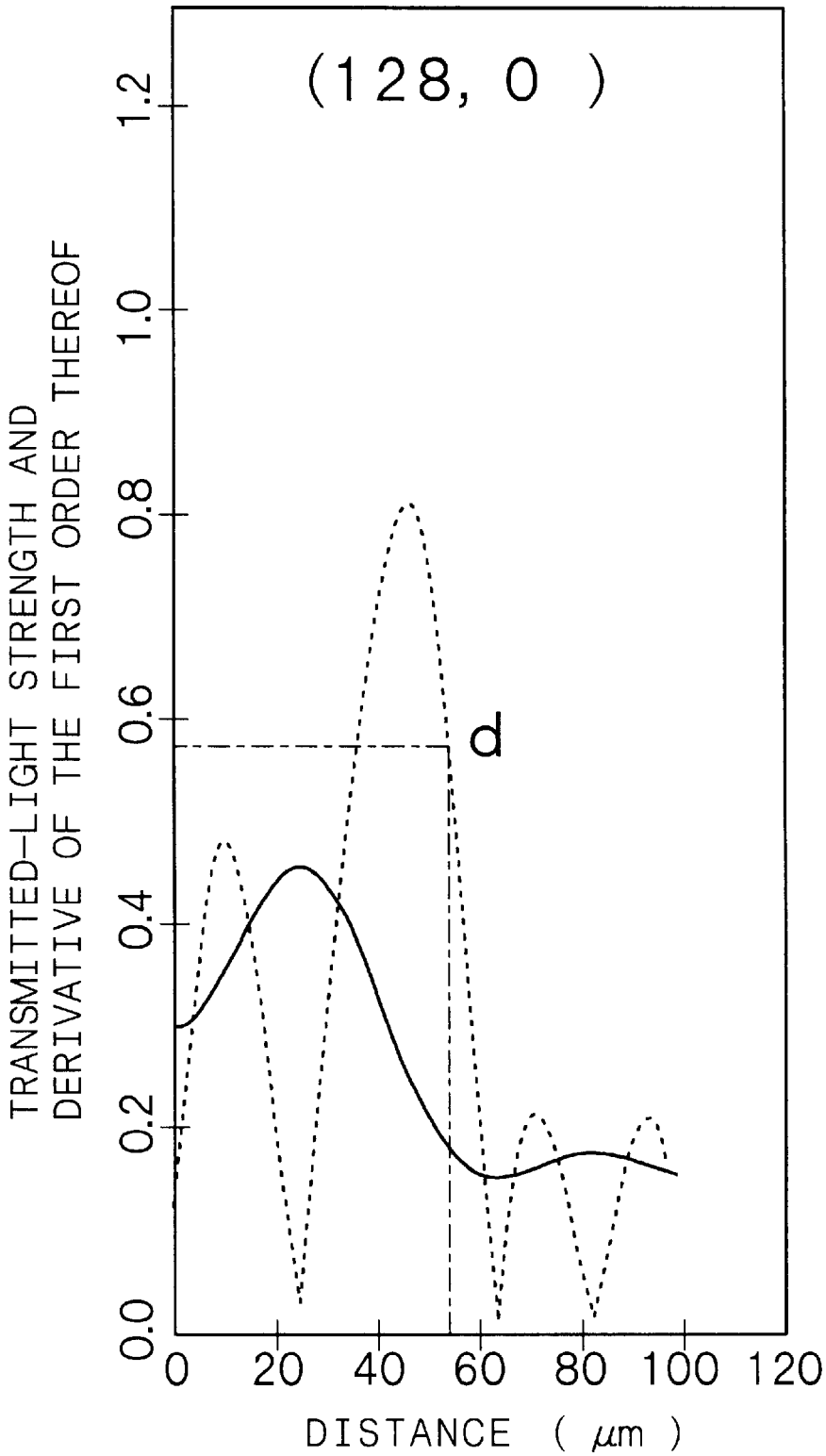
FIG. 14 is a graph showing a transmitted-light strength distribution of superposed Fresnel diffraction waves of exposure lights which pass through a slit in a coordinate of (128,0) in the bulb for a color cathode ray tube in Example 1 of the present invention and a derivative of the first order (∂I/∂x) thereof.
Figure 15:
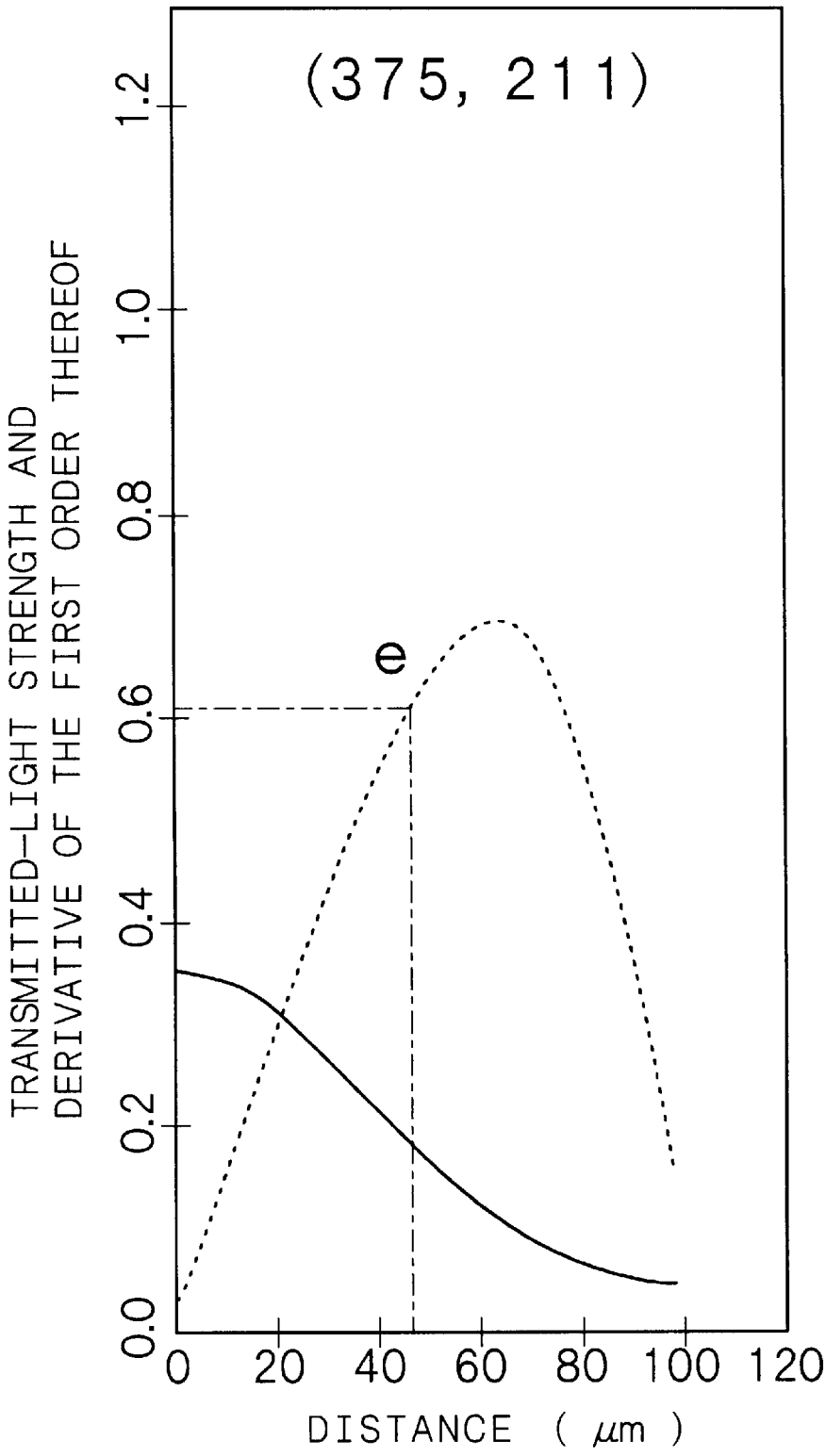
FIG. 15 is a graph showing a transmitted-light strength distribution of superposed Fresnel diffraction waves of exposure lights which pass through a slit in a coordinate of (375,211) in the bulb for a color cathode ray tube in Example 1 of the present invention and a derivative of the first order (∂I/∂x) thereof.
Figure 16:
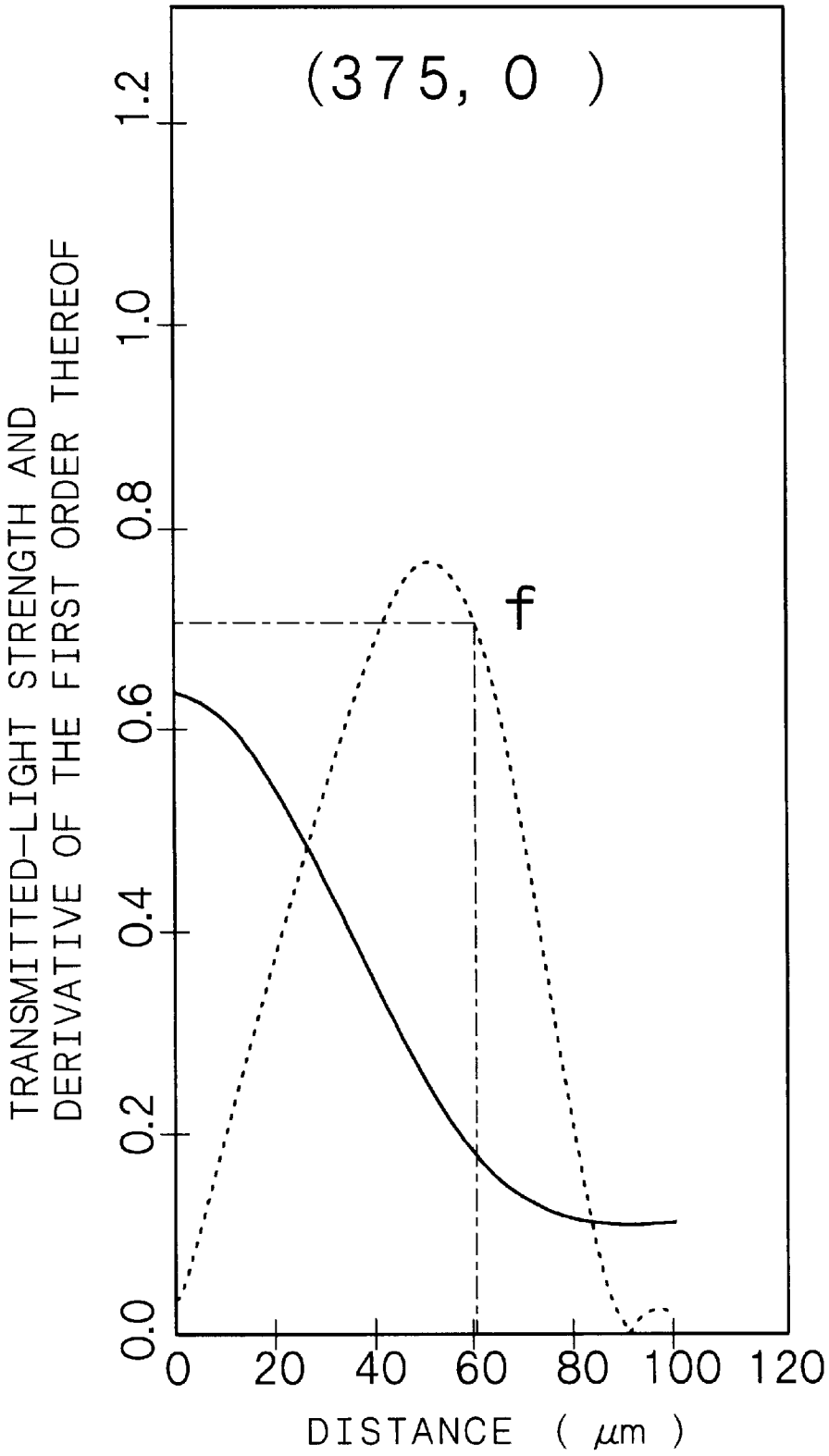
FIG. 16 is a graph showing a transmitted-light strength distribution of superposed Fresnel diffraction waves of exposure lights which pass through a slit in a coordinate of (375,0) in the bulb for a color cathode ray tube in Example 1 of the present invention and a derivative of the first order (∂I/∂x) thereof.
Figure 17:
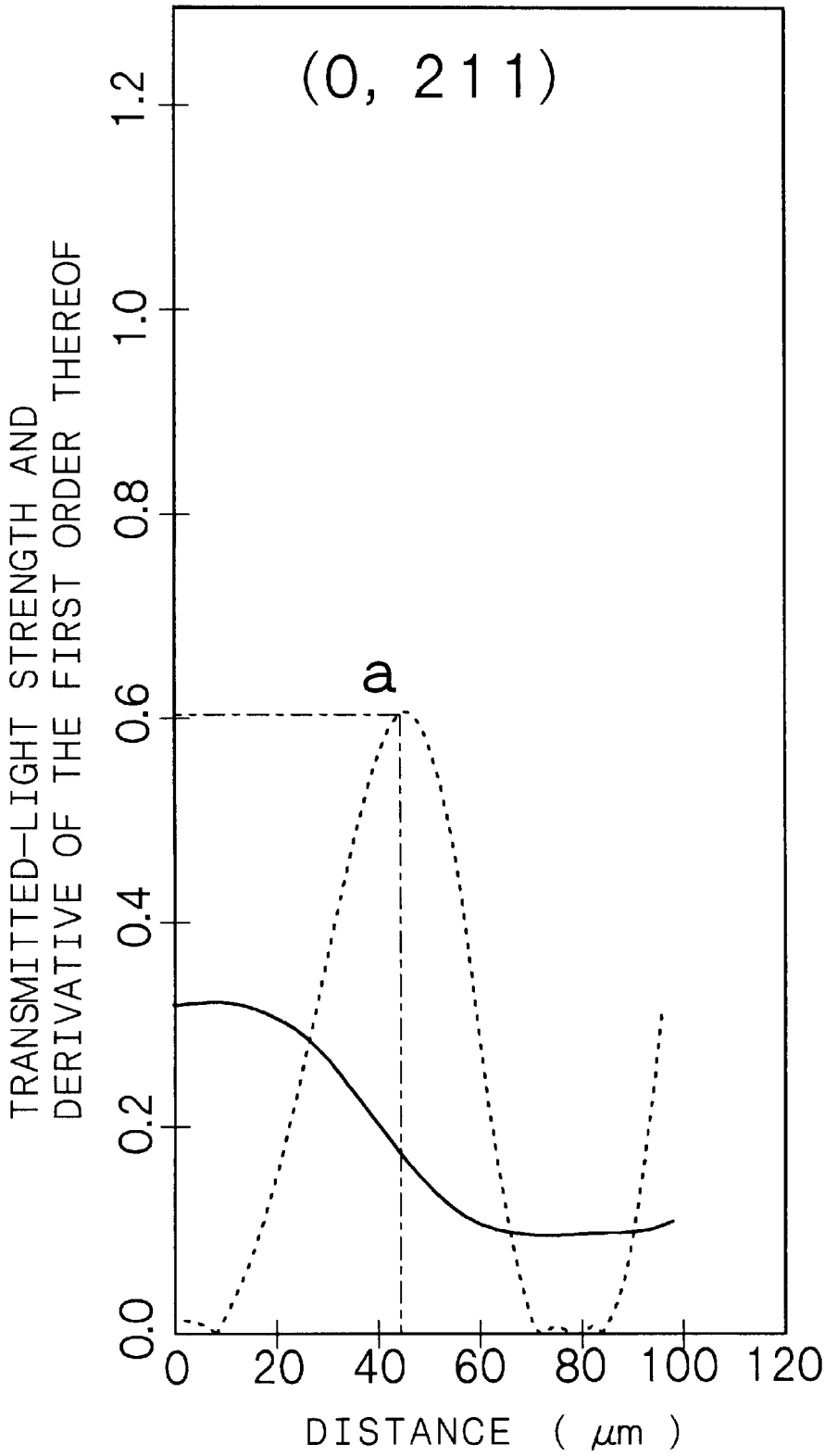
FIG. 17 is a graph showing a transmitted-light strength distribution of superposed Fresnel diffraction waves of exposure lights which pass through a slit in a coordinate of (0,211) in the bulb for a color cathode ray tube in Example 2 of the present invention and a derivative of the first order (∂I/∂x) thereof.

The face plate 11 is bonded to a funnel 12 with a glass-containing adhesive as shown in a partially cut drawing of the bulb 10 in FIG. 9. A tension band 17 is wound around the face plate 11 in the vicinity of the funnel 12 to increase the strength of the bulb 10. As shown in a schematic perspective view of FIG. 10A, the color selection member 13 of aperture grille type is attached to a frame member 15 by a resistance welding method or a laser welding method in a state where a tension is applied thereto in the y-direction. The frame member 15 is removably attached to the face plate 11 with an attaching tool 16 made of a spring. As shown in FIG. 10B, the color selection member 13 has slits 14 corresponding to the opening portions.

Figure 2:
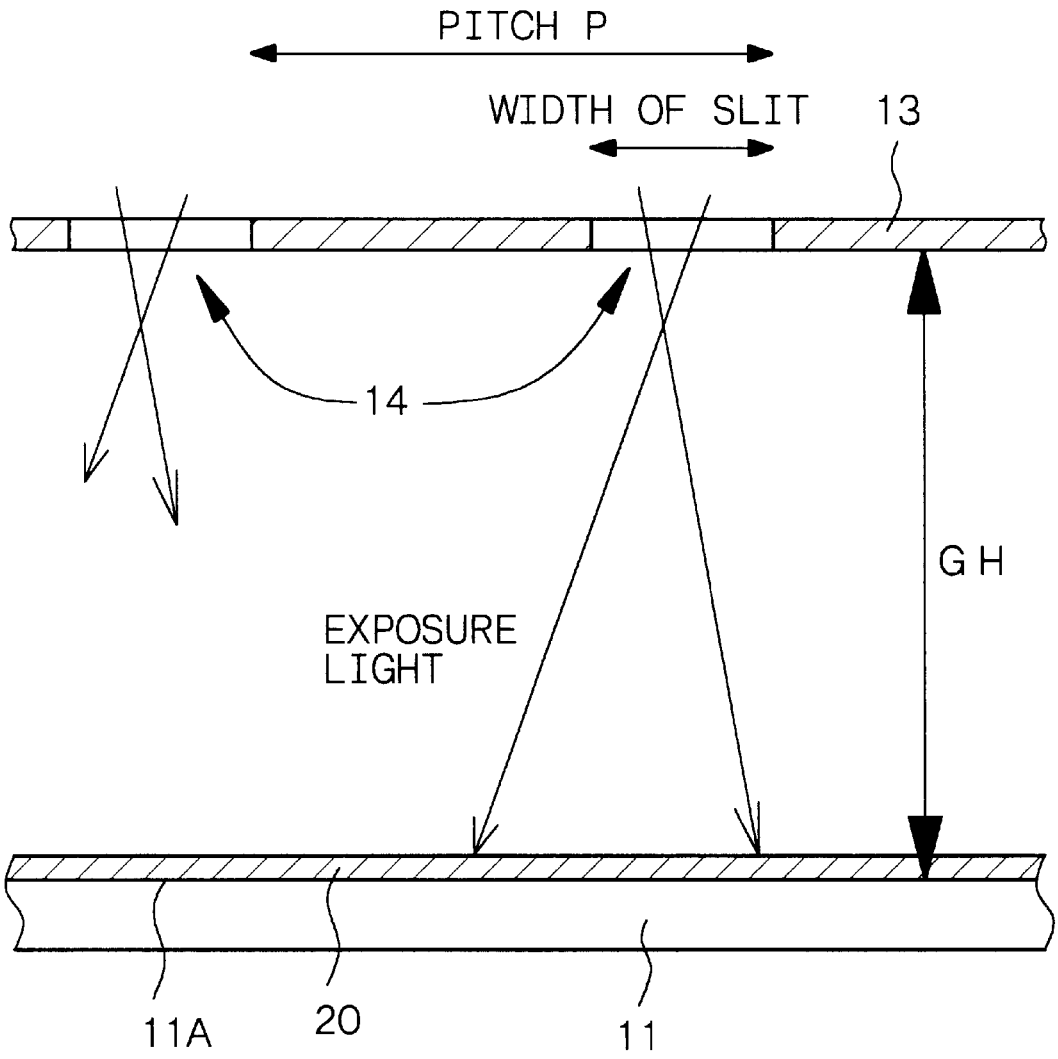
FIG. 2 is an enlarged schematic partial cross-sectional view of a face plate, a color selection member, etc., in Example 1 of the present invention.

FIG. 2 is an enlarged schematic partial cross-sectional view of some constituent elements of the bulb 10 such as the face plate 11, the color selection member 13, etc. The bulb or the color cathode ray tube in Example 1 satisfies the following expressions (1) and (2), wherein X is a nominal diagonal inchage of the bulb 10, P (unit: mm) is a pitch of the opening portions along an electron beam sweep direction (x-direction) in the central portion of the bulb 10 (more specifically, a pitch of the slits 14), GH (unit: mm) is a distance between an inner surface 11A of the face plate 11 and the color selection member 13 in the central portion of the bulb 10, and LT (corresponding to an opening rate) is a value obtained by dividing a size of the opening portion (specifically, the width of the slit 14) (unit: mm) along the electron beam sweep direction in the central portion of the bulb 10 by the pitch P (more specifically, the pitch of the slits 14). In Example 1, specifically, the value of $P \times LT \times GH^{-1/2}$ was determined to be $3.4 \times 10^{-2}$.

$$0.0117X-0.0457<P<0.018X-0.0771 \quad (1)$$

$$2.8\times10^{-2}<P\times LT\times GH^{-1/2}<4.1\times10^{-2} \quad (2)$$

Figure 7:
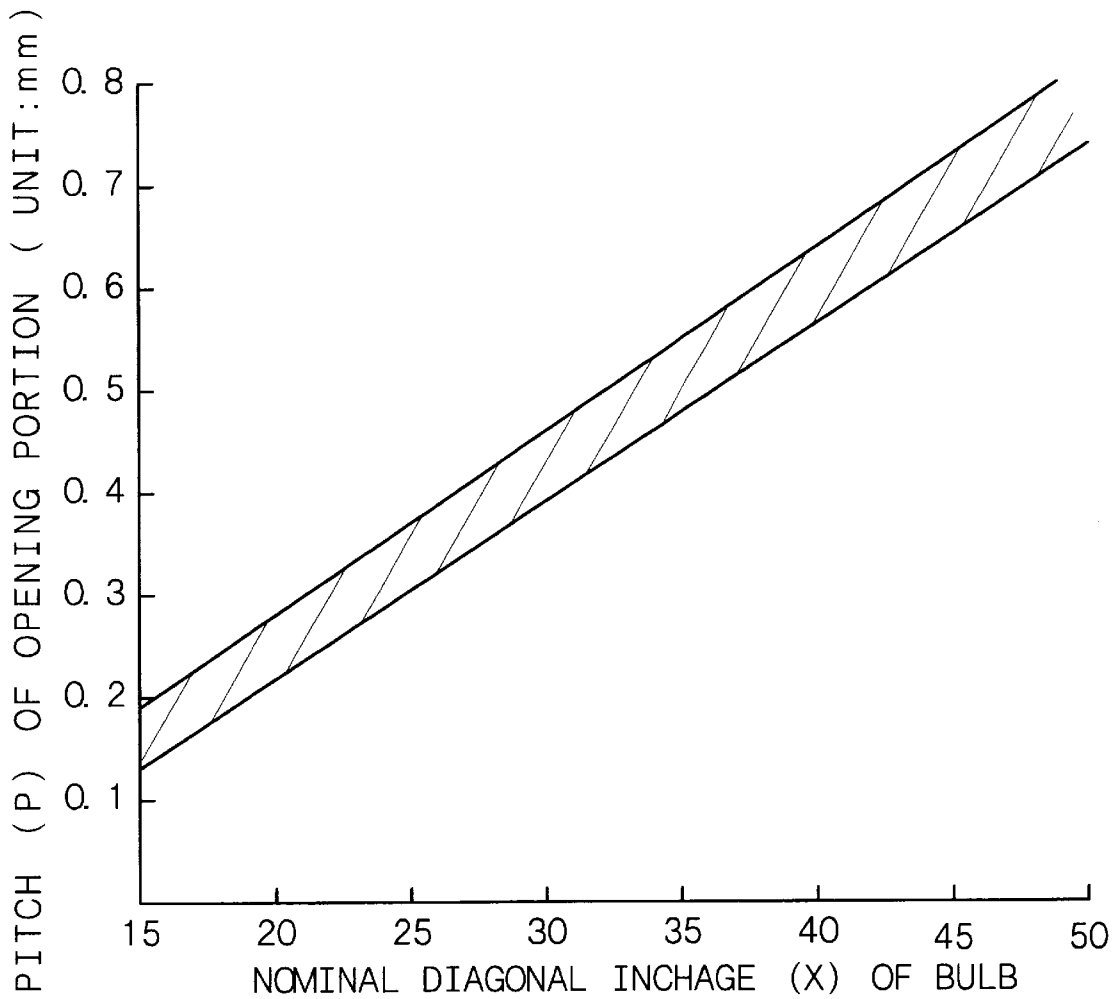
FIG. 7 is a graph of relational expression (1) of a nominal diagonal inchage X of a bulb for a color cathode ray tube and a pitch P of opening portions of a color selection member in the central portion of a bulb for a color cathode ray tube.
Figure 8:
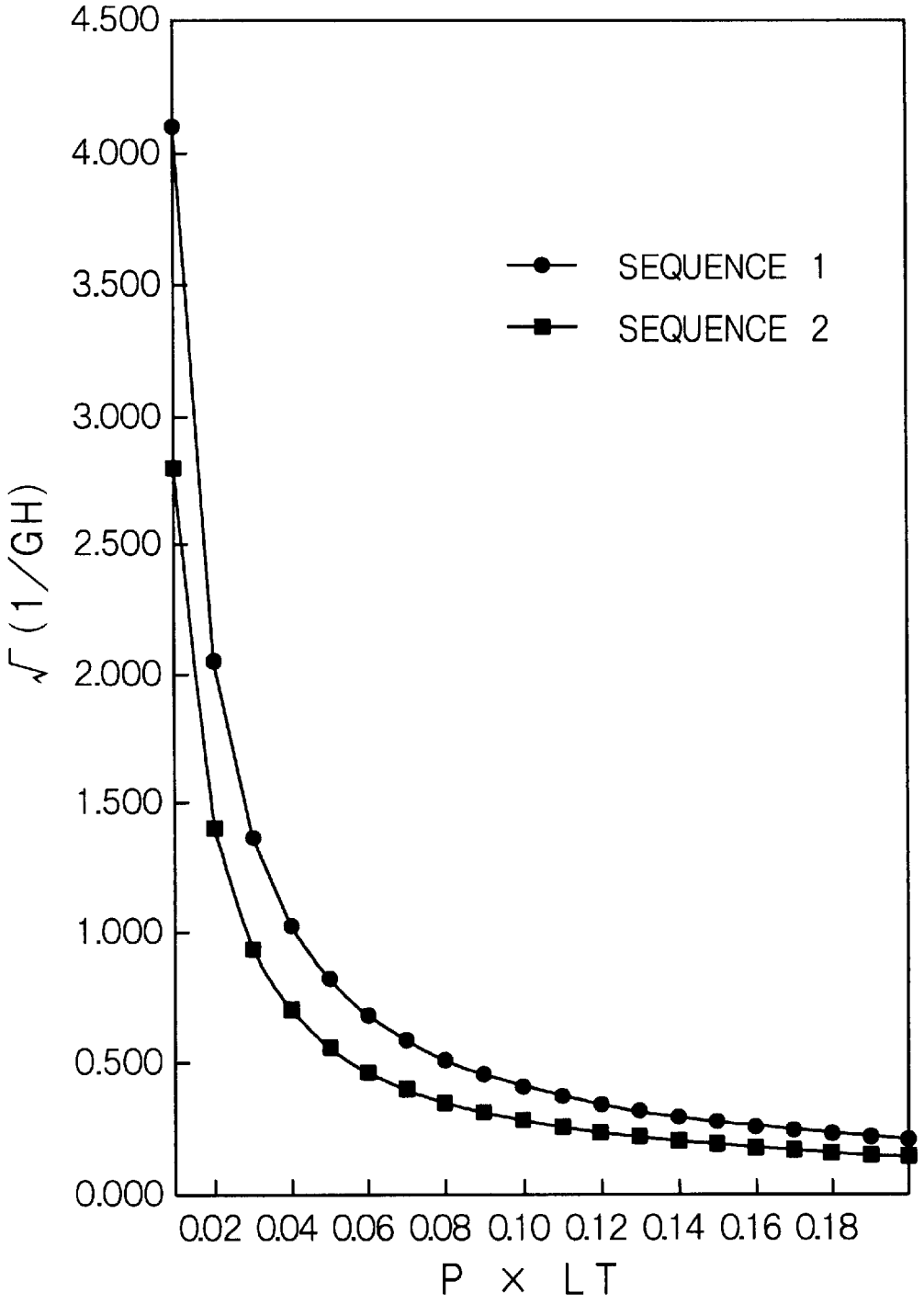
FIG. 8 is a graph of relational expression (2') of a distance GH between an inner surface of a face plate in the central portion of a bulb for a color cathode ray tube and a color selection member, a value of LT obtained by dividing the size of an opening portion (width of a slit) in the central portion of the bulb for a color cathode ray tube by the pitch P of the color selection member and the pitch P of the color selection member.

In FIG. 7, a region surrounded by the two straight lines corresponds to a region expressed by the expression (1). In FIG. 7, the axis of abscissas is the nominal diagonal inchage (X) of the bulb 10, and the axis of ordinates is the pitch (P) of the slits 14. A graph shown in FIG. 8 is a graph obtained by modifying the expression (2) to the following expression (2'), and a region surrounded by the two curves is a region expressed by the expression (2'). In FIG. 8, the axis of abscissas is (P×LT), and the axis of ordinates is $GH^{-1/2}$. A function expressed by the curve (sequence 1) formed by combining black circles is expressed by the following expression (2'-1), and a function expressed by the curve (sequence 2) formed by combining black squares is expressed by the following expression (2'-2).

$$2.8\times10^{-2}/(P\times LT)<GH^{-1/2}<4.1\times10^{-2}/(P\times LT) \quad (2')$$

$$GH^{-1/2}=4.1\times10^{-2}/(P\times LT) \quad (2'\text{-}1)$$

$$GH^{-1/2}=2.8\times10^{-2}/(P\times LT) \quad (2'\text{-}2)$$

The bulb or the color cathode ray tube in Example 1 can be produced by the step of exposing a light sensitive film 20 formed on the inner surface 11A of the face plate 11 on the basis of a transmitted-light strength distribution (corresponding to a superposed transmitted-light strength in Example 1) of superposed Fresnel diffraction waves of exposure lights which are emitted from a plurality of exposure light sources arranged in different positions along the electron beam sweep direction (specifically, the horizontal direction of the face plate 11) and pass through the opening portions (slits 14) formed in the color selection member 13, to form exposed regions (more specifically, stripe-shaped exposed regions) in the light sensitive film 20 which regions correspond to the opening portions (slits 14), so long as the expressions (1) and (2) are satisfied.

The method for producing the bulb in Example 1 is a method for producing a bulb for a color cathode ray tube which bulb comprises the face plate 11 and the color selection member 13 of aperture grille type having stripe-shaped slits 14 (corresponding a plurality of opening portions) extending in parallel with the vertical direction (y-direction) of the face plate 11 and satisfies the above expression (1) in which X is a nominal diagonal inchage of the bulb and P (unit: mm) is the pitch of the opening portions (more specifically, the pitch of the slits 14) along the electron beam sweep direction (x-direction) in the central portion of the bulb 10. The method for producing a color cathode ray tube in Example 1 is a method for producing a color cathode ray tube constituted of the above bulb.

Figure 1:
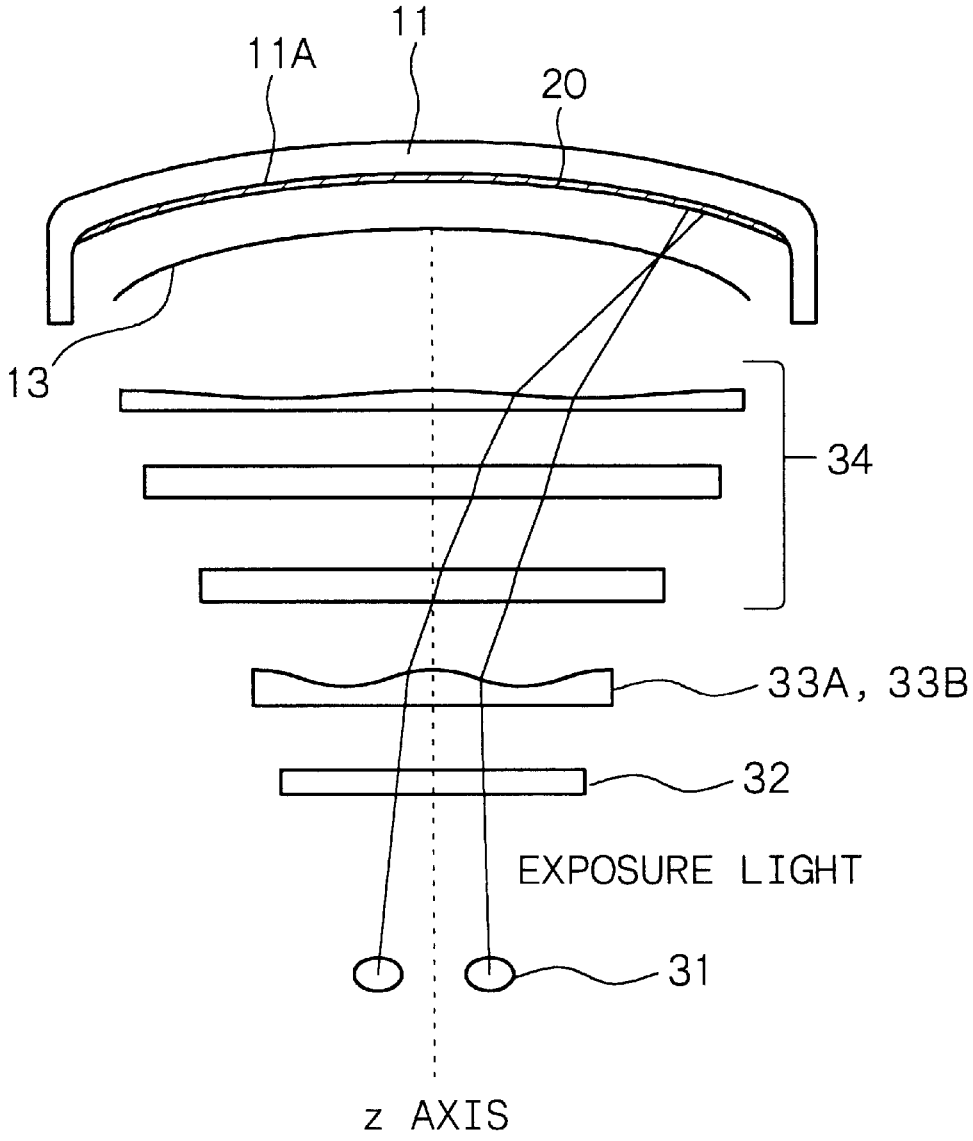
FIG. 1 is a conceptual view of an exposure apparatus suitable for practicing the method of Example 1 of the present invention.

In practicing the method for producing the bulb or the color cathode ray tube in Example 1 (to be generally referred to as "production method of Example 1" hereinafter), there is used a plurality of exposure light sources 31 (two ultraviolet light sources in Example 1) which are disposed in different positions along the horizontal direction (x-direction) of the face plate which direction is the electron beam sweep direction, as shown in the conceptual drawing of an exposure apparatus in FIG. 1. Further, a correction lens system is disposed between the exposure light sources 31 and the color selection member 13. The correction lens system comprises an illumination correction filter 32, first correction lenses 33A and 33B and a second correction lens group 34 which are positioned in this order from the exposure light sources 31 side. The illumination correction filter 32 serves to optimize the size (width) of the fluorescent material layers to be obtained on the entire surface of the face plate 11. The second correction lenses group 34 made of glass serves to approximate the paths of the exposure lights during the exposure to the paths of actual electron beams.

Further, when the first correction lenses 33A and 33B made of glass are provided, there can be attained a large value of the derivative of the first order ($\partial I/\partial x$) of the transmitted-light strength in the edge portion of the exposed stripe-shaped light sensitive film all over the inner surface of the face plate 11, and the edge portions of the exposed stripe-shaped light sensitive film can be included in an area of the transmitted-light strength corresponding to the first wave of the derivative of the first order ($\partial I/\partial x$). When the light sensitive film is exposed to a light from one exposure light source 31, the first correction lens 33A is used, and when the light sensitive film is exposed to a light from the other exposure light source 31, the first correction lens 33B is used. The first correction lens 33A and the first correction lens 33B have identical characteristics (but symmetrical characteristic with regard to a z-axis shown in FIG. 1). Each of the first correction lenses 33A and 33B has a smooth convexo-concave shape formed on one surface.

Specifically, the first correction lenses 33A and 33B for correcting Fresnel diffraction conditions are selected depending upon the exposure light sources used. In the exposure apparatus, a plurality of the exposure lights emitted from a plurality of the exposure light sources are adjusted such that their Fresnel diffraction waves are superposed on the light sensitive film 20 through the correction lens system 32, 33A, 33B, 34 and the color selection member 13 so that the light sensitive film 20 is exposed in the form of stripes having a predetermined width depending upon the slits corresponding to the opening portions. Further, a plurality of the exposure lights are adjusted such that the value of the derivative of the first order ($\partial I/\partial x$) of the transmitted-light strength corresponding to the edge portions of the exposed stripe-shaped light sensitive film comes to be a value of a certain level or higher.

Figure 3:
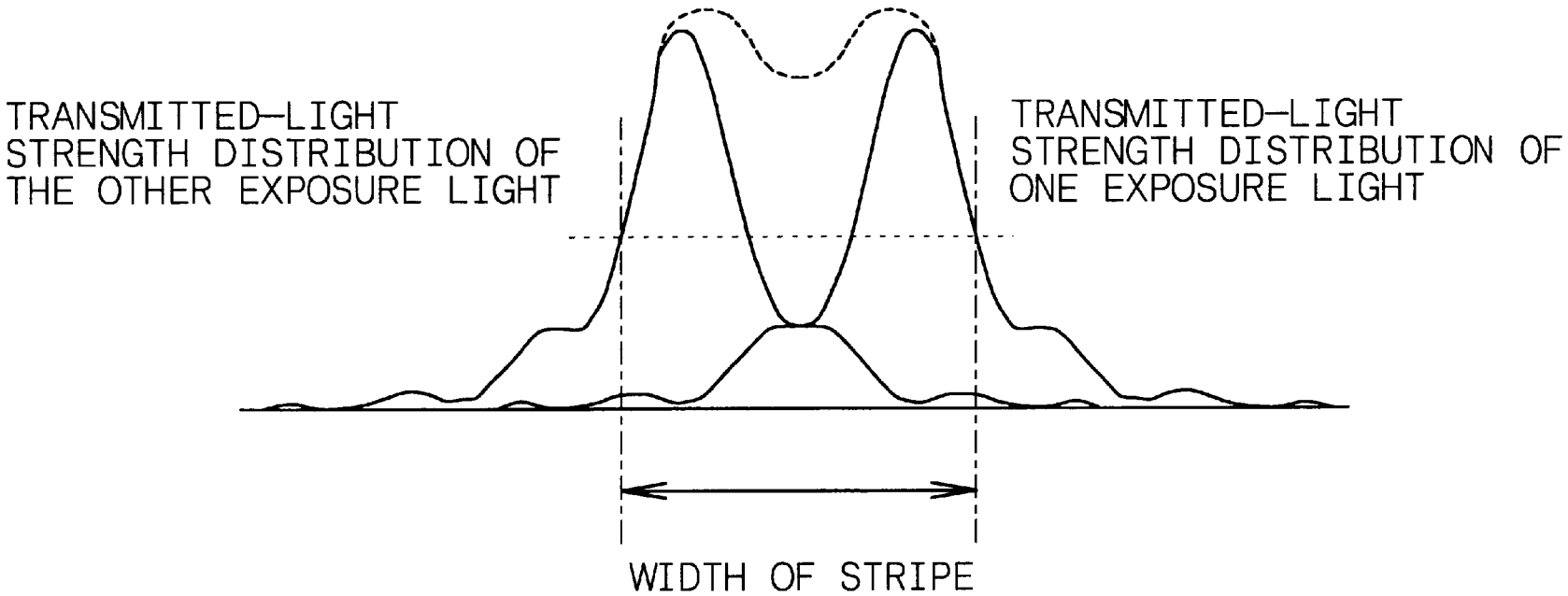
FIG. 3 is a schematic drawing of a transmitted-light strength distribution of superposed Fresnel diffraction waves of exposure lights which pass through one slit in Example 1 of the present invention.
Figure 47A:
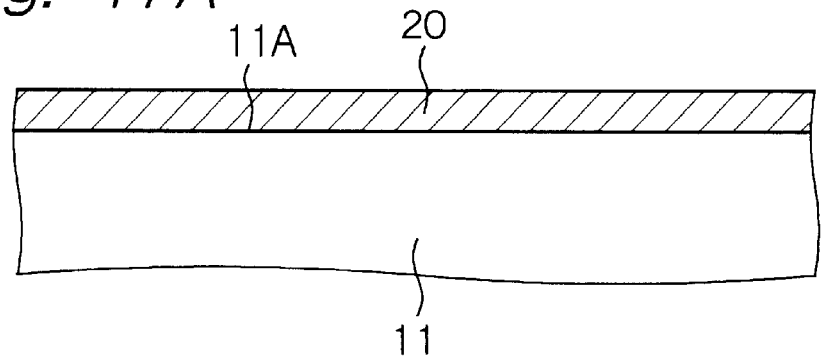
FIGS. 47A, 47B and 47C are schematic partial end views of a face plate, etc., for explaining the steps of producing a bulb for a color cathode ray tube.
Figure 47B:
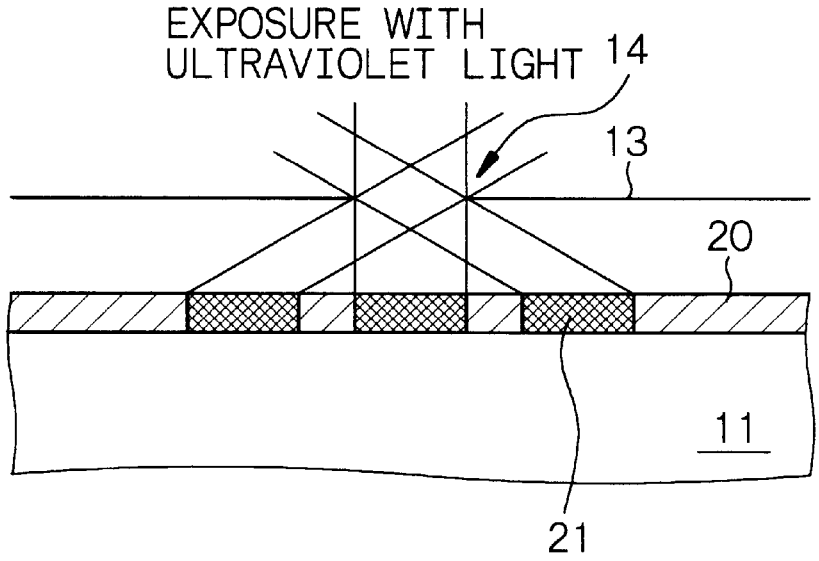

In the production method of Example 1, the face plate 11 having the inner surface 11A on which the light sensitive film 20 is formed (applied) is prepared (see FIG. 47A). The light sensitive film 20 formed (applied) on the inner surface 11A of the face plate 11 is exposed to the exposure lights (see FIGS. 1 and 2) to form stripe-shaped exposed regions 21 in the light sensitive film 20 corresponding to the slits (see FIG. 47B) on the basis of the transmitted-light strength distribution of superposed Fresnel diffraction waves of the exposure lights which are emitted from a plurality of the exposure light sources 31 (two exposure light sources in Example 1) arranged in different positions along the horizontal direction of the face plate (x-direction), the electron beam sweep direction, and which pass through the slits 14 corresponding to the opening portions formed in the color selection member 13. FIG. 3 schematically shows, by a solid line, one example of each transmitted-light strength distribution of a Fresnel diffraction wave of each of the two exposure lights which pass through one slit 14. A convexo-convex curved portion shown by a dotted line indicates a portion of a transmitted-light strength distribution in which portion the two exposure lights are superposed, that is, part of the transmitted-light strength distribution of superposed Fresnel diffraction waves of the two exposure lights.

FIGS. 11, 12, 13, 14, 15 and 16 show results of measurement of transmitted-light strength distributions of superposed Fresnel diffraction waves of the two exposure lights which pass through the slits 14 in coordinates (0,211), (0,0), (128,211), (128,0), (375,211) and (375,0) where the nominal diagonal inchage X of the bulb 10 is 36 (X=36), the center of the face plate 11 is an origin, a straight line extending in the horizontal direction (x-direction) of the face plate and passing through the origin is an x-axis and a straight line extending in the vertical direction (y-direction) of the face plate and passing through the origin is a y-axis. The unit of values in the coordinates is "mm". In each drawing, the derivative of the first order ($\partial I/\partial x$) of the transmitted-light strength is shown by a dotted line. In FIGS. 11 to 16 and FIGS. 17 to 46 to be discussed later, the axis of abscissas shows a distance (unit: $\mu$m) from the center of the stripe-shaped exposed region of the light sensitive film, and the axis of ordinates shows relative values of the transmitted-light strength and the derivative of the first order ($\partial I/\partial x$) thereof. A chain line in parallel with the axis of ordinates shows a position corresponding to the edge portion of the exposed stripe-shaped light sensitive film. A transmitted-light strength in a point where the axis of ordinates and the transmitted-light strength cross each other corresponds to $I_{CENTER}$, and a transmitted-light strength in a point where the chain line in parallel with the axis of ordinates and the transmitted-light strength cross each other corresponds to $I_{EDGE}$.

As shown in FIGS. 11 to 16, in an area of the transmitted-light strength in which area the transmitted-light strength on the light sensitive film 20 decreases (first) along the horizontal direction (x-direction), the electron beam sweep direction, from the central portion of the stripe-shaped exposed region corresponding the opening portion, the derivative of the first order ($\partial I/\partial x$) of the superposed transmitted-light strength has at least one upward-convex area. And, the edge portion (see chain lines a, b, c, d, e and f in parallel with the axis of ordinates) of the exposed stripe-shaped light sensitive film corresponding to the opening portion is included in an area of the superposed transmitted-light strength corresponding to the upward-convex area (first wave) appearing first along the horizontal direction of the face plate, the electron beam sweep direction, from the central portion of the stripe-shaped exposed region, out of the upward-convex areas of the derivative of the first order ($\partial I/\partial x$) of the superposed transmitted-light strength.

In FIGS. 11, 12, 13 and 14, due to the superposing of the two exposure lights, the transmitted-light strength on the light sensitive film 20 increases first and then decreases along the horizontal direction (x-direction) of the face plate from the central portion of the stripe-shaped exposed region. In this increasing area, the derivative of the first order ($\partial I/\partial x$) of the transmitted-light strength also has an upward-convex area. However, this upward-convex area is not the "upward-convex area which appears first (first wave)".

For forming fluorescent material layers for red, green and blue, the above exposure procedures were carried out three times (total six times) with regard to each color by changing the exposure light sources. In this manner, stripe-shaped exposed regions were formed in the light sensitive film formed on the entire of inner surface of the face plate. In this case, no convexo-concave shapes were observed in edge portions of the obtained exposed regions, and each of the edge portions was in the form of a straight line.

Figure 47C:
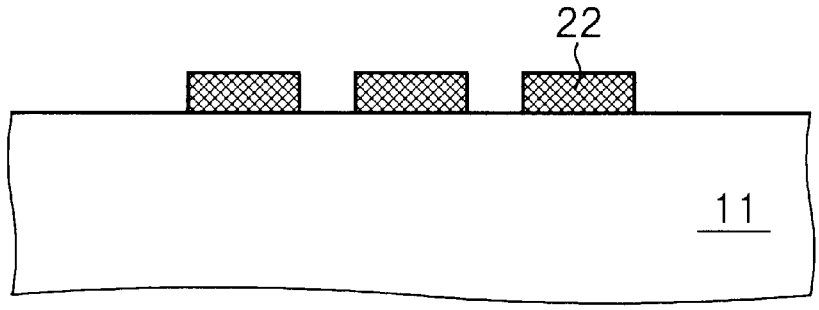
Figure 48A:
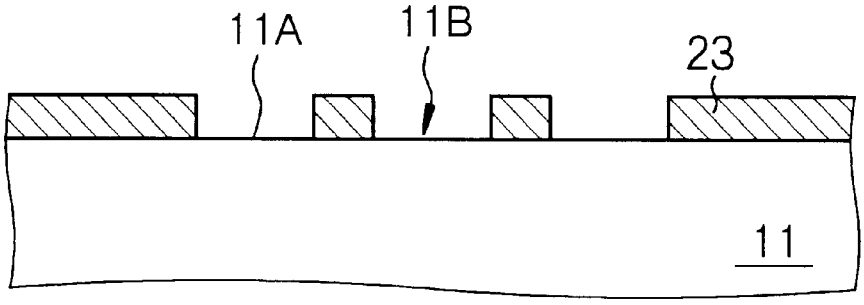
FIGS. 48A and 48B, following
Figure 48B:
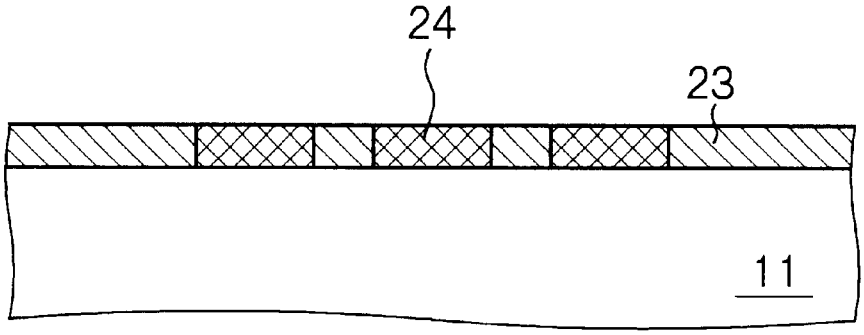
Figure 49A:
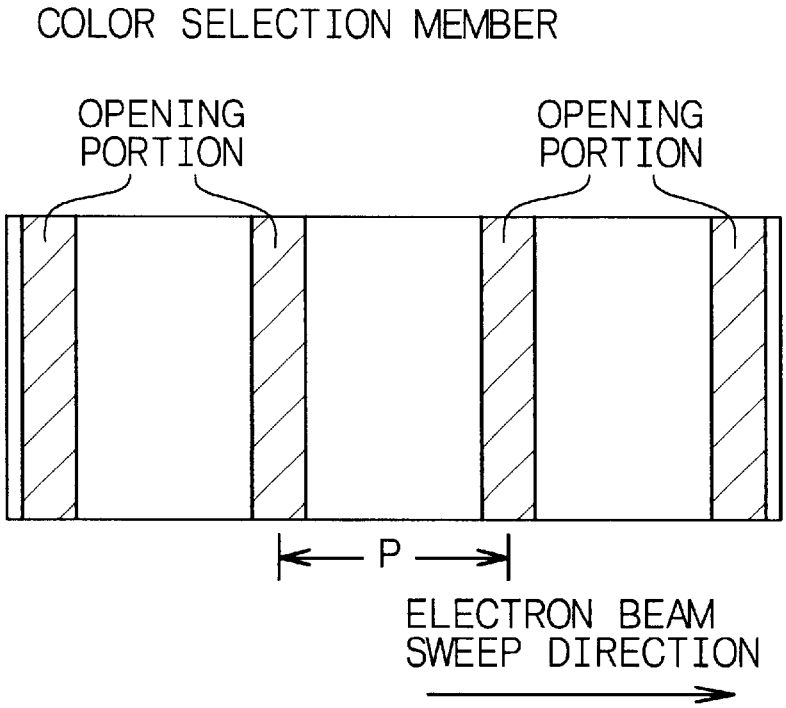
FIGS. 49A and 49B are layouts of a color selection member and fluorescent material layers when the color selection member is of aperture grille type.
Figure 49B:
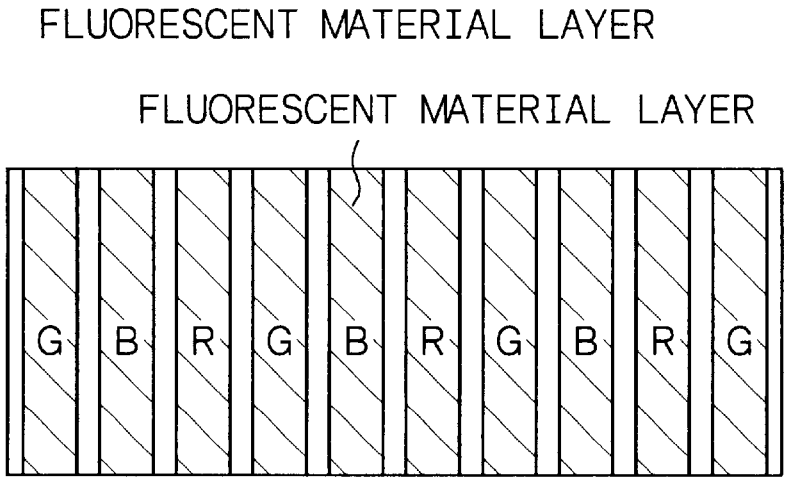
Figure 50A:
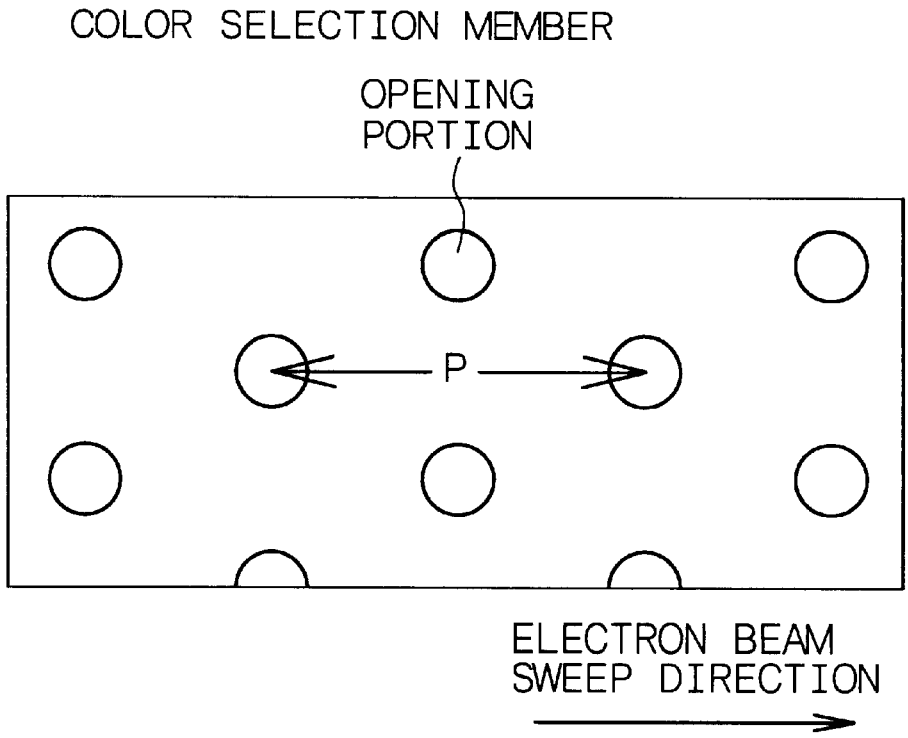
FIGS. 50A and 50B are layouts of a color selection member and fluorescent material layers when the color selection member is of dot-type shadow mask type.
Figure 50B:
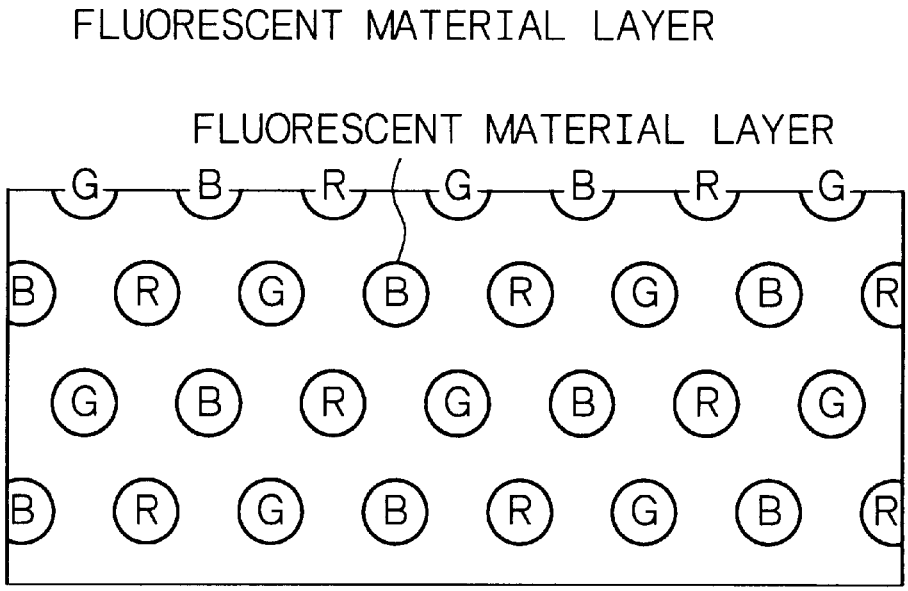
Figure 51A:
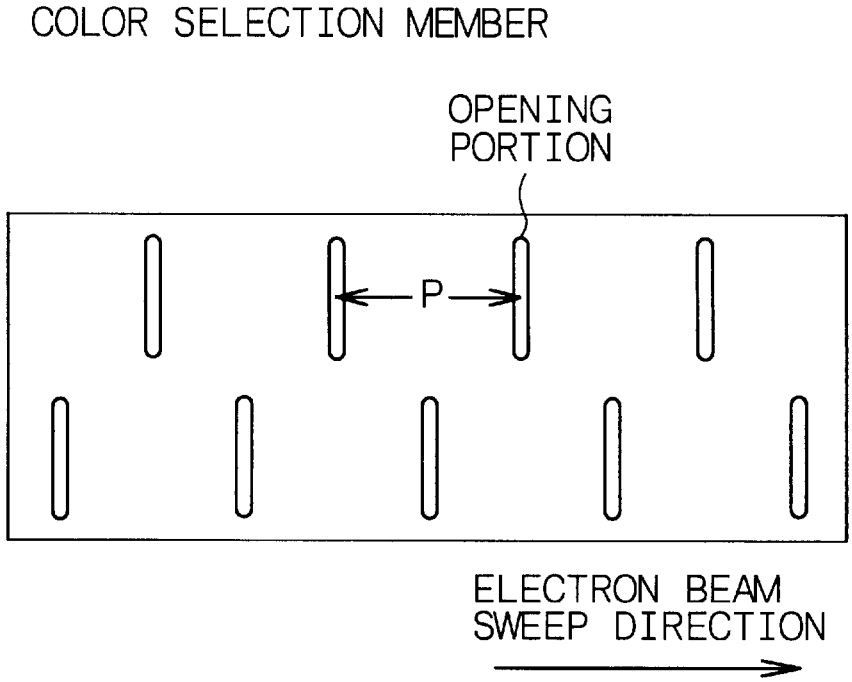
FIGS. 51A and 51B are layouts of a color selection member and fluorescent material layers when the color selection member is of slot-type shadow mask type.
Figure 51B:
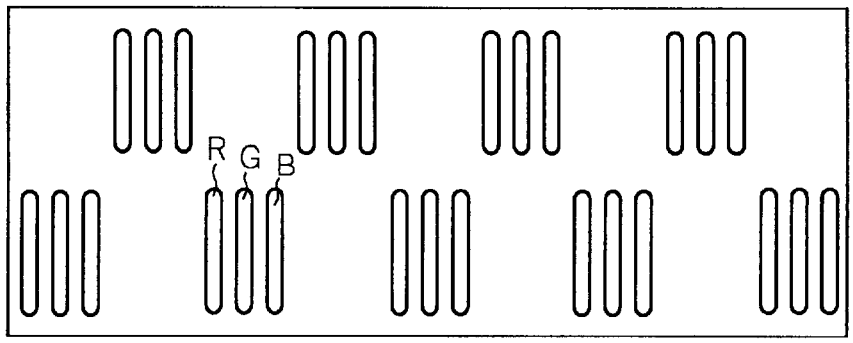
Figure 52A:
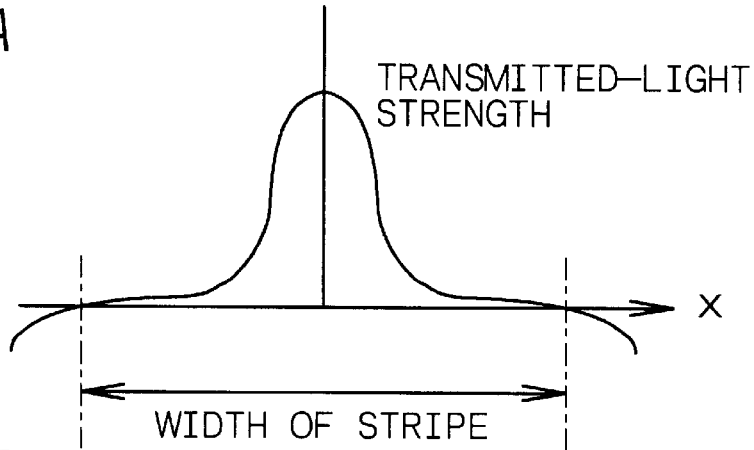
FIGS. 52A and 52B are schematic drawings of a distribution of a Fresnel diffraction wave of an exposure light emitted from one exposure light source and a state where heavy convexo-concave shapes are caused in edge portions of a light sensitive film remaining on a face plate.
Figure 52B:
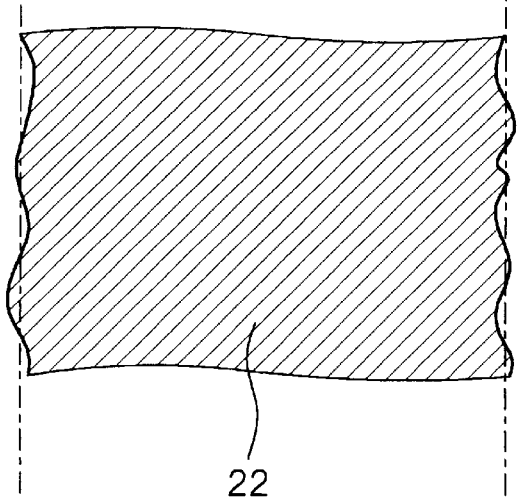

Then, the light sensitive film 20 is selectively removed by development, and a remaining portion 22 of the light sensitive film (light sensitive film after the exposure and development) is retained on the inner surface 11A of the face plate 11 (see FIG. 47C). Then, a carbon agent (carbon slurry) is applied to the entire surface, dried and calcined or sintered, and then, the remaining portion 22 of the light sensitive film and the carbon agent thereon are removed by a lift-off method, to form a stripe-shaped black-matrix 23 composed of the carbon agent on the exposed inner surface 11A of the face plate 11 in the form of a stripe and also to remove the remaining portion 22 of the light sensitive film (see FIG. 48A). Then, stripe-shaped fluorescent material layers 24 for red, green and blue are formed on the exposed inner surface 11A (portion 11B of the inner surface 11A exposed between black-matrixes (light absorption layers) 23) of the face plate 11 (see FIG. 48B). Specifically, for example, a photosensitive fluorescent material slurry for red is applied to the entire surface, followed by exposure and development, then, a photosensitive fluorescent material slurry for green is applied to the entire surface, followed by exposure and development, and a photosensitive fluorescent material slurry for blue is applied to the entire surface, followed by exposure and development. Then, the face plate and a funnel, etc., are assembled, to complete a bulb for a color cathode ray tube. Further, an electron gun is incorporated into the obtained bulb, and the inside of the bulb is vacuumed, to complete a color cathode ray tube.

The thus-obtained color cathode ray tube was used to display images, to show no non-uniformity in displayed images, so that the obtained color cathode ray tube had excellent qualities.

EXAMPLE 2

Figure 53A:
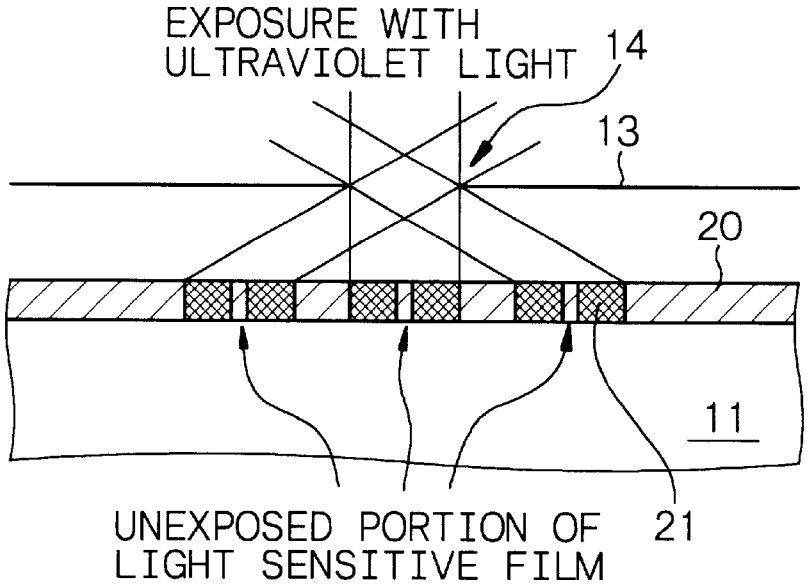
FIGS. 53A and 53B are schematic partial cross-sectional views of a light sensitive film remaining on a face plate, for explaining a problem caused when two exposure light sources are used.
Figure 53B:
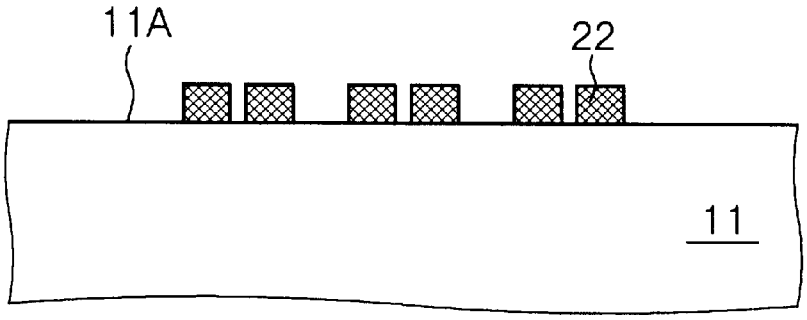

Example 1 used two exposure light sources. However, on exposure of the light sensitive film, the central portion thereof in particular, is insufficiently exposed with some exposure apparatus or under some exposure conditions. In such a case, when the light sensitive film 20 is developed and selectively removed to retain a remaining portion 22 of the light sensitive film (light sensitive film after exposure and development) on the inner surface 11A of the face plate 11, those portions of the light sensitive film which portions correspond to the central portions of the opening portions are not retained as shown in a schematic partial cross-sectional view of the light sensitive film retained on the face plate, as shown in FIGS. 53A and 53B. For reliably preventing the above phenomenon, it is required to use three or more exposure light sources.

Example 2 is a variant of Example 1. Differing from Example 1, Example 2 used three exposure light sources. Of three exposure light sources 31A, 31B and 31C, two exposure light sources 31A and 31C positioned outside correspond to exposure light sources for exposing an edge portion, and the exposure light source 31B positioned between the exposure light sources 31A and 31C for exposing an edge portion corresponds to an exposure light source for exposing a central portion. The bulb for a color cathode ray tube in Example 2 is structurally the same as the bulb for a color cathode ray tube explained in Example 1, so that a detailed explanation thereof is omitted. In Example 2, the above expressions (1) and (2) are also satisfied. Further, in Example 2, the value of $P \times LT \times GH^{-1/2}$ was also set at $3.4 \times 10^{-2}$. In the transmitted-light strength of superposed Fresnel diffraction waves of the exposure lights from the three exposure light sources 31A, 31B and 31C, further, $I_{CENTER}/I_{EDGE} \geqq 1.2$ is satisfied, wherein $I_{CENTER}$ is a transmitted-light strength in the central portion of an exposed region corresponding to each opening portion and $I_{EDGE}$ is a transmitted-light strength in an edge portion of the light sensitive film corresponding to each opening portion. Further, when the exposure light sources 31A and 31C for exposing an edge portion were individually operated to expose the light sensitive film formed on the inner surface of the face plate, each of the exposure light sources for exposing an edge portion was adjusted to satisfy $I_{MIN} \leqq I_1$, wherein $I_1$ is a transmitted-light strength in an edge portion of the light sensitive film corresponding to each opening portion and IMIN is the lowest transmitted-light strength required for exposing the light sensitive film.

The bulb or the color cathode ray tube in Example 2 can be produced by the step of exposing the light sensitive film 20 formed on the inner surface 11A of the face plate 11 on the basis of a transmitted-light strength distribution of superposed Fresnel diffraction waves of the exposure lights which are emitted from a plurality of exposure light sources (the three exposure light sources 31A, 31B and 31C in Example 2) arranged in different positions along the electron beam sweep direction (specifically, the horizontal direction of the face pate 11) and pass through the opening portions (slits 14) formed in the color selection member 13, to form exposed regions (more specifically, stripe-shaped exposed regions) in the light sensitive film 20 corresponding to the opening portions (the slits 14), so long as the expressions (1) and (2) are satisfied.

The method for producing a bulb for a color cathode ray tube in Example 2 is a method for a bulb for a color cathode ray tube which bulb comprises a face plate 11 and a color selection member 13 of aperture grille type having stripe-shaped slits 14 (corresponding to a plurality of the opening portions) extending in parallel with the vertical direction (y-direction) of the face plate 11 and satisfies the above expression (1), wherein X is a nominal diagonal inchage of the bulb and P (unit: mm) is a pitch of the opening portions along the electron beam sweep direction (x-direction) in the central portion of the bulb (more specifically, a pitch of the slits 14). Further, the method for producing a color cathode ray tube in Example 2 is a method for producing a color cathode ray tube comprising the above bulb.

Figure 4:
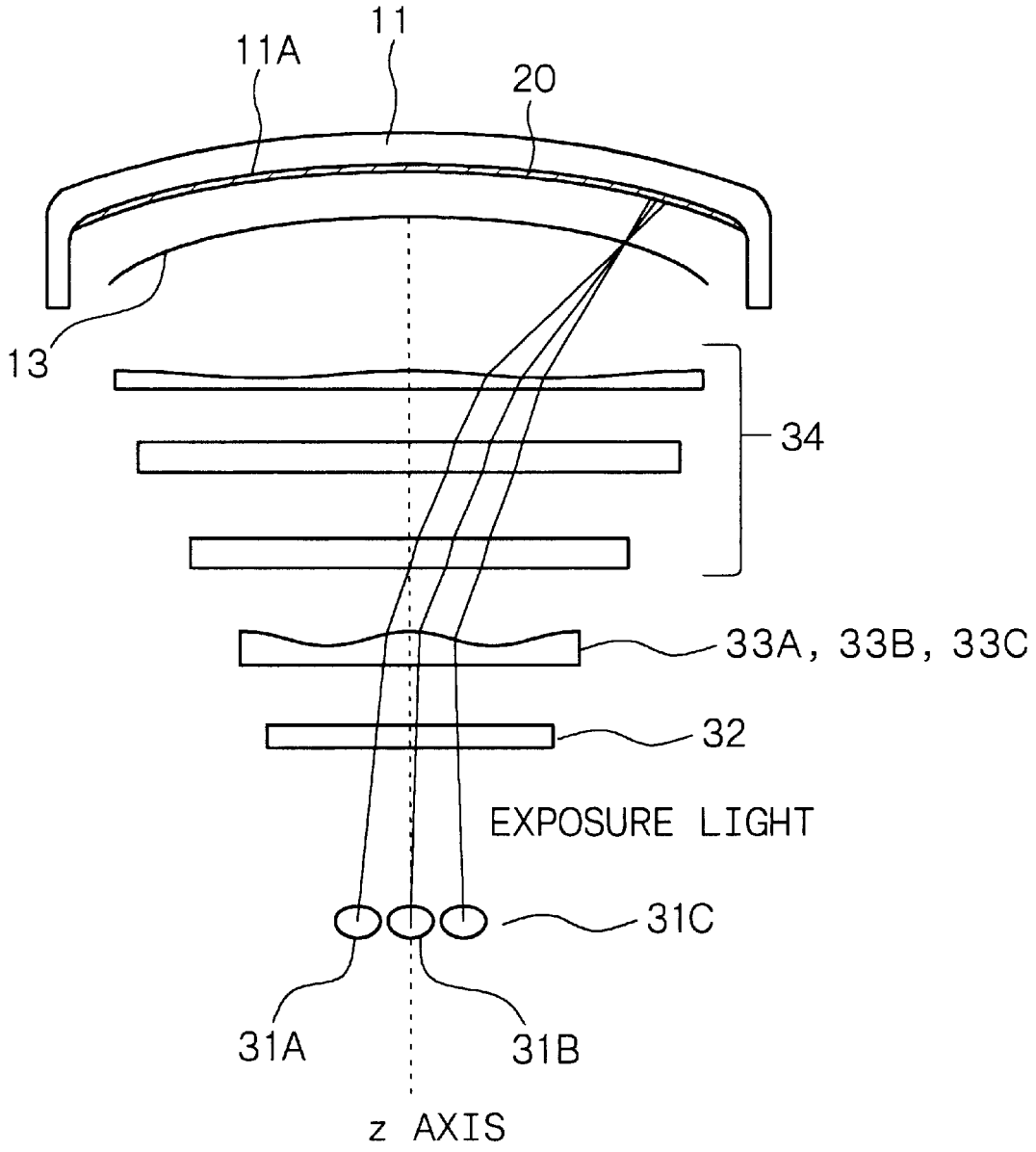
FIG. 4 is a conceptual view of an exposure apparatus suitable for practicing the method of Example 2 of the present invention.

In practicing the method for producing a bulb for a color cathode ray tube or the method for producing a color cathode ray tube in Example 2 (to be generally referred to as "production method of Example 2" hereinafter), three exposure light sources (ultraviolet light sources 31A, 31B and 31C in an example shown in FIG. 4) are used, and as shown in FIG. 4, are arranged in different positions along the horizontal direction (x-direction) of the face plate, the electron beam sweep direction. Of the three exposure light sources 31A, 31B and 31C, the two exposure light sources 31A and 31C positioned outside correspond to exposure light sources for exposing an edge portion, and the exposure light source 31B positioned between the two exposure light sources 31A and 31C for exposing an edge portion corresponds to an exposure light source for exposing a central portion. Further, a correction lens system is disposed between the exposure light sources 31A, 31B and 31C and the color selection member 13. The correction lens system comprises an illumination correction filter 32, first correction lenses 33A, 33B and 33C and a second correction lens group 34, which are positioned in this order from the exposure light source side. The illumination correction filter 32 serves to optimize the size (width) of the fluorescent material layers to be obtained on the entire surface of the face plate 11. The second correction lenses group 34 made of glass serves to approximate the paths of the exposure lights during the exposure to the paths of actual electron beams.

Further, when the first correction lenses 33A, 33B and 33C made of glass are provided, there can be attained a large value of the derivative of the first order ($\partial I/\partial x$) of the transmitted-light strength in the edge portion of the exposed stripe-shaped light sensitive film all over the inner surface of the face plate, and the edge portions of the exposed stripe-shaped light sensitive film can be included in an area of the transmitted-light strength which area corresponds to the first wave of the derivative of the first order ($\partial I/\partial x$). When the light sensitive film is exposed to the light from one exposure light source 31A, the first correction lens 33A is used, when the light sensitive film is exposed to the light from the exposure light source 31B for exposing an central portion, the first correction lens 33B is used, and when the light sensitive film is exposed to the light from the other exposure light source 31C, the first correction lens 33C is used. The first correction lens 33A and the first correction lens 33C have identical characteristics (but symmetrical characteristic with regard to a z-axis shown in FIG. 4). Each of the first correction lenses 33A, 33B and 33C has a smooth convexo-concave shape formed on one surface.

Specifically, the first correction lenses 33A, 33B and 33C for correcting Fresnel diffraction conditions are selected depending upon the exposure light sources used. In the exposure apparatus, the three exposure lights emitted from the three exposure light sources 31A, 31B and 31C are adjusted such that their Fresnel diffraction waves are superposed on the light sensitive film 20 through the correction lens system 32, 33A, 33B, 33C, 34 and the color selection member 13 so that the light sensitive film 20 is exposed in the form of a stripe having a predetermined width depending upon the slit corresponding to the opening portion. Further, the exposure lights are adjusted such that the value of the derivative of the first order ($\partial I/\partial x$) of the transmitted-light strength corresponding to the edge portions of the exposed stripe-shaped light sensitive film comes to be a value of a certain level or higher.

Figure 5:
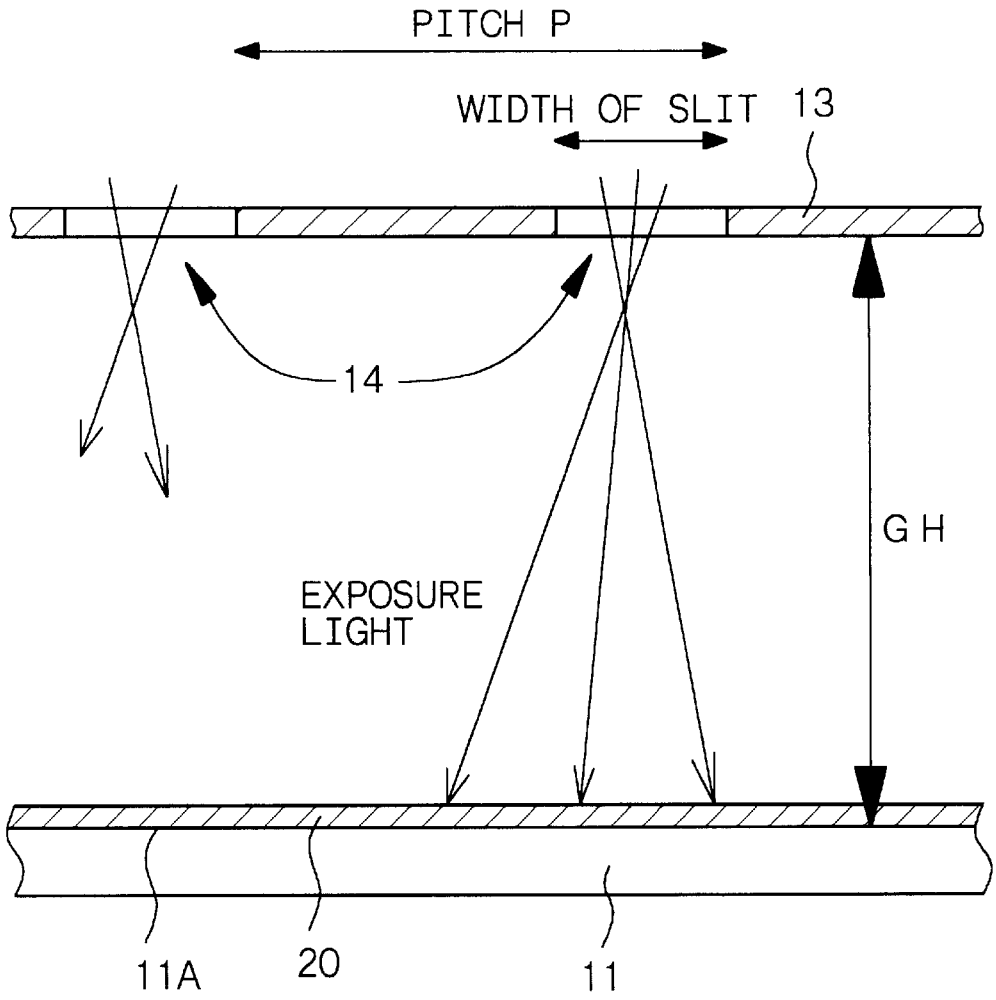
FIG. 5 is an enlarged schematic partial cross-sectional view of a face plate, a color selection member, etc., in Example 2 of the present invention.
Figure 6:
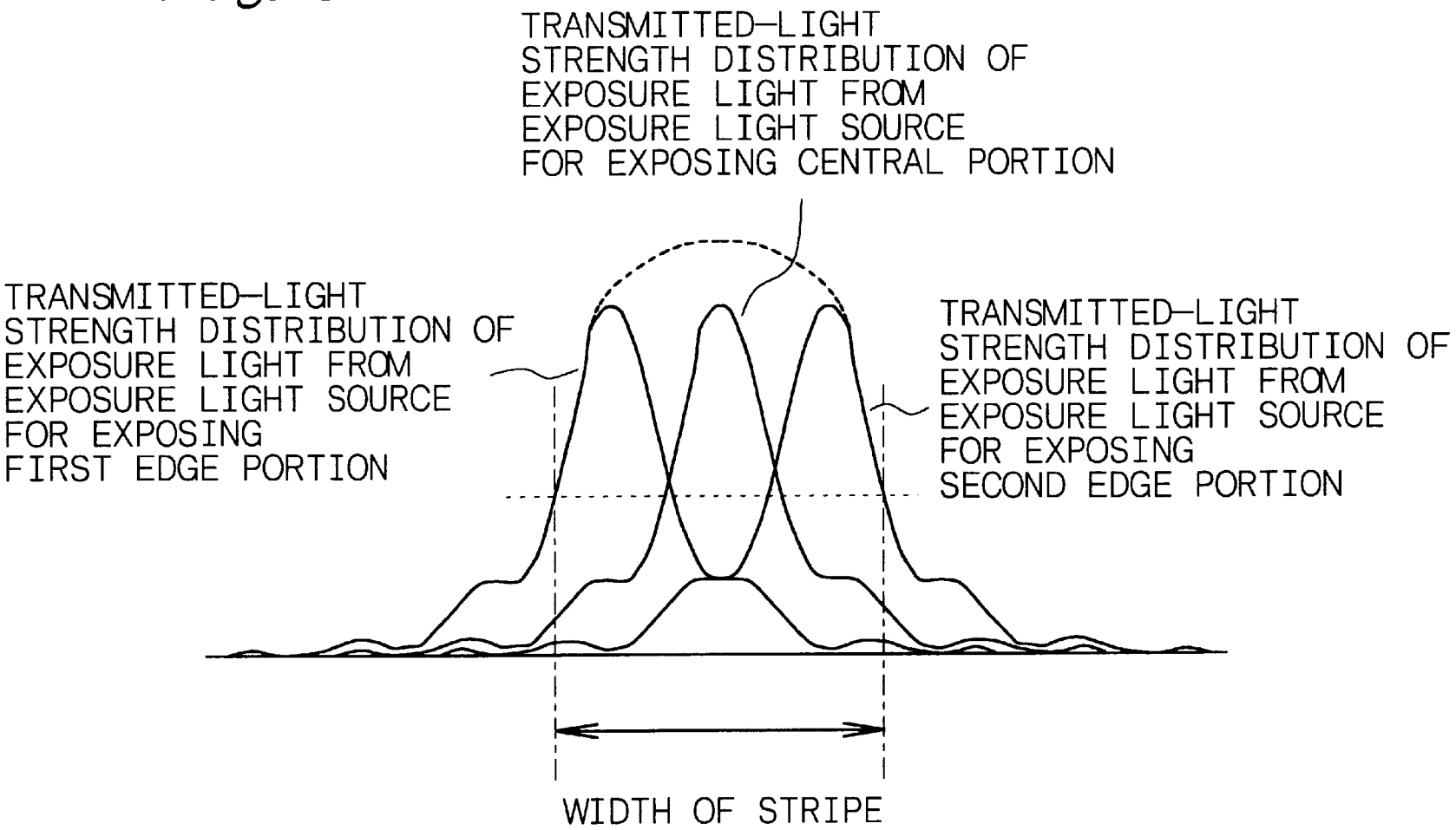
FIG. 6 is a schematic drawing of a transmitted-light strength distribution of superposed Fresnel diffraction waves of exposure lights which pass through one slit in Example 2 of the present invention.

In the production method of Example 2, the face plate 11 having the inner surface 11A on which the light sensitive film 20 is formed (applied) is also prepared (see FIG. 47A). The light sensitive film 20 formed (applied) on the inner surface 11A of the face plate 11 is exposed (see FIGS. 4 and 5) to form stripe-shaped exposed regions 21 in the light sensitive film 20 corresponding to the slits (see FIG. 47B) on the basis of the transmitted-light strength distribution of superposed Fresnel diffraction waves of the exposure lights which are emitted from a plurality of the exposure light sources 31A, 31B and 31C (three exposure light sources in Example 2) arranged in different positions along the horizontal direction of the face plate (x-direction), the electron beam sweep direction, and which pass through the slits 14 corresponding to the opening portions formed in the color selection member 13. FIG. 6 schematically shows, by a solid line, one example of each transmitted-light strength distribution of a Fresnel diffraction wave of each of the three exposure lights which pass through one slit 14. A convexo-convex curved portion shown by a dotted line indicates a portion of a transmitted-light strength distribution in which portion the three exposure lights are superposed, that is, part of transmitted-light strength distribution of superposed Fresnel diffraction waves of the three exposure lights.

FIGS. 17, 18, 19, 20, 21 and 22 show results of measurement of transmitted-light strength distributions of superposed Fresnel diffraction waves of the three exposure lights which pass through the slits 14 in coordinates (0,211), (0,0), (128,211), (128,0), (375,211) and (375,0) where the nominal diagonal inchage X of the bulb 10 is 36 (X=36), the center of the face plate 11 is an origin, a straight line extending in the horizontal direction (x-direction) of the face plate and passing through the origin is an x-axis and a straight line extending in the vertical direction (y-direction) of the face plate and passing through the origin is a y-axis. The unit of values in the coordinates is "mm". In each drawing, the derivative of the first order ($\partial I/\partial x$) of the transmitted-light strength is shown by a dotted line.

The transmitted-light strength distributions of superposed Fresnel diffraction waves of the exposure lights from the two exposure light sources contributing to the exposure of the edge portions of the light sensitive film (exposure light sources 31A and 31C for exposing an edge portion) corresponding to the opening portion, out of the three exposure light sources 31A, 31B and 31C, are the same as the transmitted-light strength distributions shown in FIGS. 11 to 16. That is, in an area of the transmitted-light strength in which area the transmitted-light strength on the light sensitive film 20 decreases (first) along the horizontal direction of the face plate (x-direction), the electron beam sweep direction, from the central portion of the stripe-shaped exposed region corresponding the opening portion, the derivative of the first order ($\partial I/\partial x$) of the superposed transmitted-light strength has at least one upward-convex area. And, the edge portion (see chain lines a, b, c, d, e and f in parallel with the axis of ordinates) of the exposed stripe-shaped light sensitive film corresponding to the opening portion is included in an area of the superposed transmitted-light strength which area corresponds to the upward-convex area (first wave) appearing first along the horizontal direction of the face plate, the electron beam sweep direction, from the stripe-shaped exposed region, out of the upward-convex areas of the derivative of the first order ($\partial I/\partial x$) of the superposed transmitted-light strength.

Figure 18:
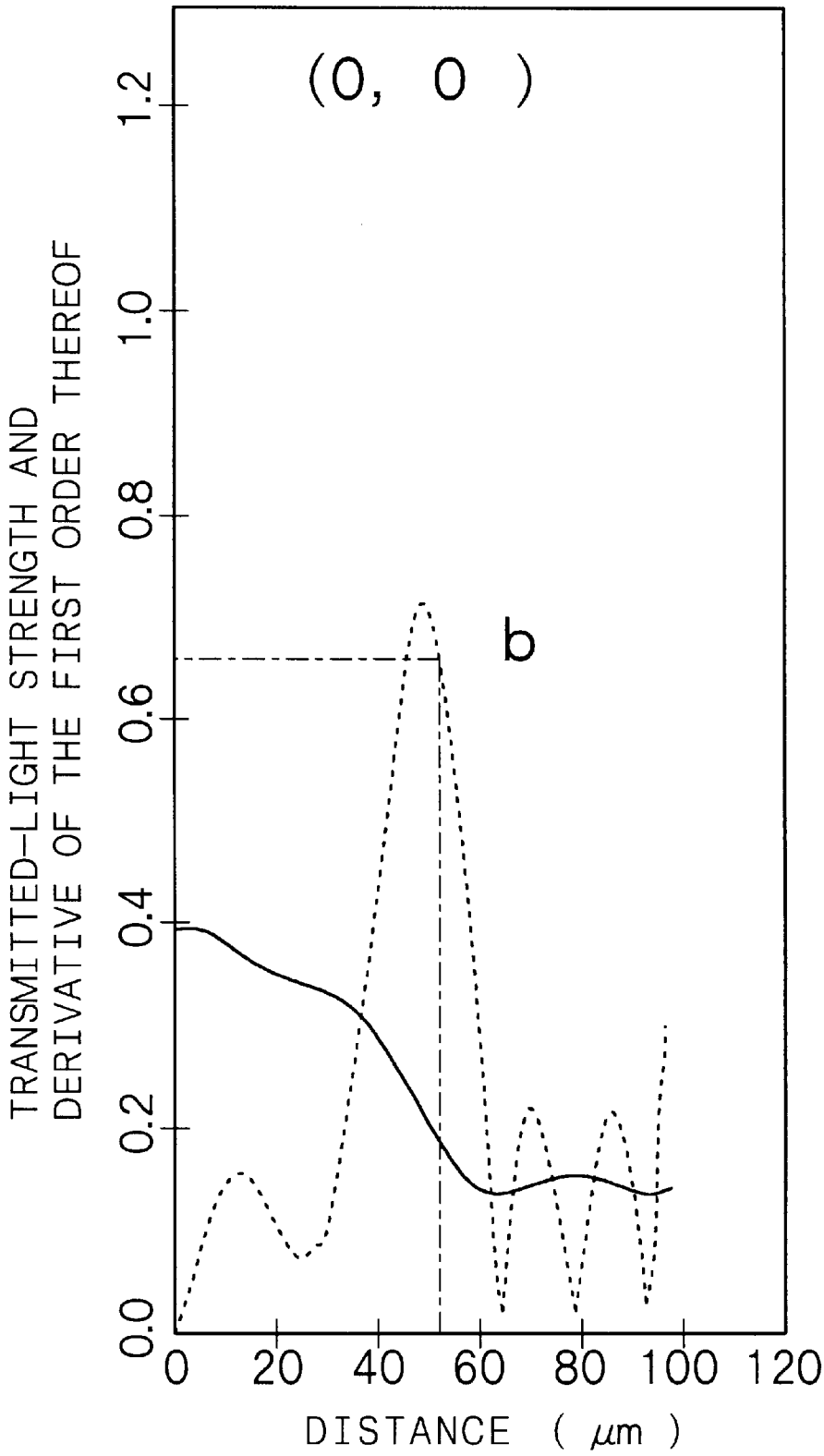
FIG. 18 is a graph showing a transmitted-light strength distribution of superposed Fresnel diffraction waves of exposure lights which pass through a slit in a coordinate of (0,0) in the bulb for a color cathode ray tube in Example 2 of the present invention and a derivative of the first order (∂I/∂x) thereof.
Figure 19:
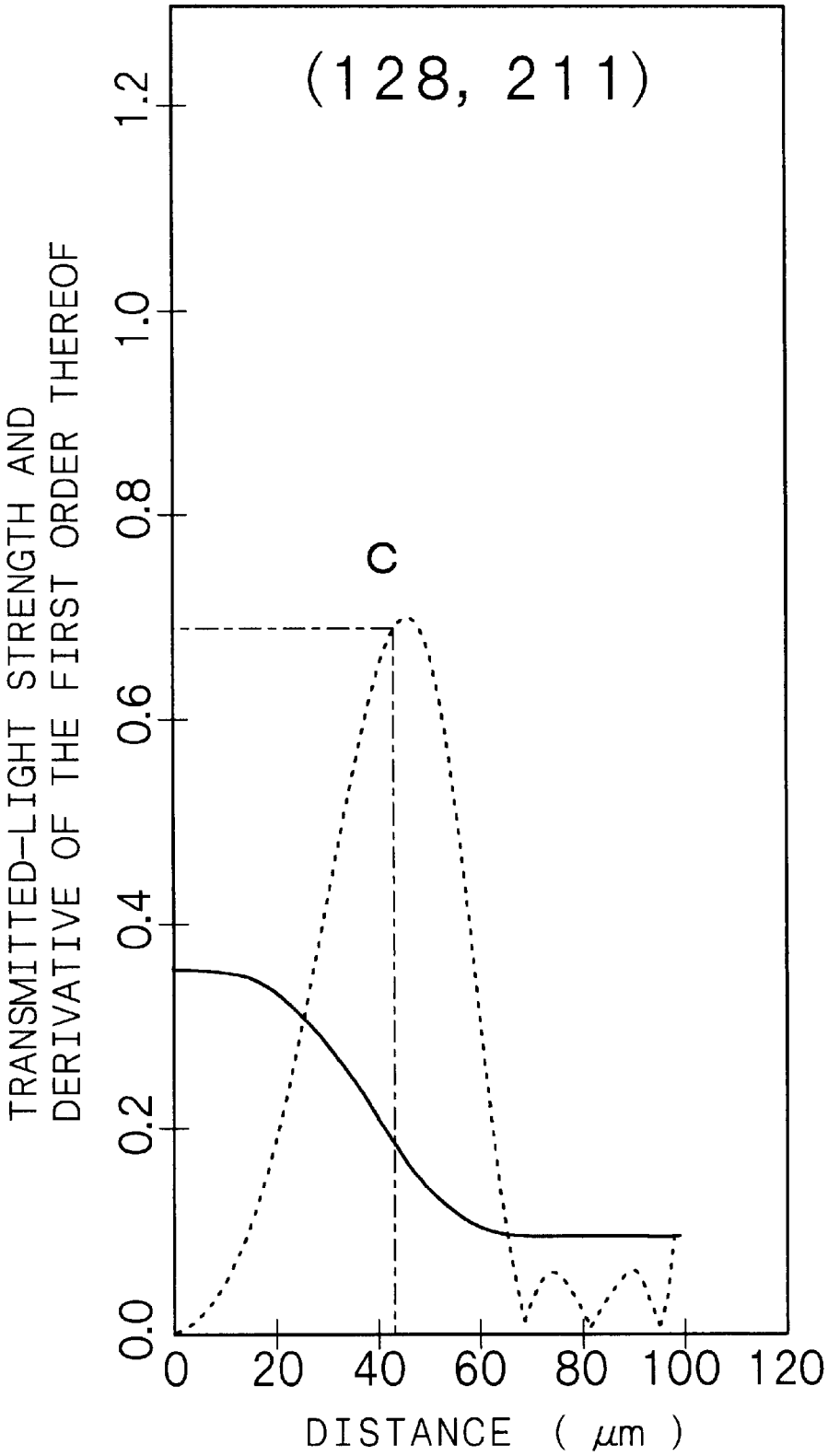
FIG. 19 is a graph showing a transmitted-light strength distribution of superposed Fresnel diffraction waves of exposure lights which pass through a slit in a coordinate of (128,211) in the bulb for a color cathode ray tube in Example 2 of the present invention and a derivative of the first order (∂I/∂x) thereof.
Figure 20:
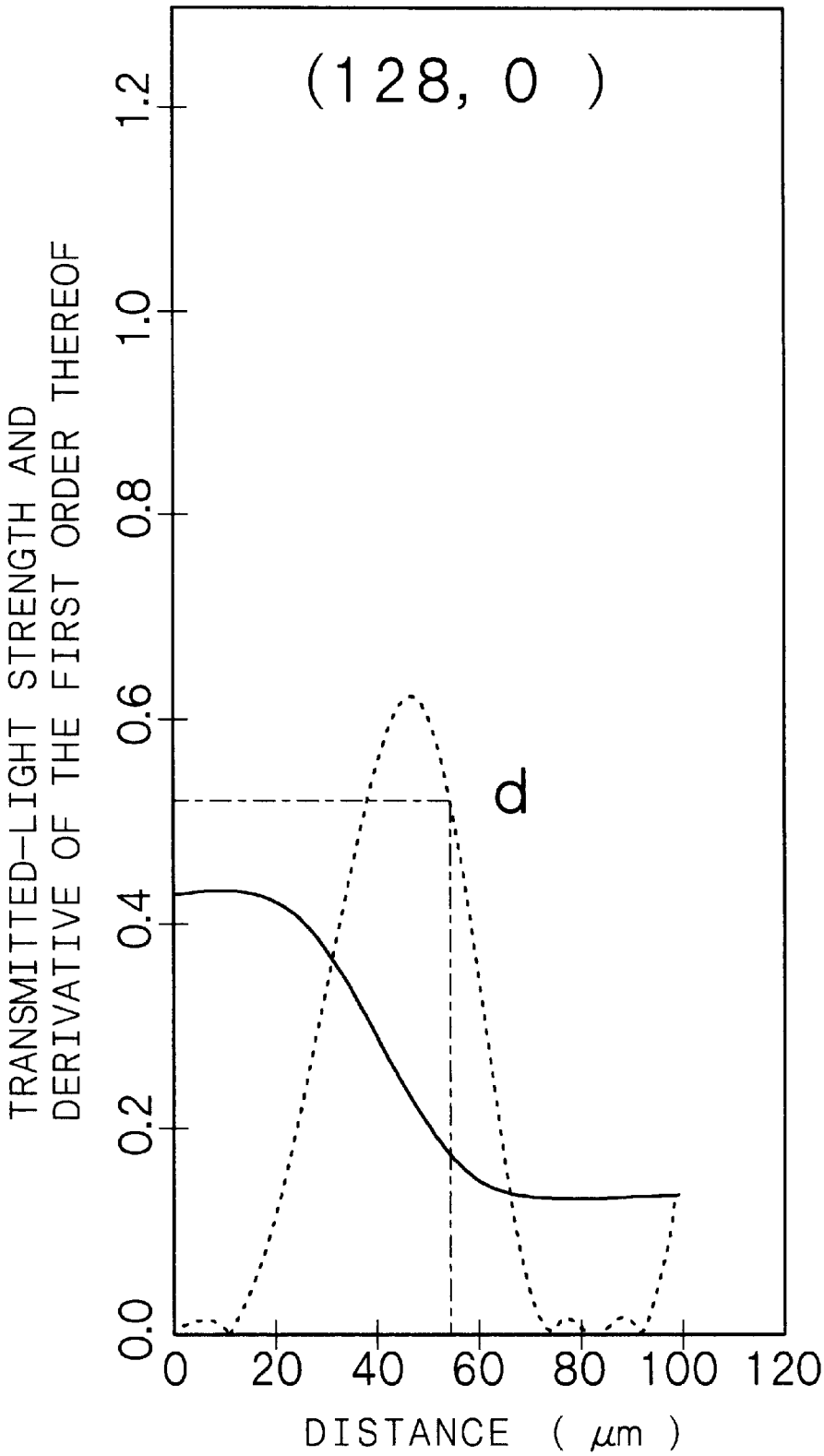
FIG. 20 is a graph showing a transmitted-light strength distribution of superposed Fresnel diffraction waves of exposure lights which pass through a slit in a coordinate of (128,0) in the bulb for a color cathode ray tube in Example 2 of the present invention and a derivative of the first order (∂I/∂x) thereof.
Figure 21:
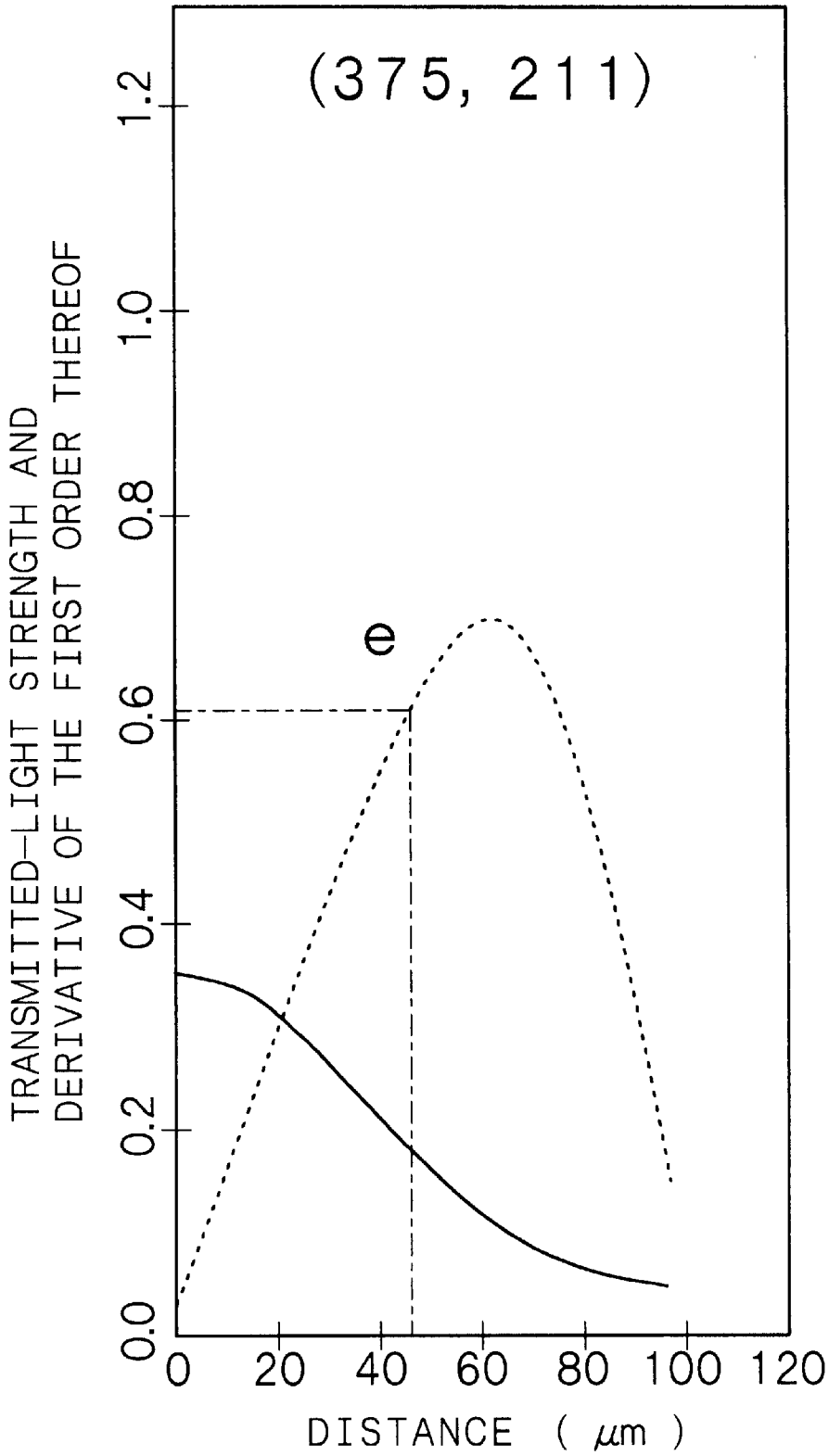
FIG. 21 is a graph showing a transmitted-light strength distribution of superposed Fresnel diffraction waves of exposure lights which pass through a slit in a coordinate of (375,211) in the bulb for a color cathode ray tube in Example 2 of the present invention and a derivative of the first order (∂I/∂x) thereof.
Figure 22:
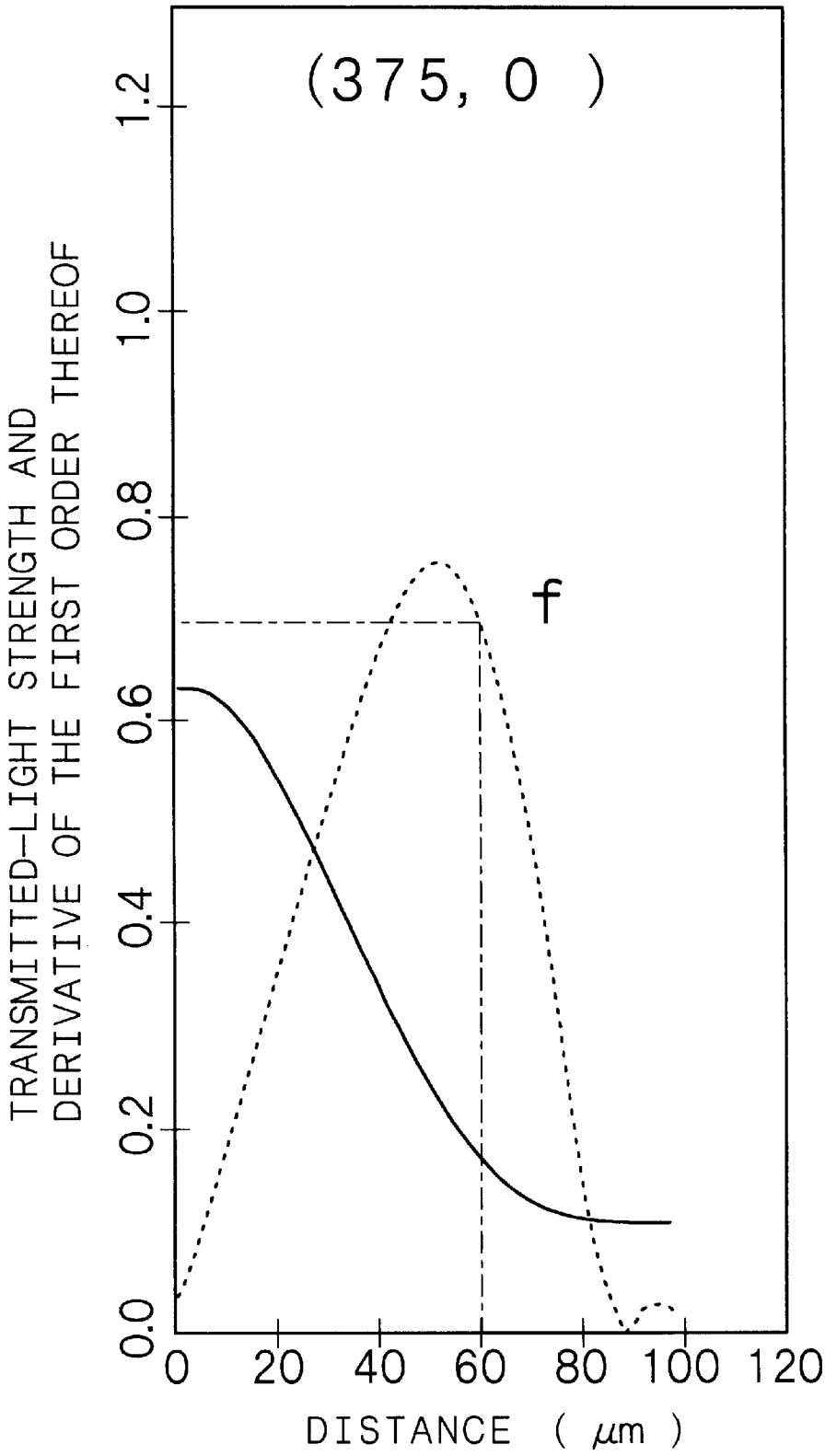
FIG. 22 is a graph showing a transmitted-light strength distribution of superposed Fresnel diffraction waves of exposure lights which pass through a slit in a coordinate of (375,0) in the bulb for a color cathode ray tube in Example 2 of the present invention and a derivative of the first order (∂I/∂x) thereof.
Figure 23:
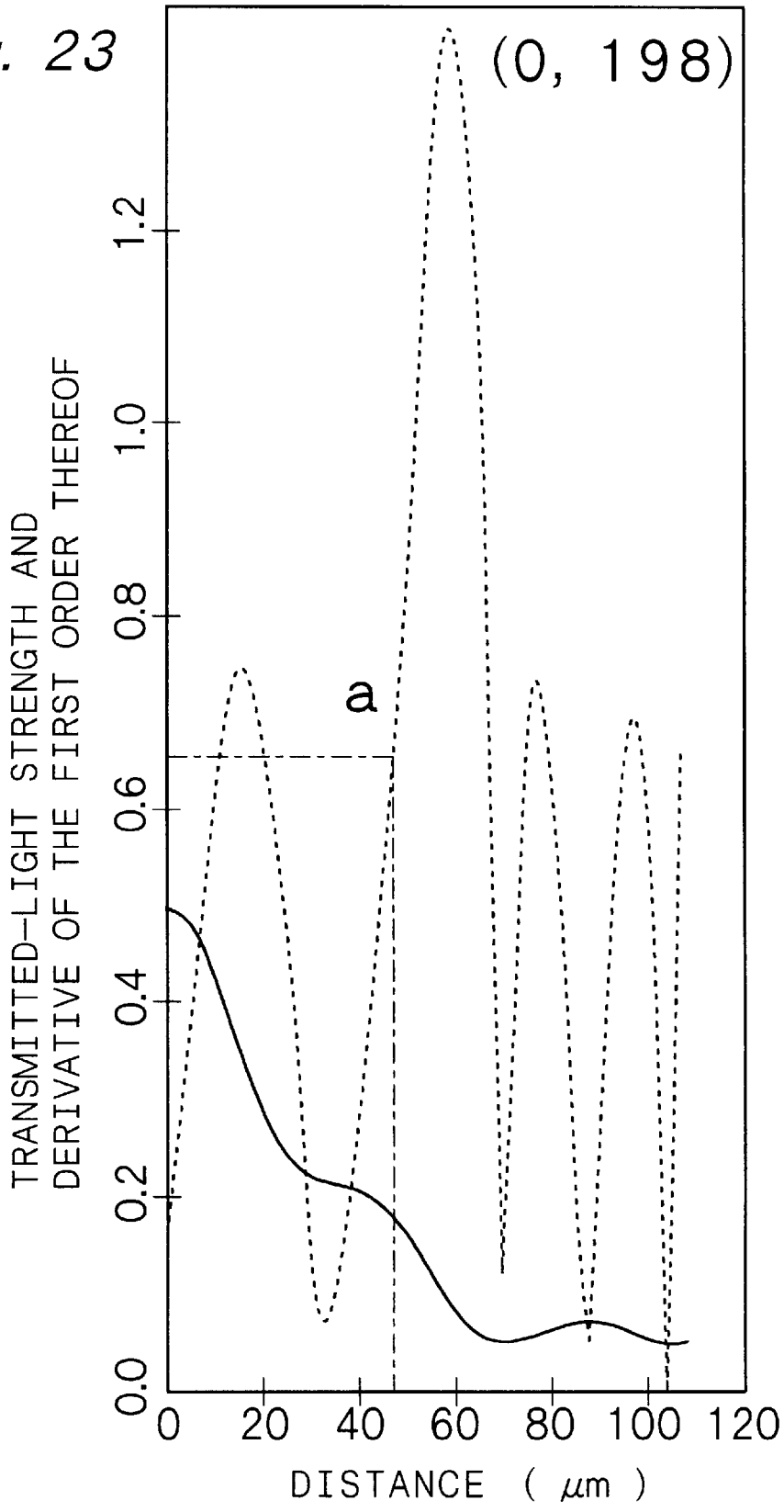
FIG. 23 is a graph showing a transmitted-light strength distribution of Fresnel diffraction wave of exposure light which passes through a slit in a coordinate of (0,198) in the bulb for a color cathode ray tube in Comparative Example 1 and a derivative of the first order (∂i/∂x) thereof.
Figure 24:
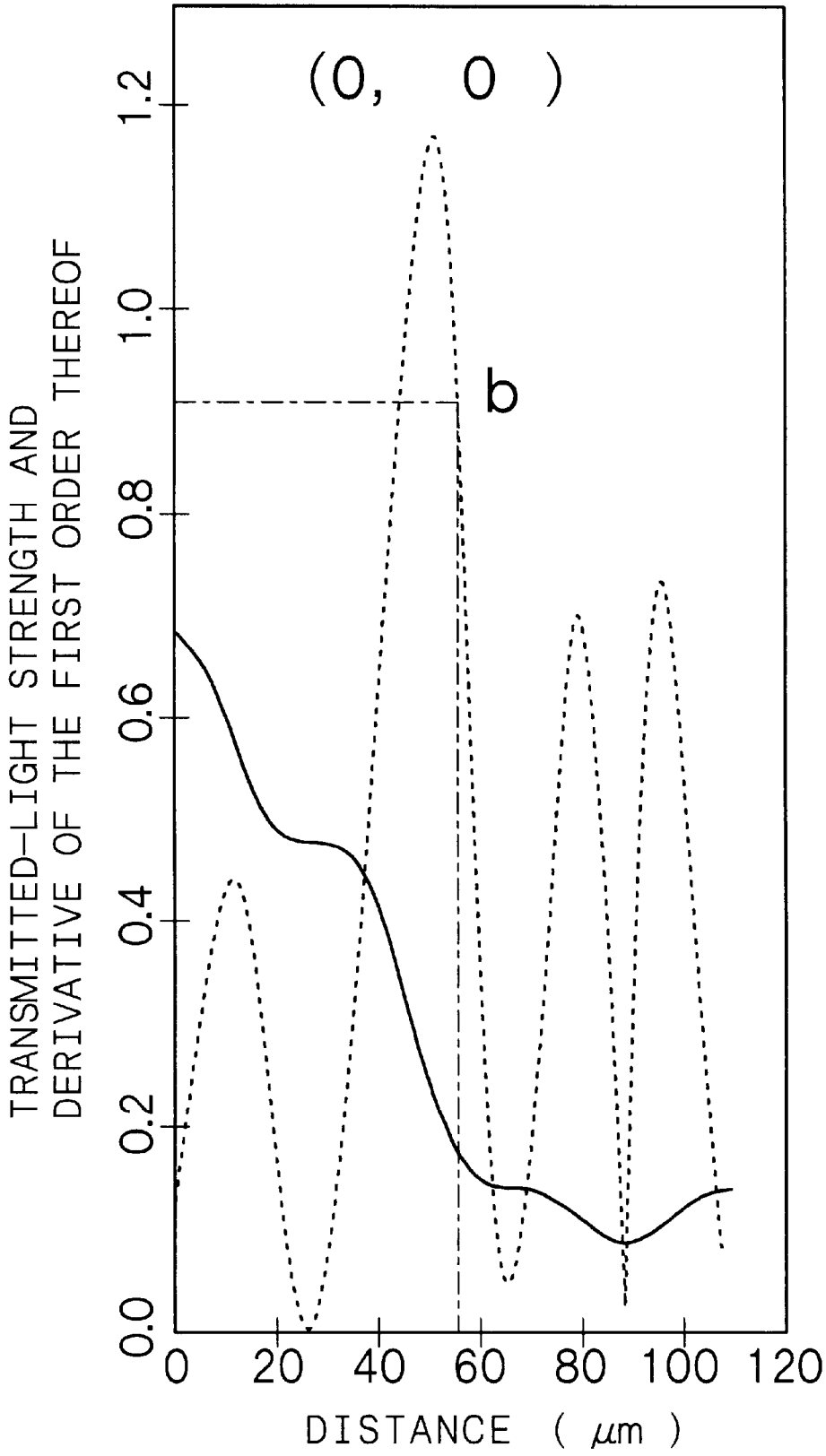
FIG. 24 is a graph showing a transmitted-light strength distribution of Fresnel diffraction wave of exposure light which passes through a slit in a coordinate of (0,0) in the bulb for a color cathode ray tube in Comparative Example 1 and a derivative of the first order (∂I/∂x) thereof.
Figure 25:
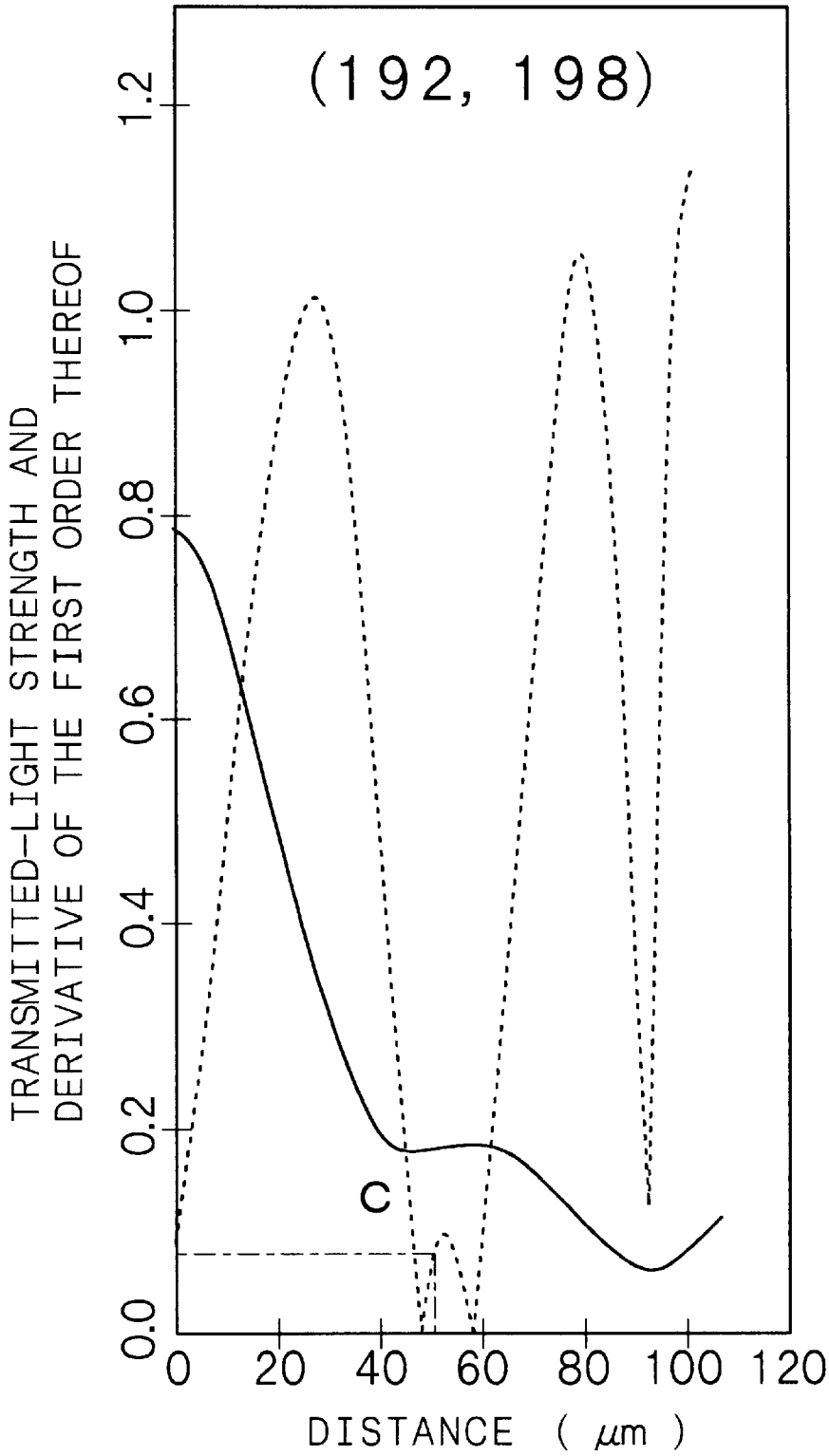
FIG. 25 is a graph showing a transmitted-light strength distribution of Fresnel diffraction wave of exposure light which passes through a slit in a coordinate of (192,198) in the bulb for a color cathode ray tube in Comparative Example 1 and a derivative of the first order (∂I/∂x) thereof.
Figure 26:
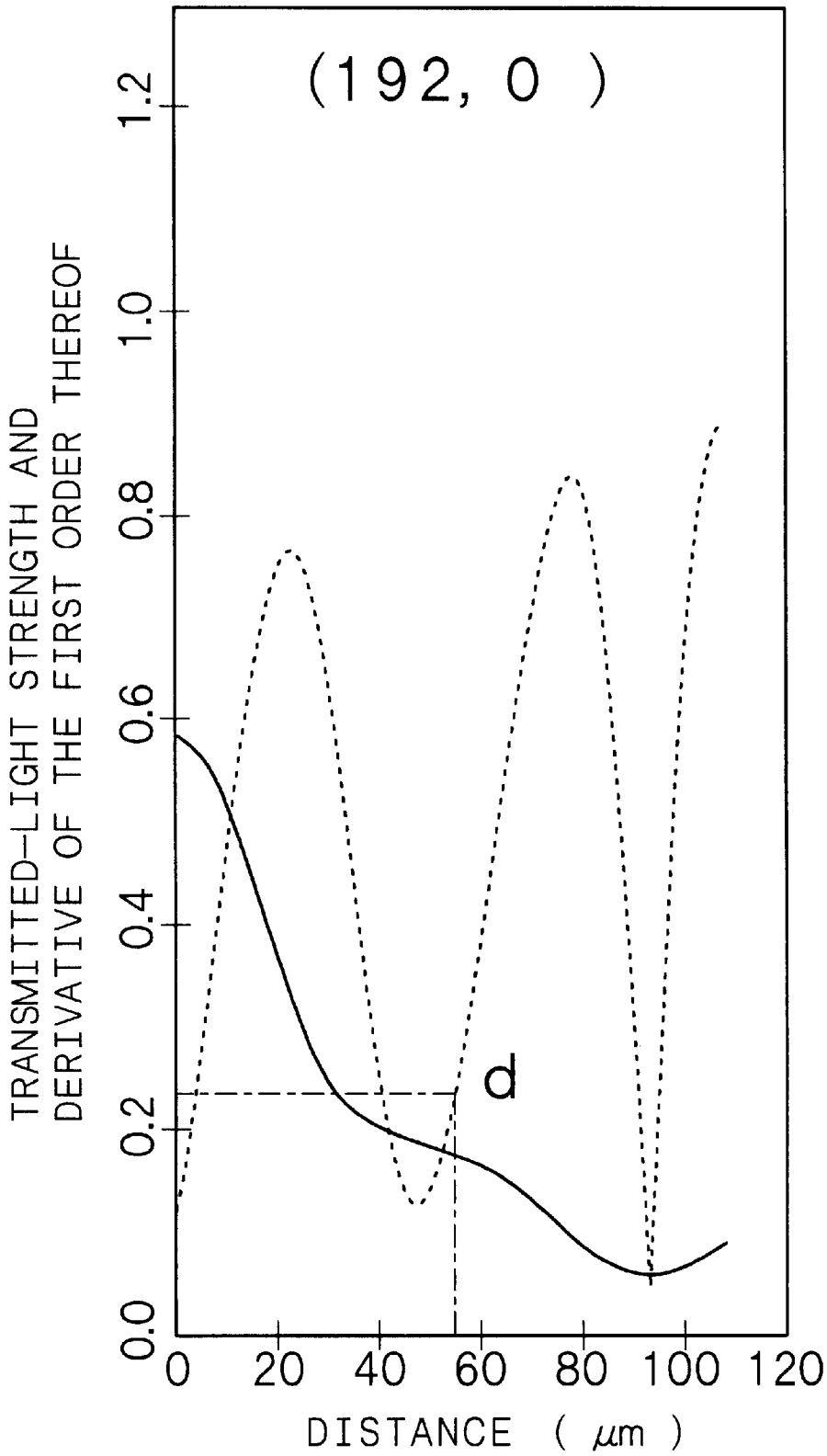
FIG. 26 is a graph showing a transmitted-light strength distribution of Fresnel diffraction wave of exposure light which passes through a slit in a coordinate of (192,0) in the bulb for a color cathode ray tube in Comparative Example 1 and a derivative of the first order (∂I/∂x) thereof.
Figure 27:
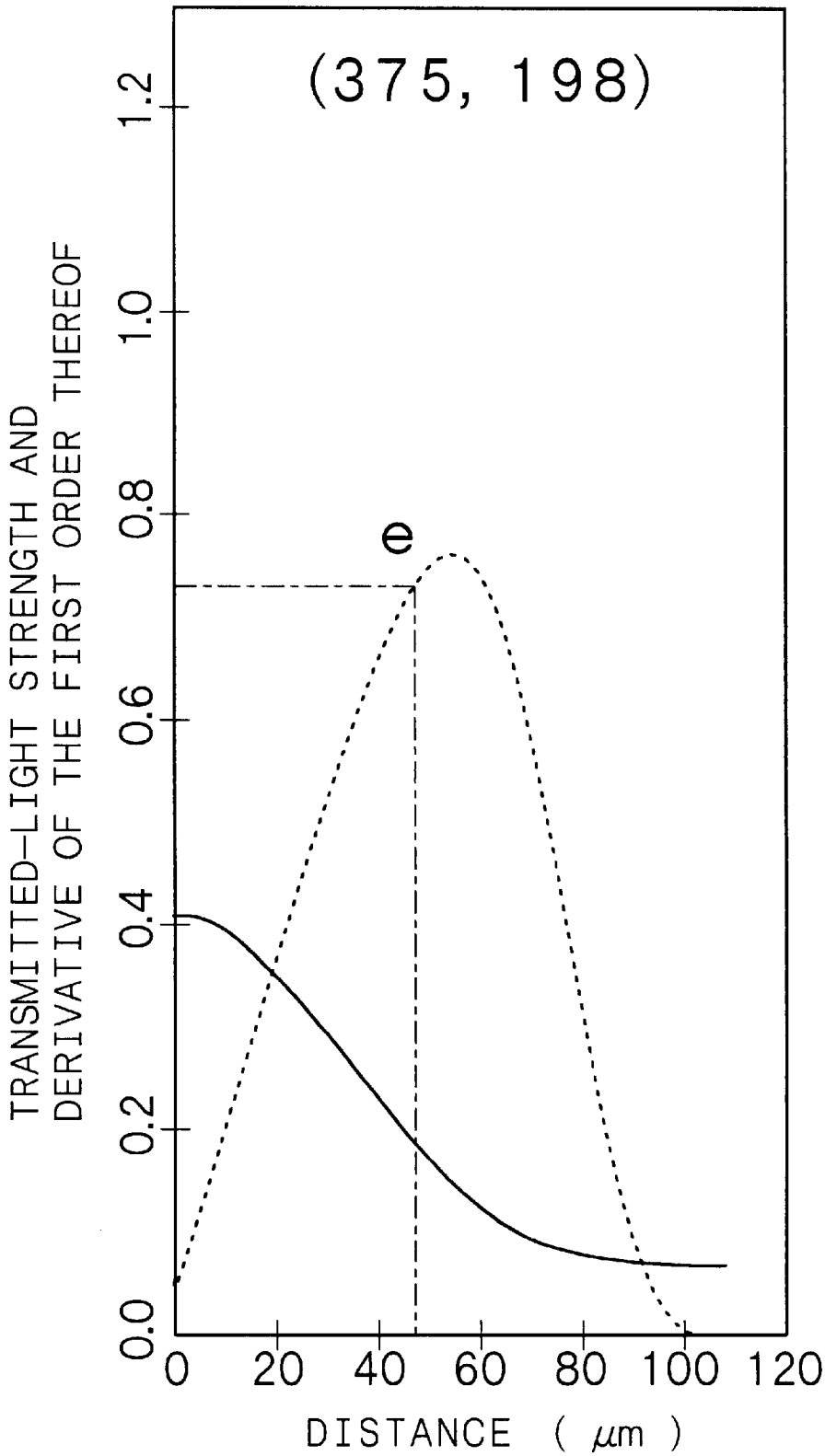
FIG. 27 is a graph showing a transmitted-light strength distribution of Fresnel diffraction wave of exposure light which passes through a slit in a coordinate of (375,198) in the bulb for a color cathode ray tube in Comparative Example 1 and a derivative of the first order (∂I/∂x) thereof.
Figure 28:
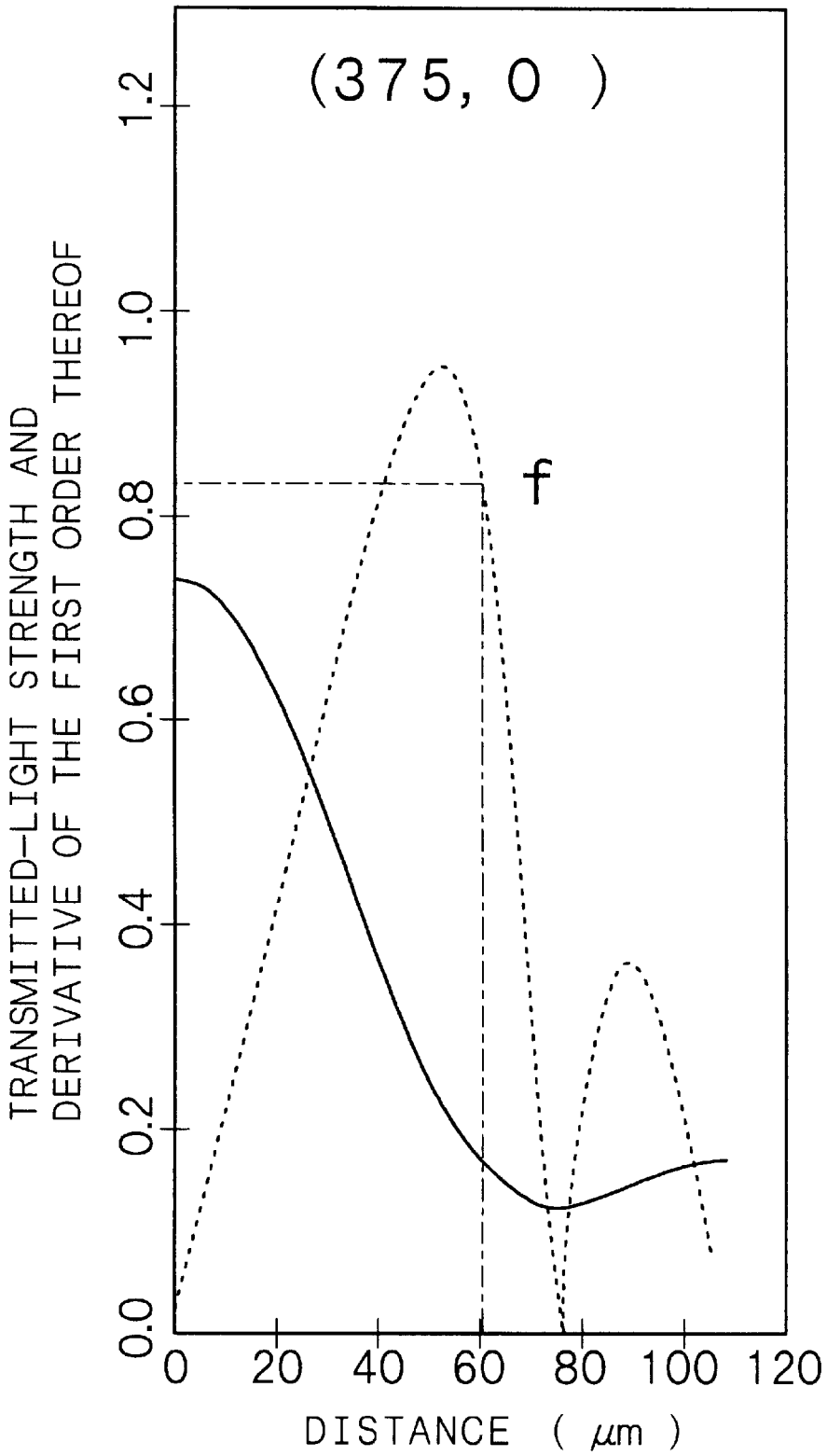
FIG. 28 is a graph showing a transmitted-light strength distribution of Fresnel diffraction wave of exposure light which passes through a slit in a coordinate of (375,0) in the bulb for a color cathode ray tube in Comparative Example 1 and a derivative of the first order (∂I/∂x) thereof.
Figure 29:
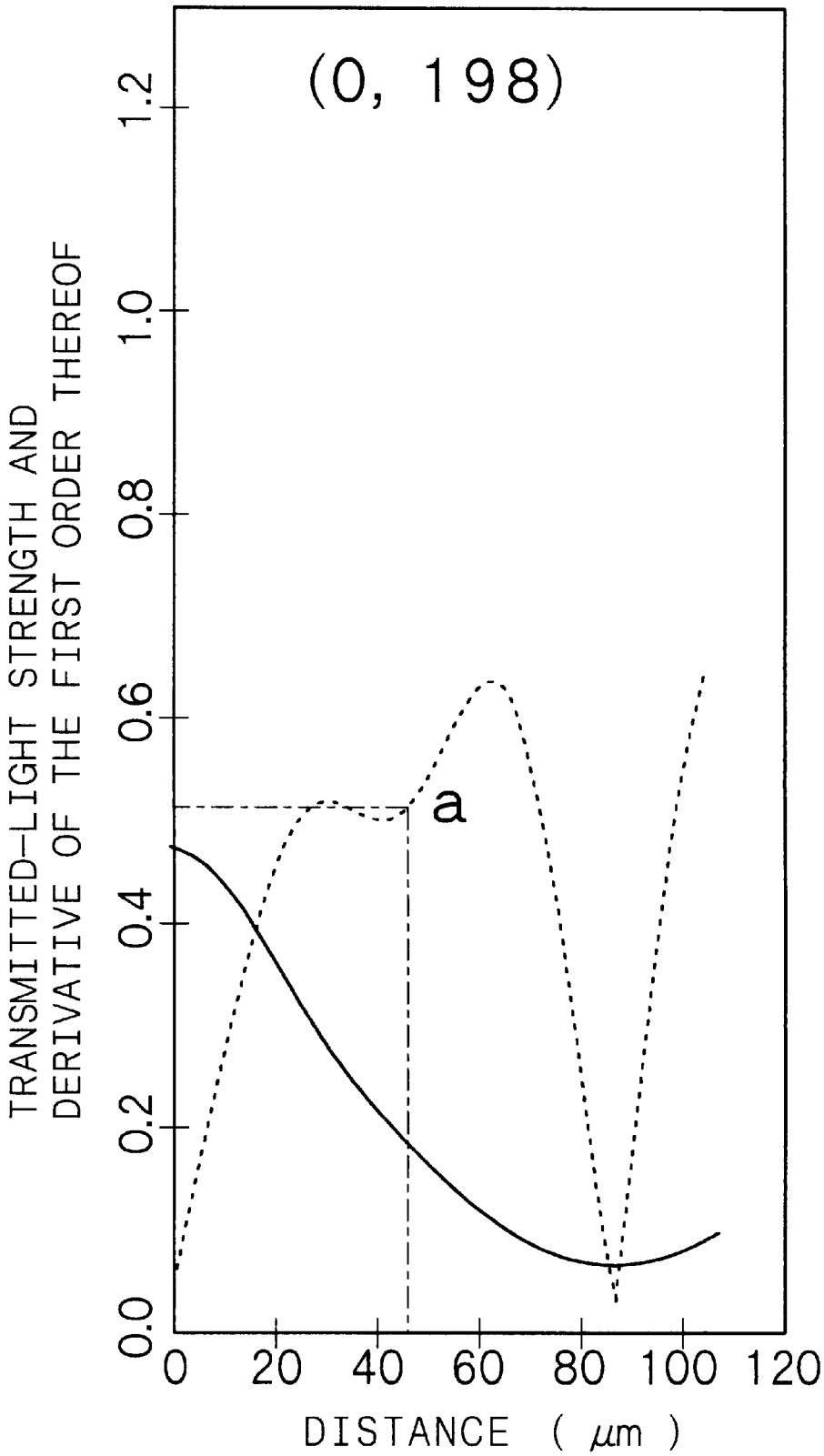
FIG. 29 is a graph showing a transmitted-light strength distribution of Fresnel diffraction waves of exposure lights which pass through a slit in a coordinate of (0,198) in the bulb for a color cathode ray tube in Comparative Example 2 and a derivative of the first order (∂I/∂x) thereof.
Figure 30:
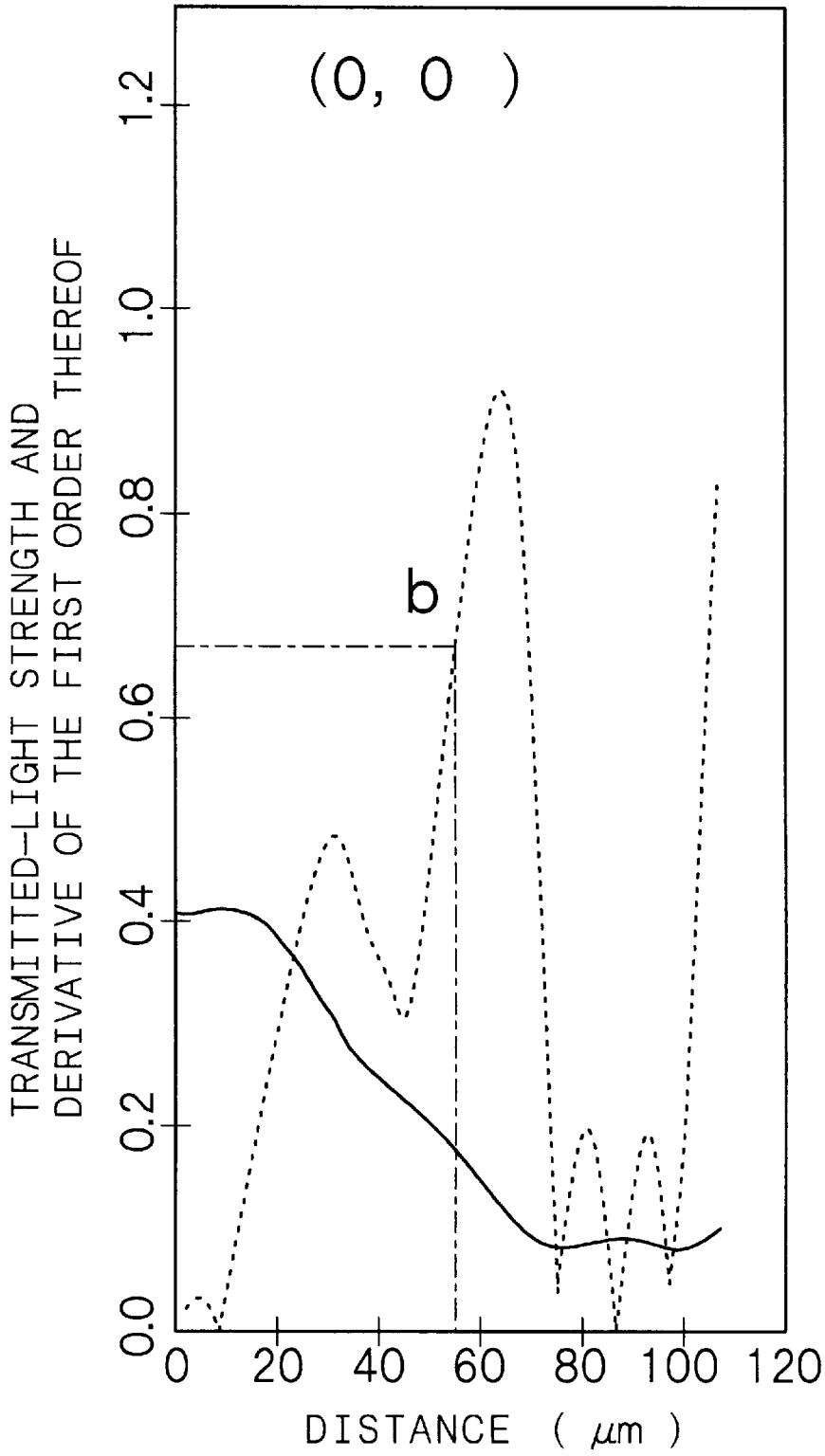
FIG. 30 is a graph showing a transmitted-light strength distribution of Fresnel diffraction waves of exposure lights which pass through a slit in a coordinate of (0,0) in the bulb for a color cathode ray tube in Comparative Example 2 and a derivative of the first order (∂I/∂x) thereof.
Figure 31:
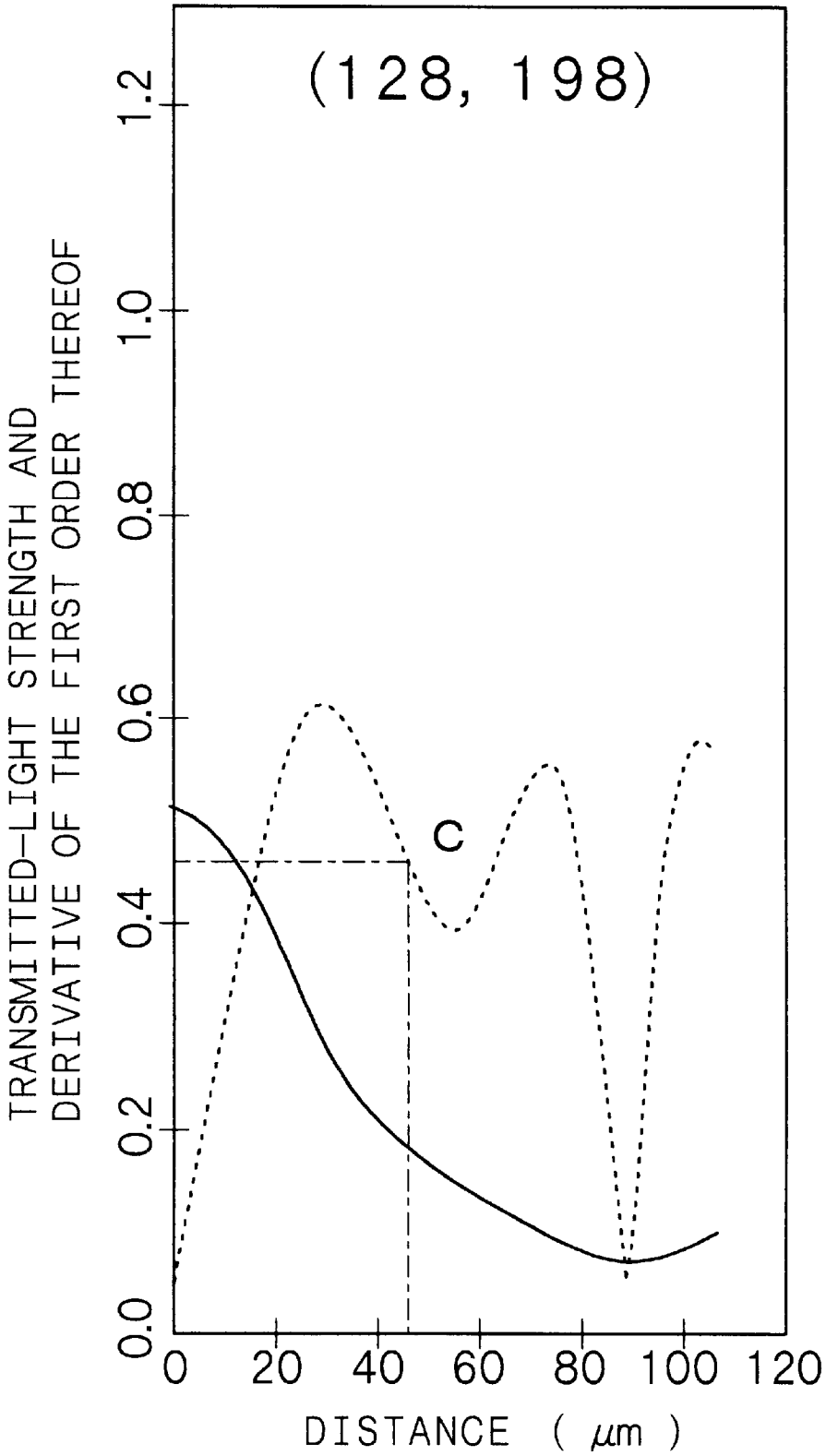
FIG. 31 is a graph showing a transmitted-light strength distribution of Fresnel diffraction waves of exposure lights which pass through a slit in a coordinate of (128,198) in the bulb for a color cathode ray tube in Comparative Example 2 and a derivative of the first order (∂I/∂x) thereof.
Figure 32:
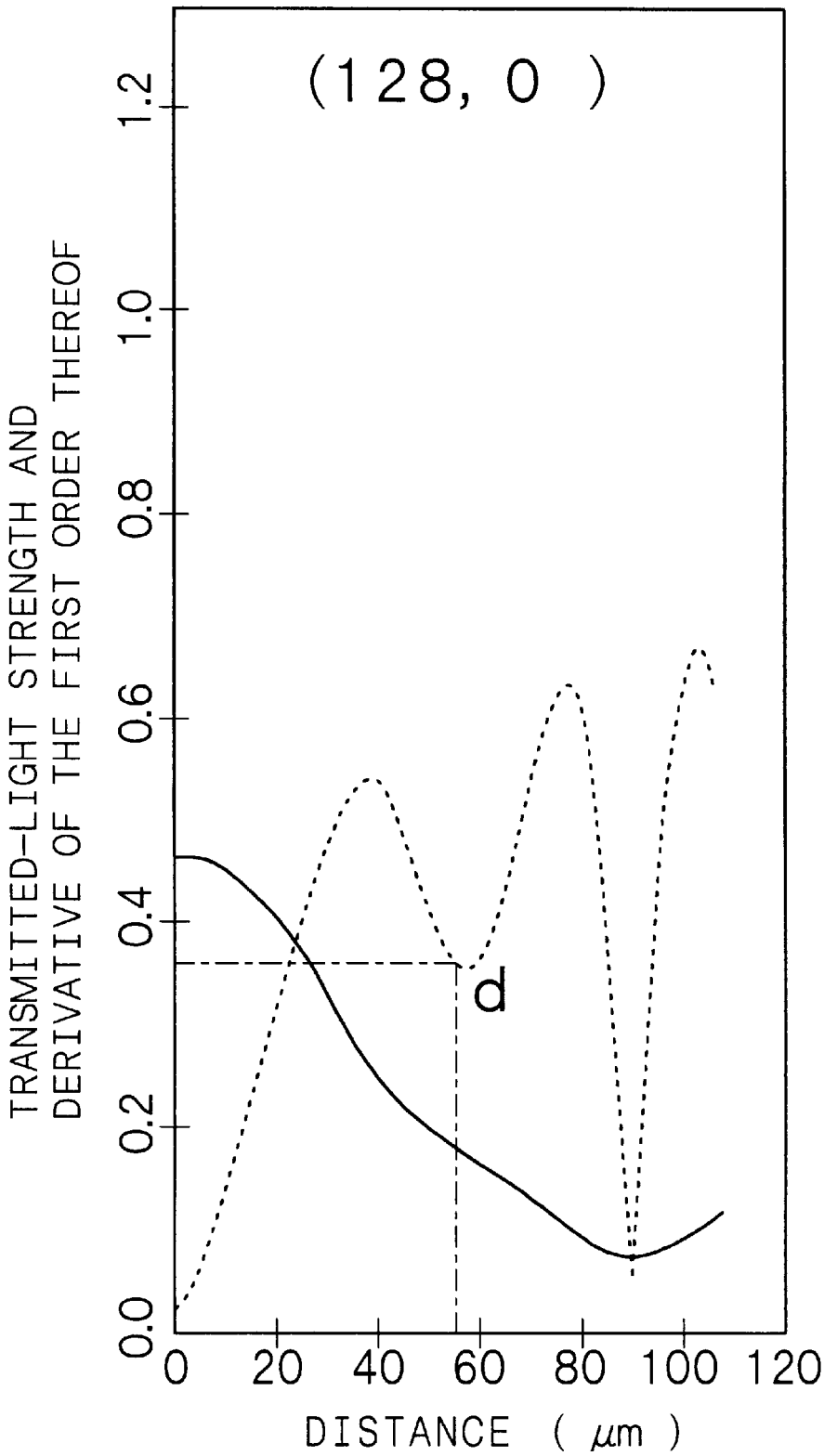
FIG. 32 is a graph showing a transmitted-light strength distribution of Fresnel diffraction waves of exposure lights which pass through a slit in a coordinate of (128,0) in the bulb for a color cathode ray tube in Comparative Example 2 and a derivative of the first order (∂I/∂x) thereof.
Figure 33:
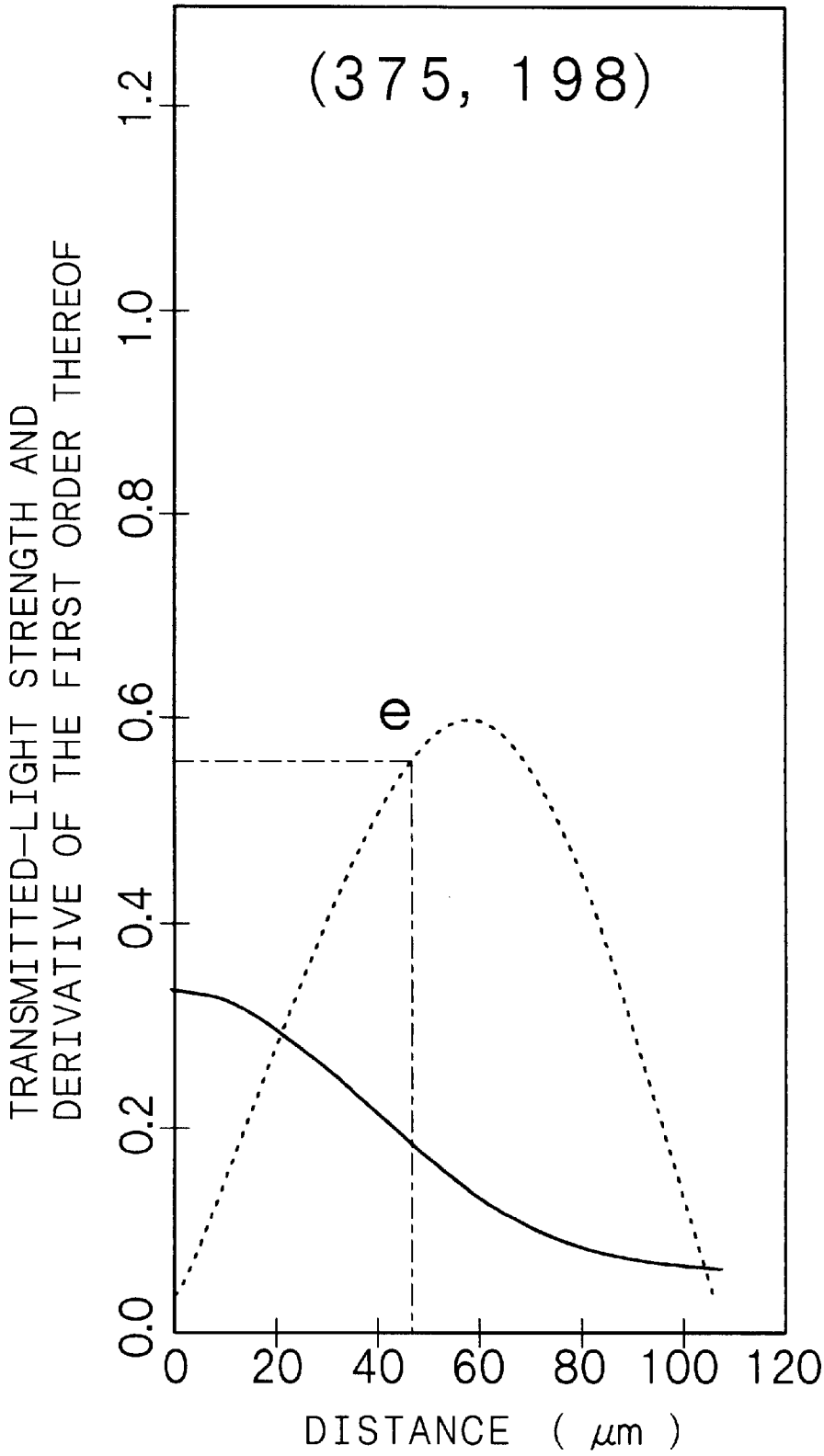
FIG. 33 is a graph showing a transmitted-light strength distribution of Fresnel diffraction waves of exposure lights which pass through a slit in a coordinate of (375,198) in the bulb for a color cathode ray tube in Comparative Example 2 and a derivative of the first order (∂I/∂x) thereof.
Figure 34:
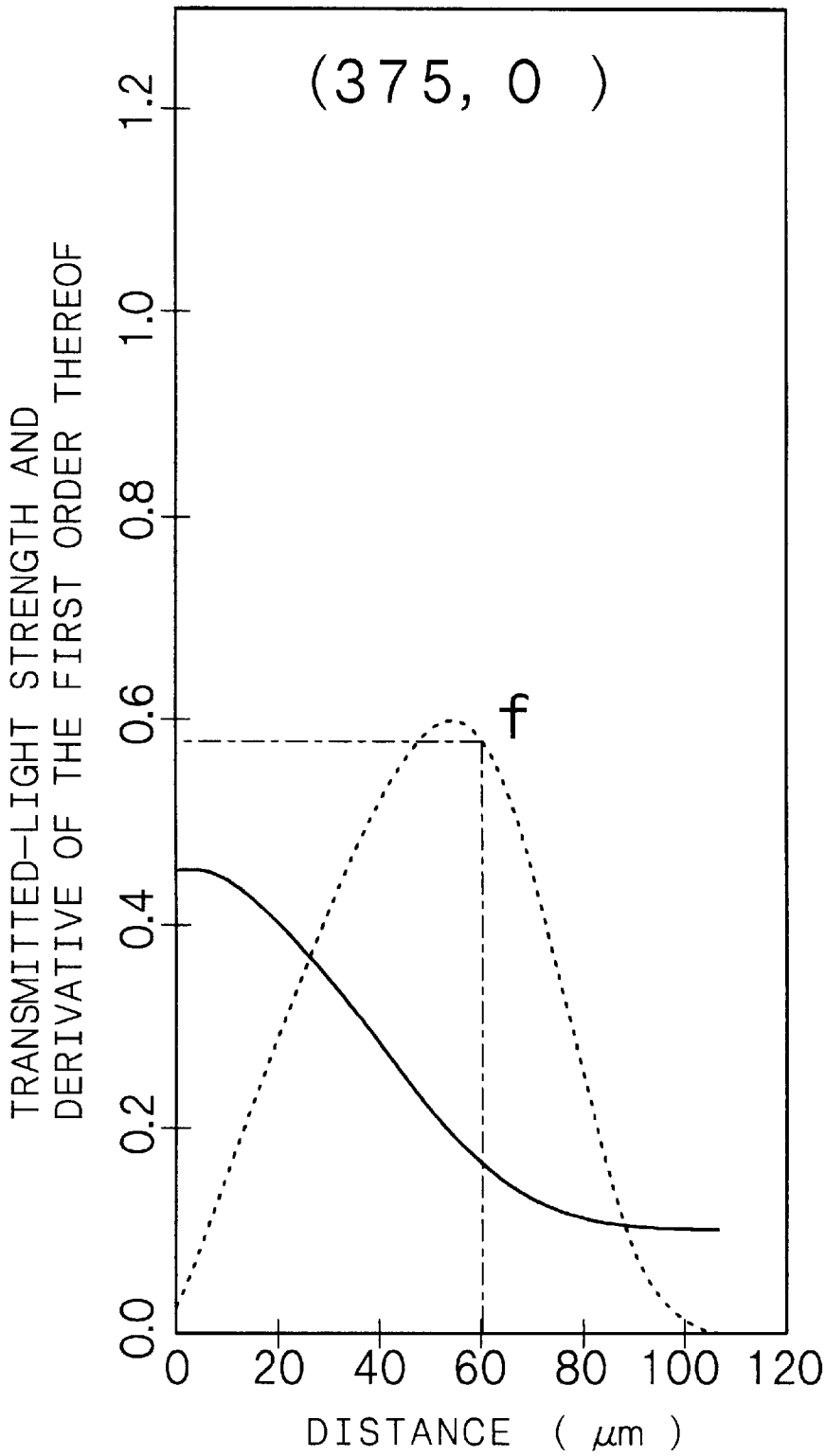
FIG. 34 is a graph showing a transmitted-light strength distribution of Fresnel diffraction waves of exposure lights which pass through a slit in a coordinate of (375,0) in the bulb for a color cathode ray tube in Comparative Example 2 and a derivative of the first order (∂I/∂x) thereof.
Figure 35:
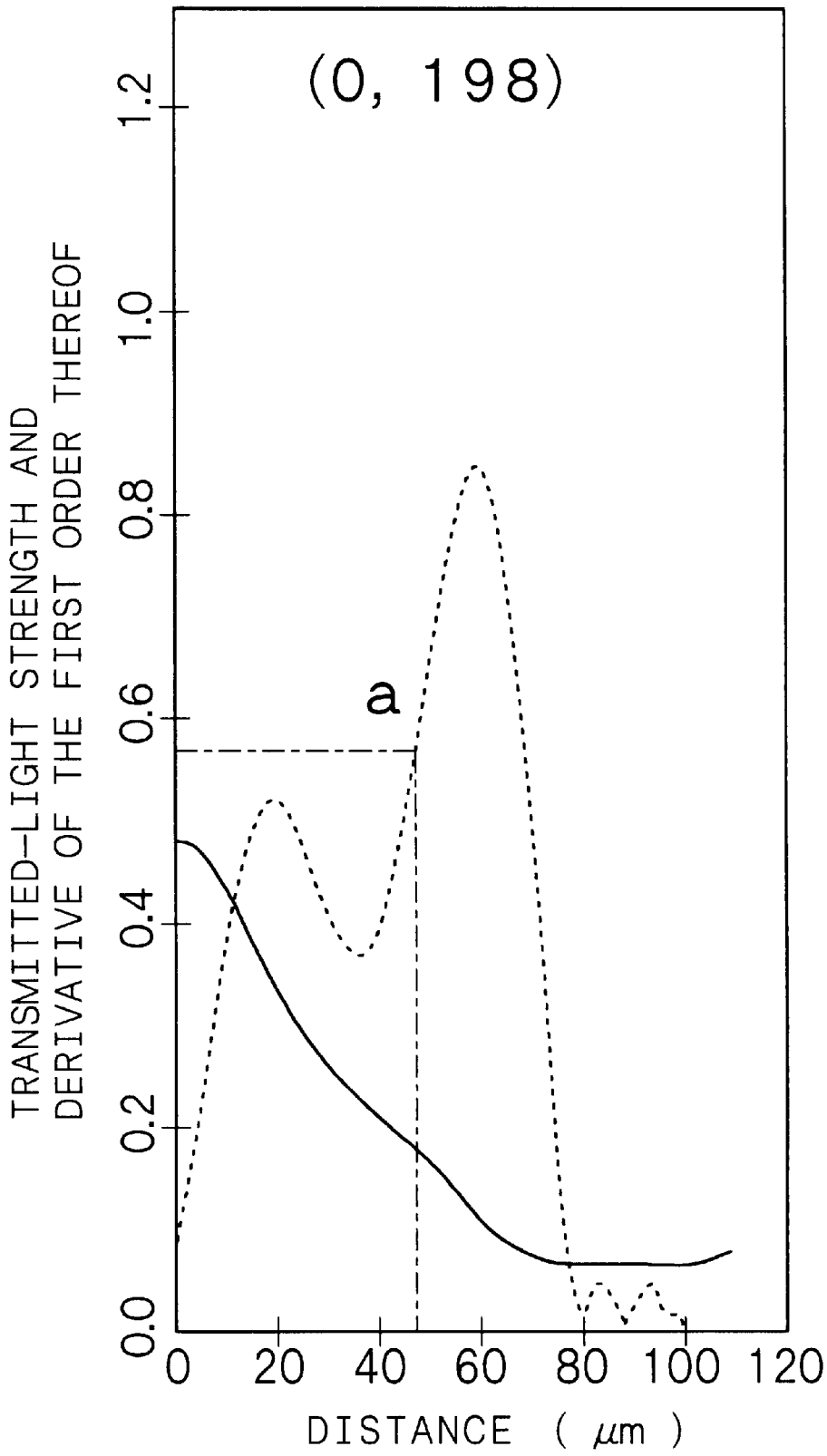
FIG. 35 is a graph showing a transmitted-light strength distribution of Fresnel diffraction waves of exposure lights which pass through a slit in a coordinate of (0,198) in the bulb for a color cathode ray tube in Comparative Example 3 and a derivative of the first order (∂I/∂x) thereof.
Figure 36:
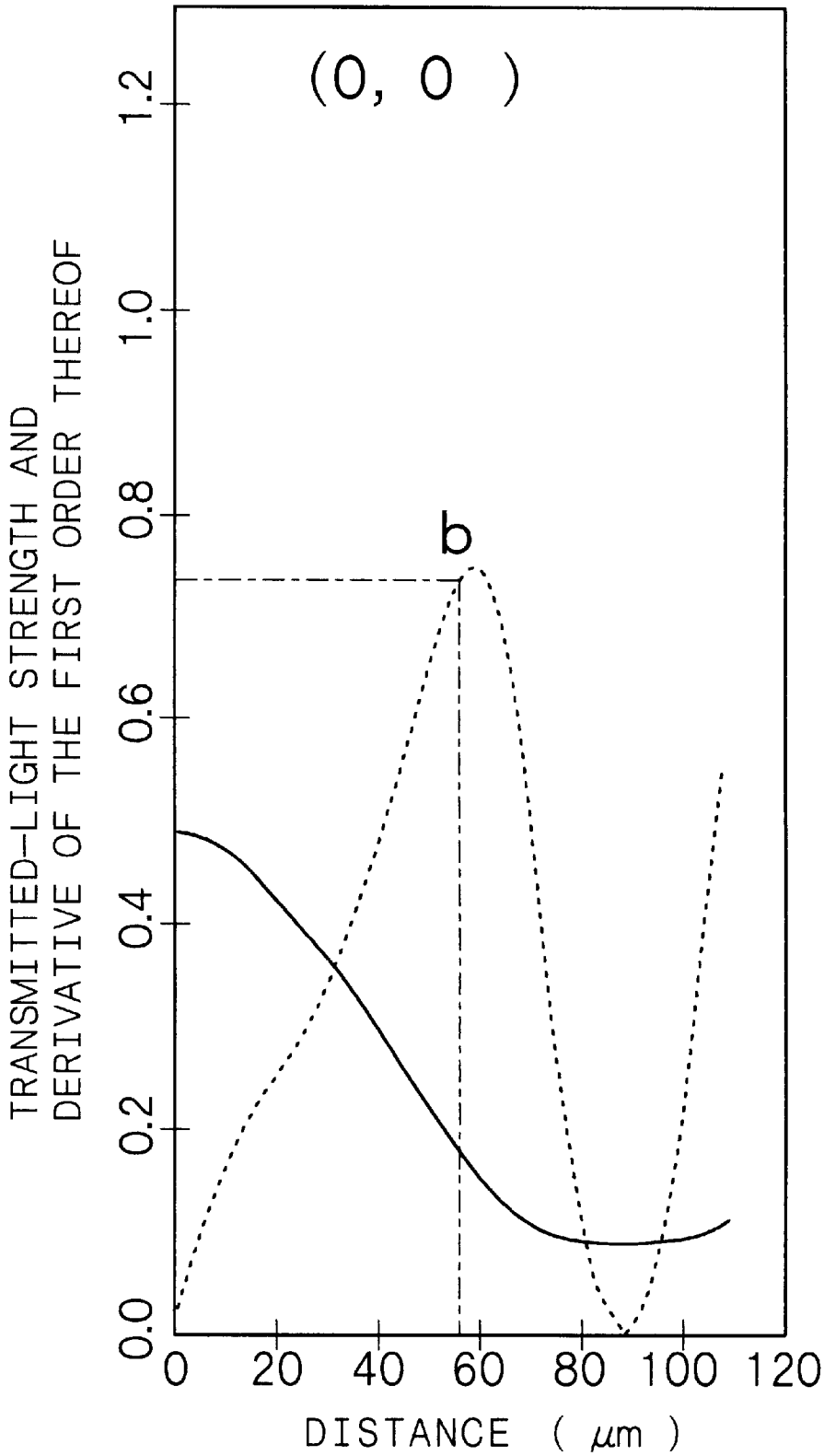
FIG. 36 is a graph showing a transmitted-light strength distribution of Fresnel diffraction waves of exposure lights which pass through a slit in a coordinate of (0,0) in the bulb for a color cathode ray tube in Comparative Example 3 and a derivative of the first order (∂I/∂x) thereof.
Figure 37:
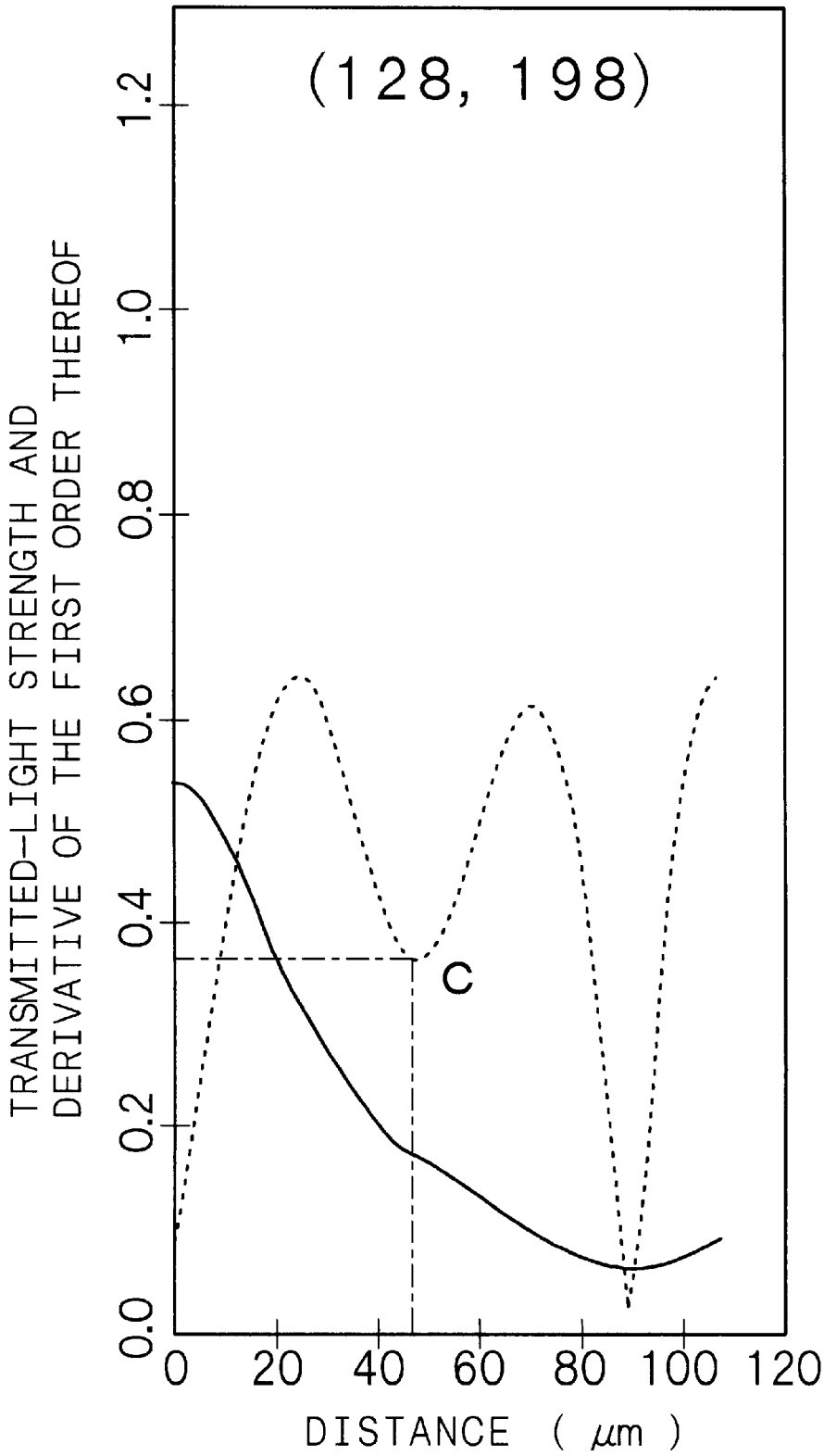
FIG. 37 is a graph showing a transmitted-light strength distribution of Fresnel diffraction waves of exposure lights which pass through a slit in a coordinate of (128,198) in the bulb for a color cathode ray tube in Comparative Example 3 and a derivative of the first order (∂I/∂x) thereof.
Figure 38:
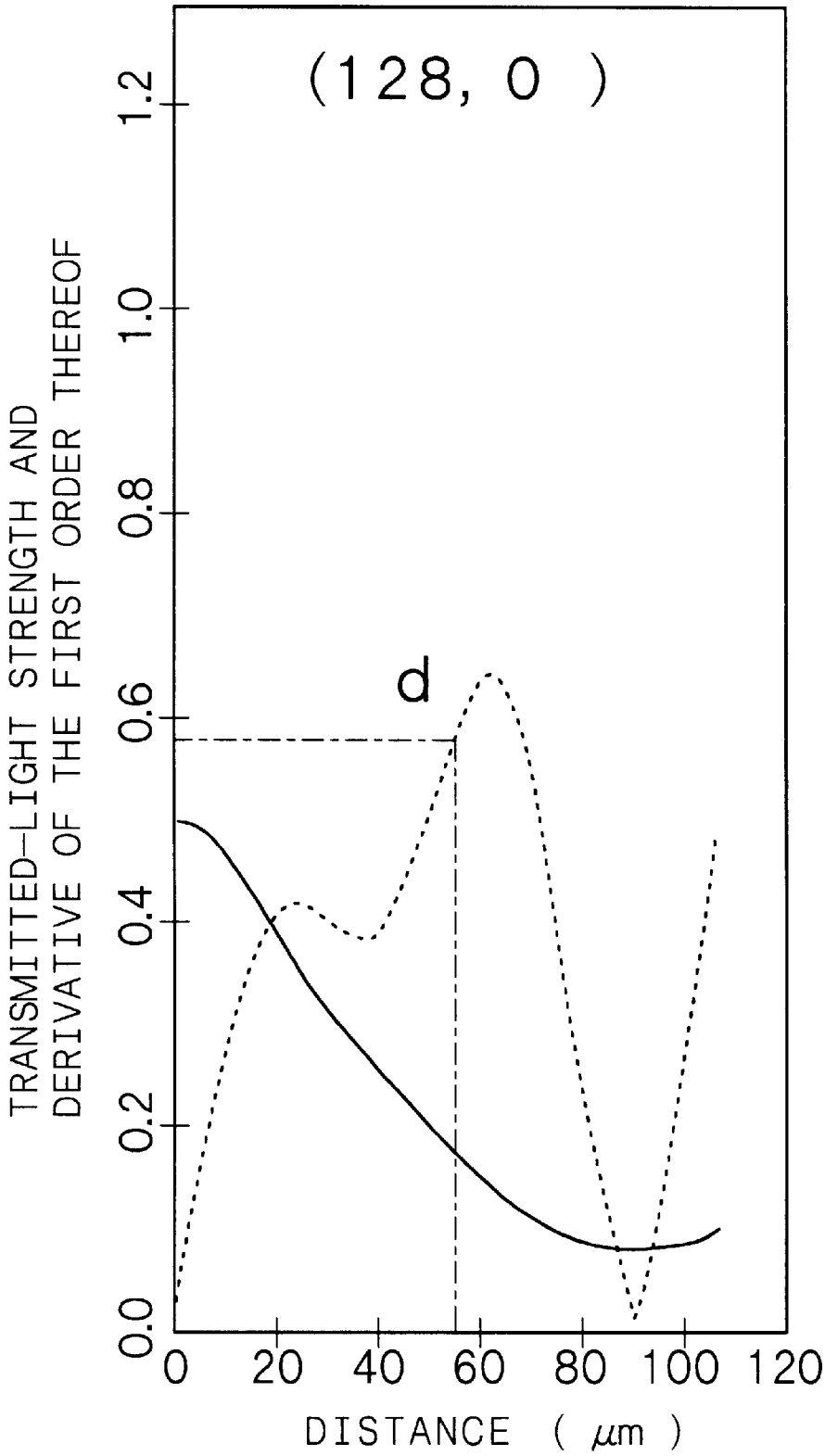
FIG. 38 is a graph showing a transmitted-light strength distribution of Fresnel diffraction waves of exposure lights which pass through a slit in a coordinate of (128,0) in the bulb for a color cathode ray tube in Comparative Example 3 and a derivative of the first order (∂I/∂x) thereof.
Figure 39:
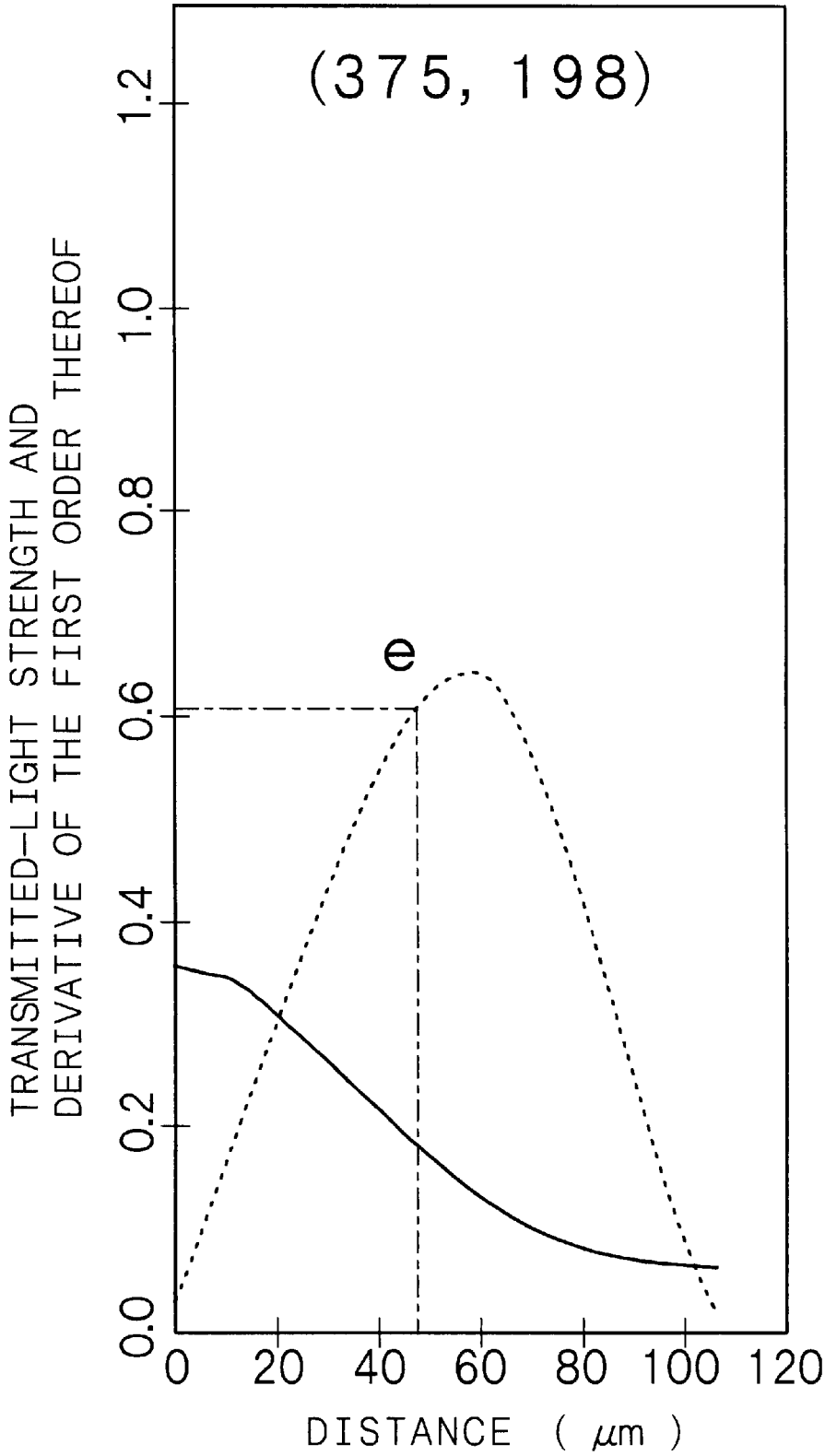
FIG. 39 is a graph showing a transmitted-light strength distribution of Fresnel diffraction waves of exposure lights which pass through a slit in a coordinate of (375,198) in the bulb for a color cathode ray tube in Comparative Example 3 and a derivative of the first order (∂I/∂x) thereof.
Figure 40:
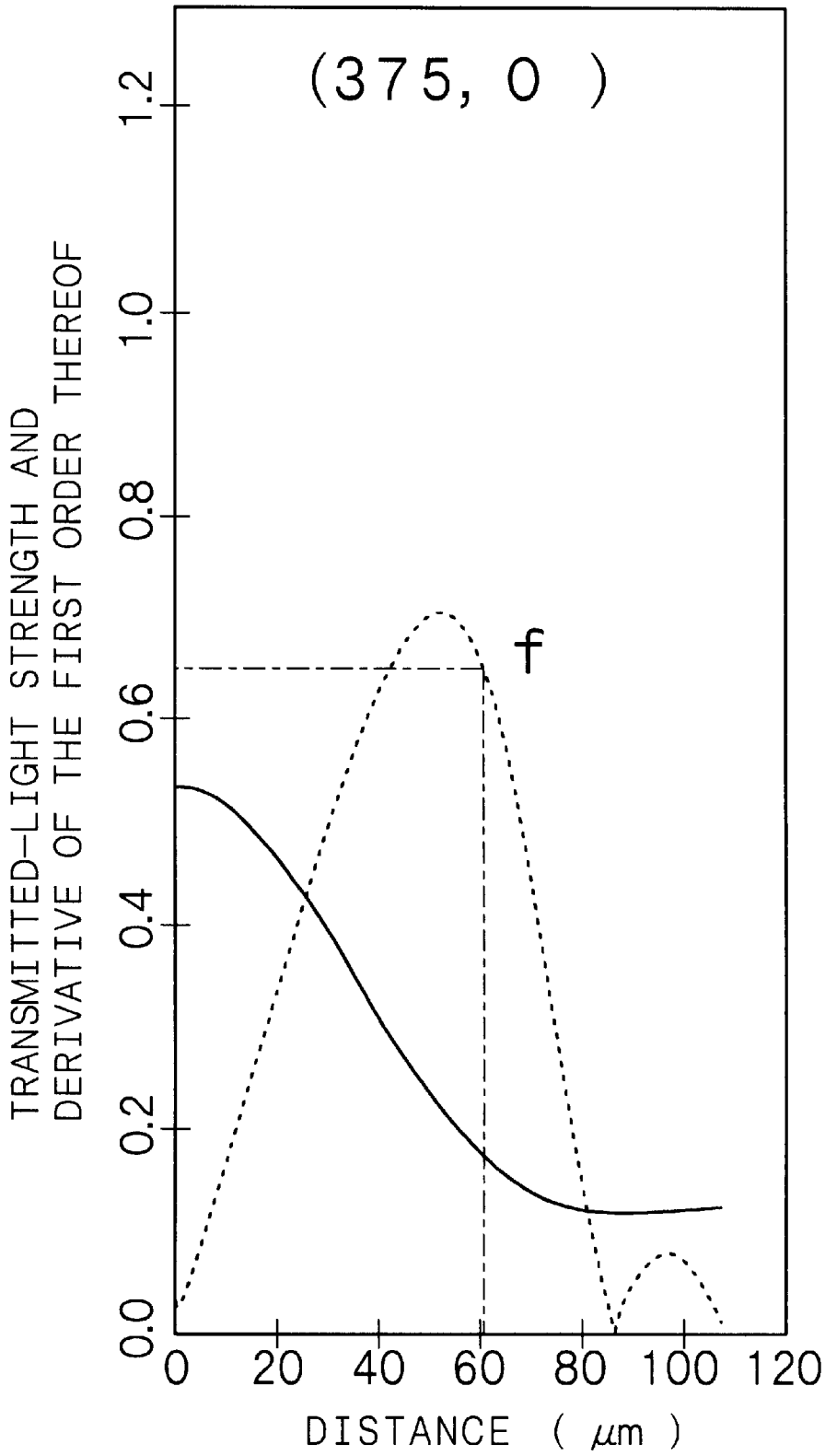
FIG. 40 is a graph showing a transmitted-light strength distribution of Fresnel diffraction waves of exposure lights which pass through a slit in a coordinate of (375,0) in the bulb for a color cathode ray tube in Comparative Example 3 and a derivative of the first order (∂I/∂x) thereof.
Figure 41:
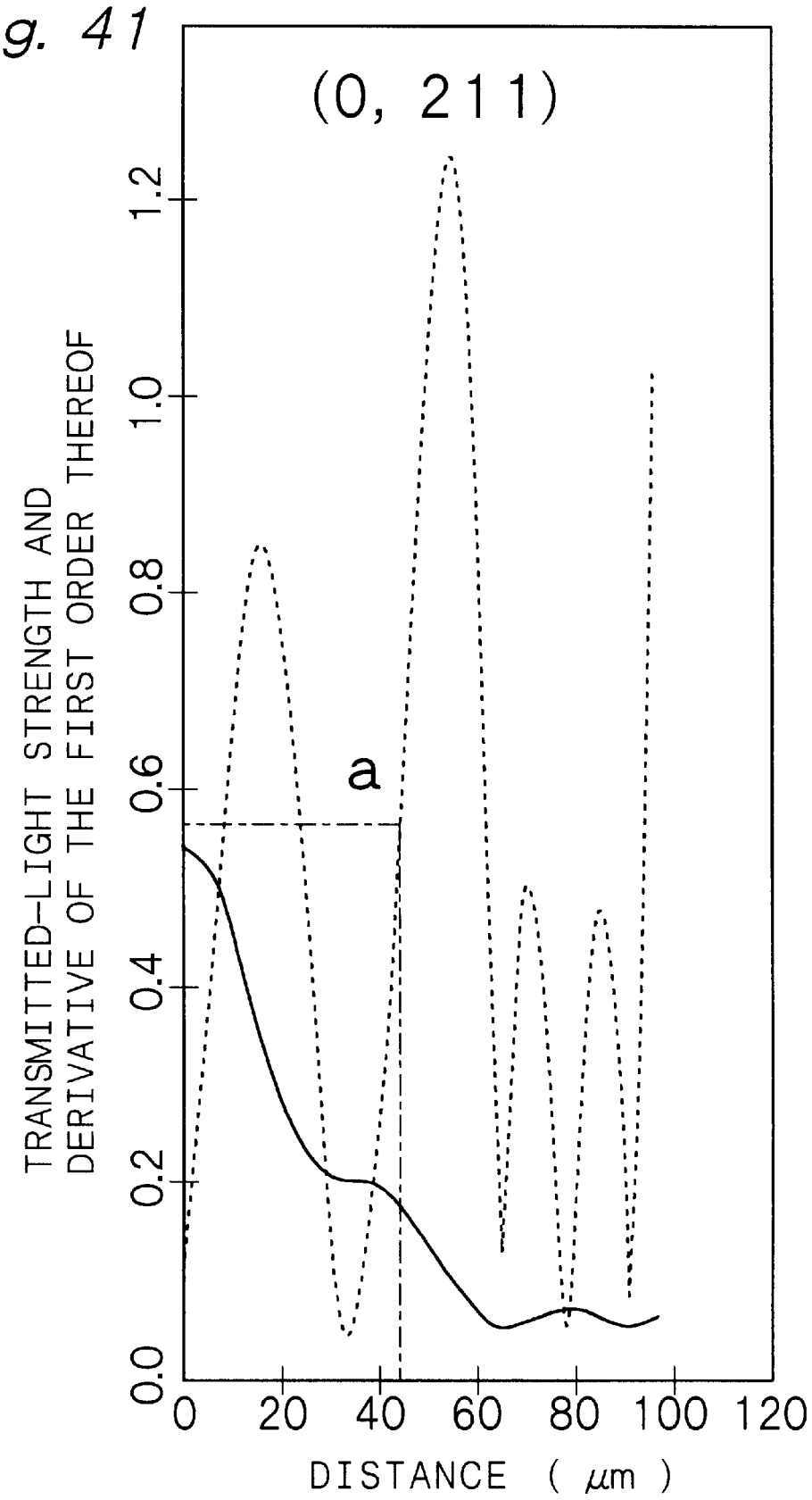
FIG. 41 is a graph showing a transmitted-light strength distribution of Fresnel diffraction wave of exposure light which passes through a slit in a coordinate of (0,211) in the bulb for a color cathode ray tube in Comparative Example 4 and a derivative of the first order (∂I/∂x) thereof.
Figure 42:
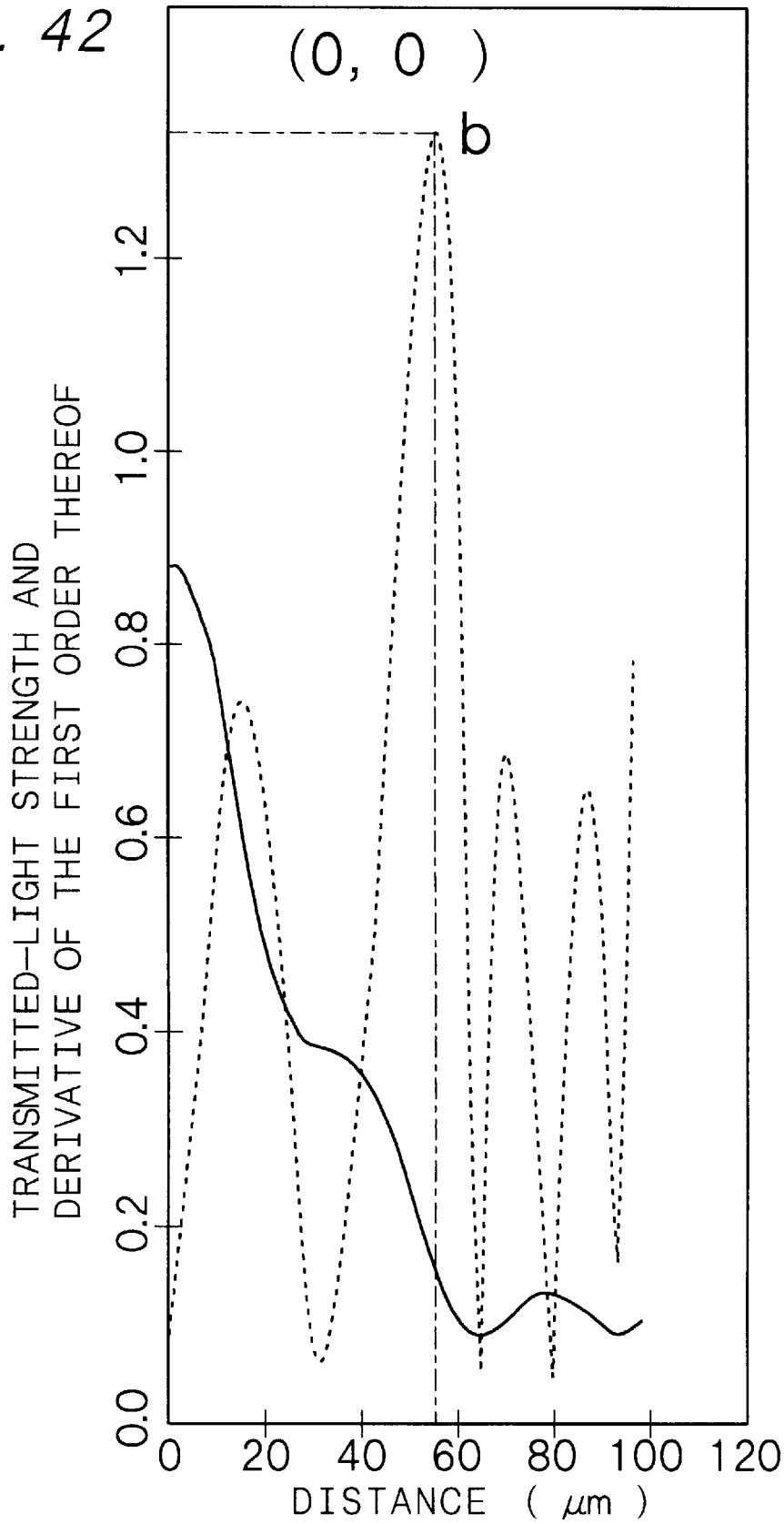
FIG. 42 is a graph showing a transmitted-light strength distribution of Fresnel diffraction wave of exposure light which passes through a slit in a coordinate of (0,0) in the bulb for a color cathode ray tube in Comparative Example 4 and a derivative of the first order (∂I/∂x) thereof.
Figure 43:
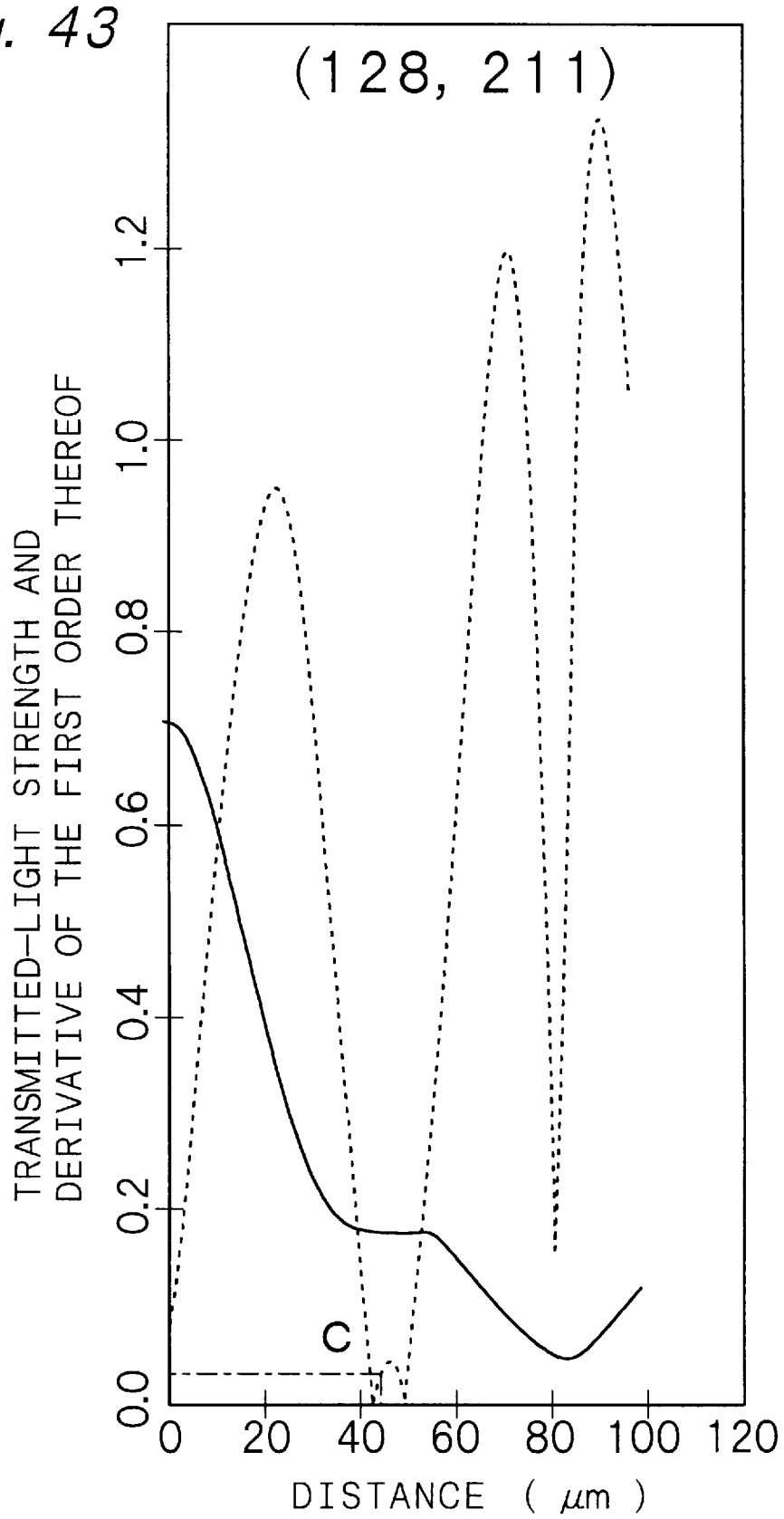
FIG. 43 is a graph showing a transmitted-light strength distribution of Fresnel diffraction wave of exposure light which passes through a slit in a coordinate of (128,211) in the bulb for a color cathode ray tube in Comparative Example 4 and a derivative of the first order (∂I/∂x) thereof.
Figure 44:
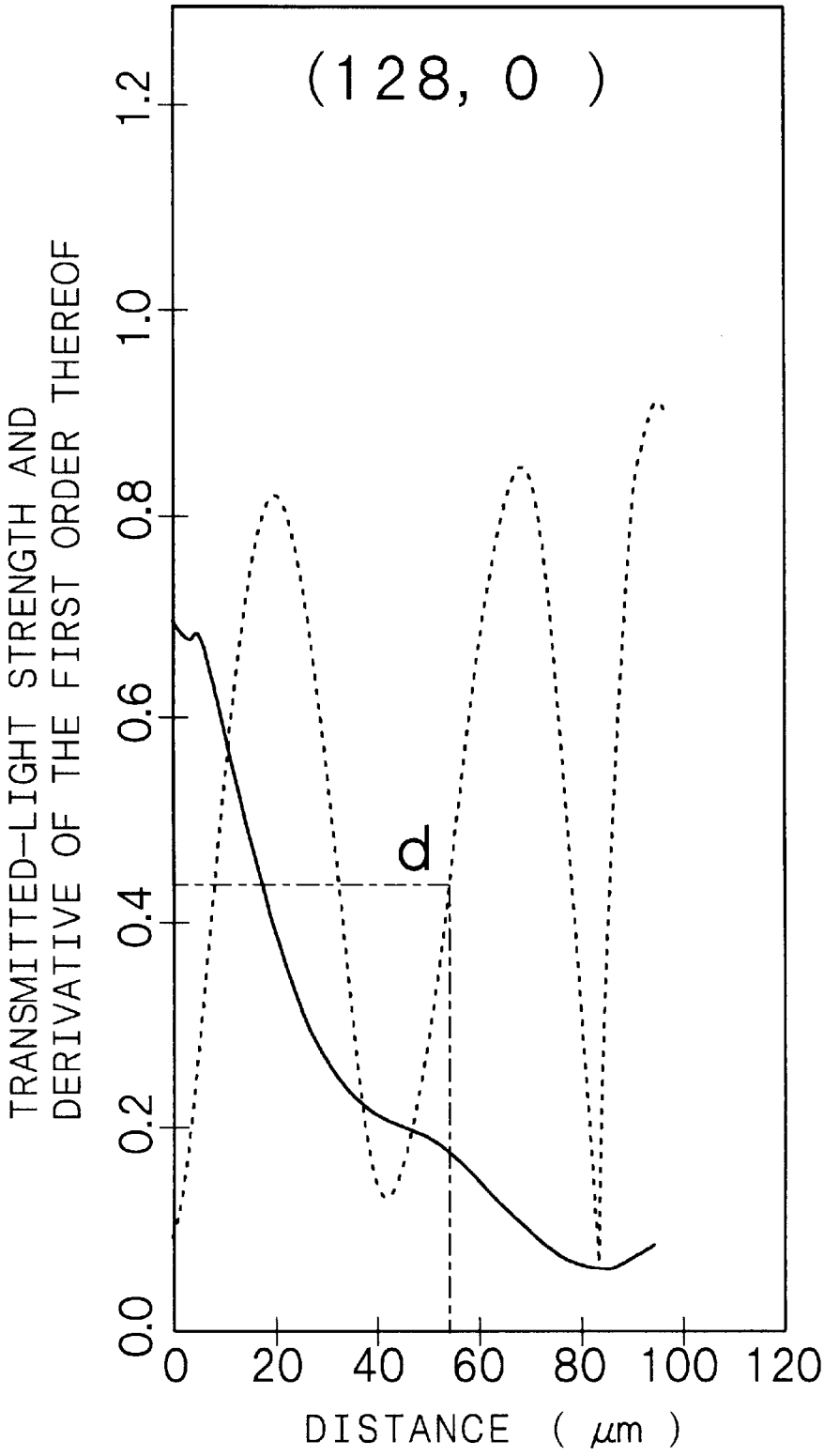
FIG. 44 is a graph showing a transmitted-light strength distribution of Fresnel diffraction wave of exposure light which passes through a slit in a coordinate of (128,0) in the bulb for a color cathode ray tube in Comparative Example 4 and a derivative of the first order (∂I/∂x) thereof.
Figure 45:
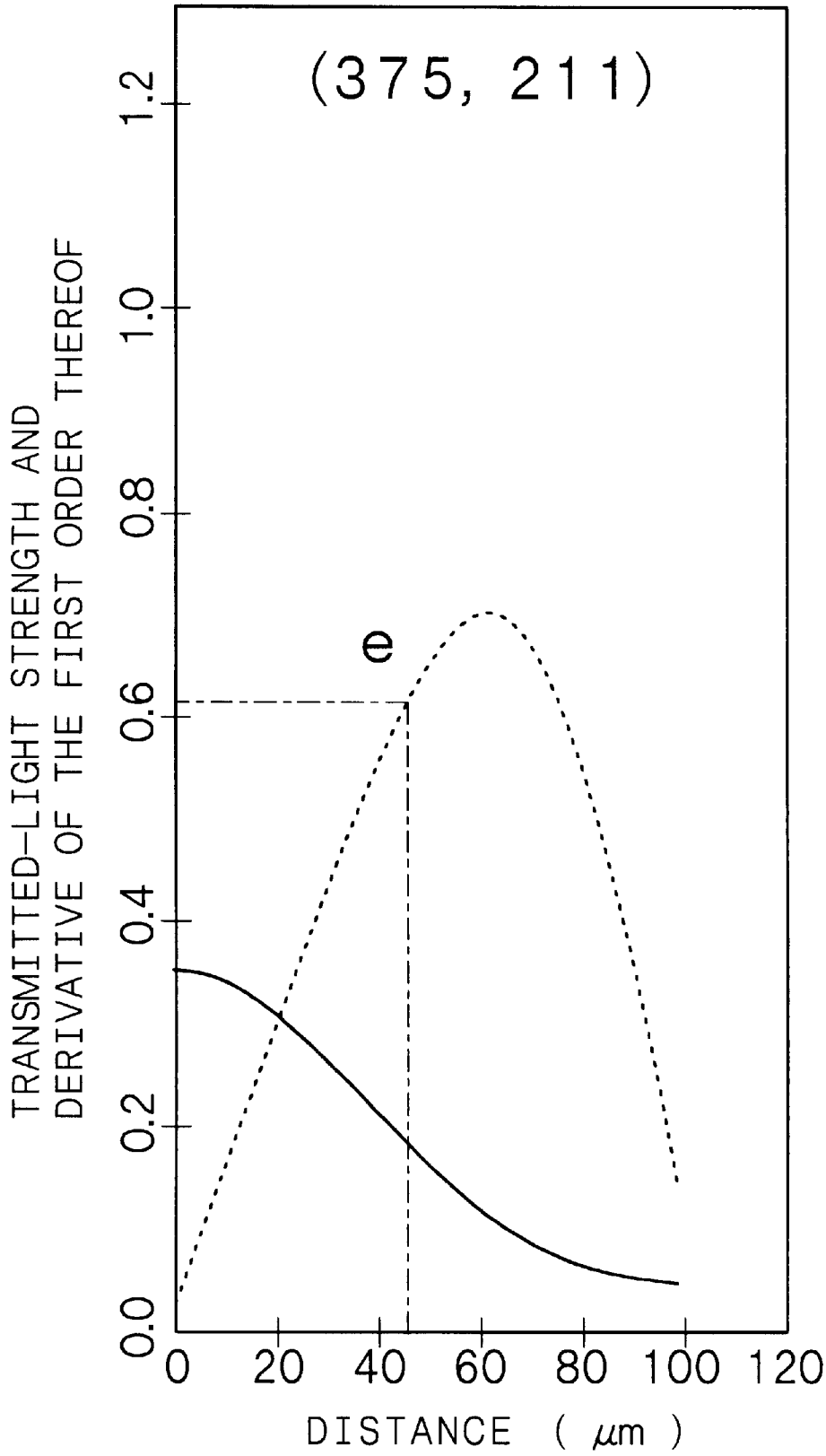
FIG. 45 is a graph showing a transmitted-light strength distribution of Fresnel diffraction wave of exposure light which passes through a slit in a coordinate of (375,211) in the bulb for a color cathode ray tube in Comparative Example 4 and a derivative of the first order (∂I/∂x) thereof.
Figure 46:
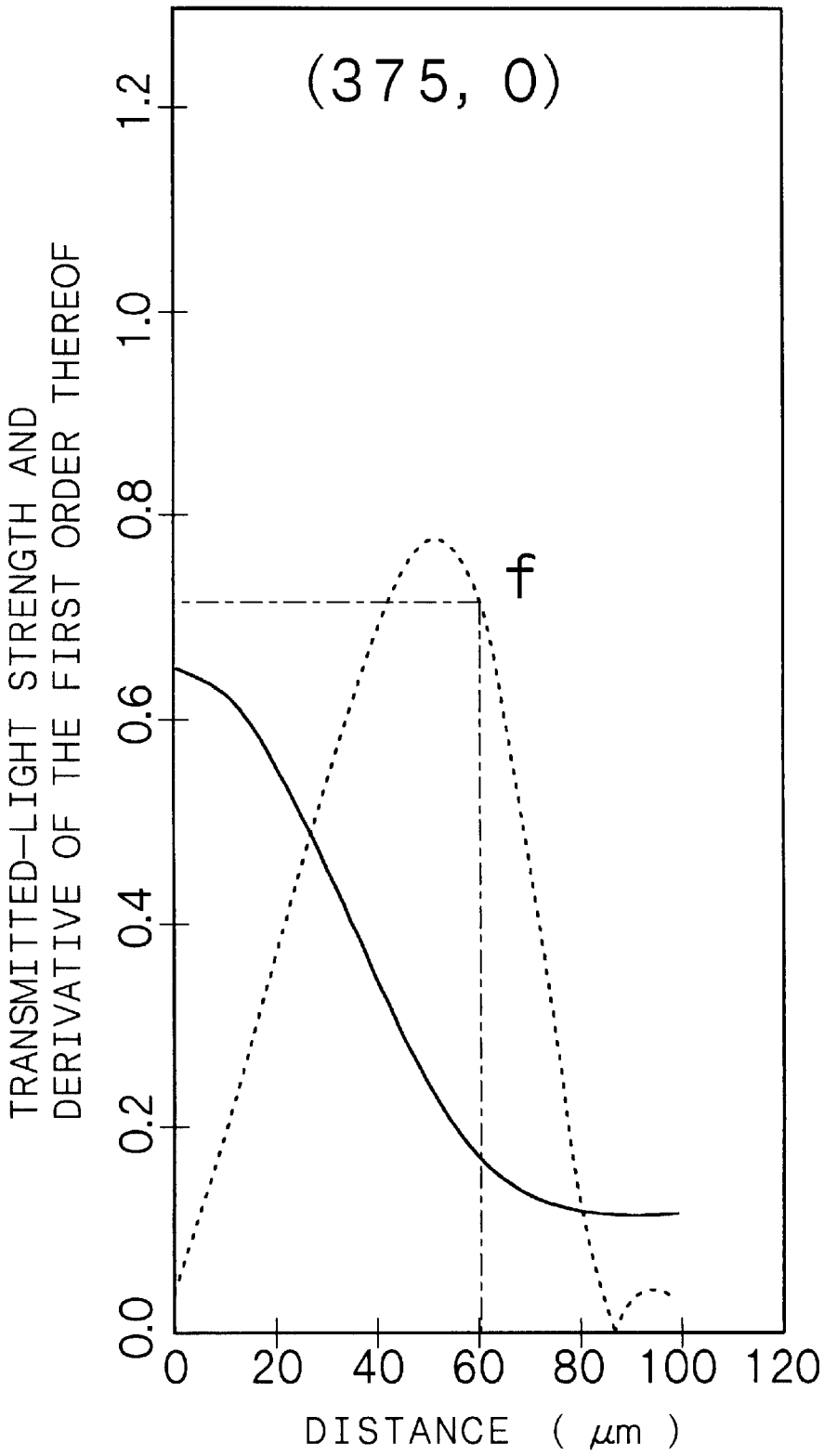
FIG. 46 is a graph showing a transmitted-light strength distribution of Fresnel diffraction wave of exposure light which passes through a slit in a coordinate of (375,0) in the bulb for a color cathode ray tube in Comparative Example 4 and a derivative of the first order (∂I/∂x) thereof.

In FIG. 18, due to the superposing of-the three exposure lights, the derivative of the first order ($\partial I/\partial x$) of the transmitted-light strength on the light sensitive film 20 has an upward-convex area in the vicinity of the central portion of the exposed region. This upward-convex area (indicated by a symbol "A" in FIG. 18) is caused by the exposure light from the exposure light source 31B for exposing a central portion.

For forming fluorescent material layers for red, green and blue, the above exposure procedures were carried out three times (total nine times) with regard to each color by changing the exposure light sources. In this manner, stripe-shaped exposed regions were formed in the light sensitive film formed on the entire of inner surface of the face plate. In this case, no convexo-concave shapes were observed in edge portions of the obtained exposed regions, and each of the edge portions was in the form of a straight line.

Then, finally, stripe-shaped fluorescent material layers 24 for red, green and blue are formed, and the face plate, a funnel, etc., are assembled, in the same manner as in Example 1, to complete a bulb for a color cathode ray tube. Further, an electron gun is incorporated into the obtained bulb, and the inside of the bulb is vacuumed to complete a color cathode ray tube.

The color cathode ray tube as an end product was used to display images, to show no non-uniformity in displayed images, so that the obtained color cathode ray tube had excellent qualities.

COMPARATIVE EXAMPLE 1

There was produced a bulb for a color cathode ray tube which satisfied the above expression (1) but did not satisfy the expression (2). This Example employed $P \times LT \times GH^{-1/2} = 4.2 \times 10^{-2}$. Further, one exposure light source was used. The nominal diagonal inchage X of the bulb 10 was 36 (X=36). Transmitted-light strength distributions of a Fresnel diffraction wave of the exposure light which passed through slits in coordinates (0,198), (0,0), (192,198), (192,0), (375,198) and (375,0) were measured, and FIGS. 23, 24, 25, 26, 27 and 28 show the results by a solid line each. In each drawing, the derivative of the first order ($\partial I/\partial x$) of the transmitted-light strength is shown by a dotted line.

The produced color cathode ray tube was used to display images, to show non-uniformity in displayed images, and the quality of the color cathode ray tube was partly degraded to a great extent. The image display non-uniformity was distinctively observed around the coordinates of (192,198) and (192,0). When the above phenomenon and the measurement results in FIGS. 23 to 28 were compared, edge portions of the exposed stripe-shaped light sensitive film (see chain lines c and d in parallel with the axis of ordinates) were included in a transition area from the first wave to the second wave as is clearly shown in FIGS. 25 and 26 in particular. Further, when the light sensitive film was selectively removed by exposure and development, edge portions of remaining portion of the light sensitive film were caused to have heavy convexo-concave shapes.

COMPARATIVE EXAMPLE 2

There was produced a bulb for a color cathode ray tube which satisfied the above expression (1) but did not satisfy the expression (2). This Example employed $P \times LT \times GH^{-1/2} = 4.2 \times 10^{-2}$. Further, two exposure light sources were used. The nominal diagonal inchage X of the bulb 10 was 36 (X=36). Transmitted-light strength distributions of superposed Fresnel diffraction waves of the two exposure lights which passed through slits in coordinates (0,198), (0,0), (128,198), (128,0), (375,198) and (375,0) were measured, and FIGS. 29, 30, 31, 32, 33 and 34 show the results by a solid line each. In each drawing, the derivative of the first order ($\partial I/\partial x$) of the transmitted-light strength is shown by a dotted line.

The produced color cathode ray tube was used to display images, to show non-uniformity in displayed images, and the quality of the color cathode ray tube was partly degraded to a great extent. The image display non-uniformity was distinctively observed around the coordinates of (0,198) and (128,0). When the above phenomenon and the measurement results in FIGS. 29 to 34 were compared, edge portions of the exposed stripe-shaped light sensitive film (see chain lines a and d in parallel with the axis of ordinates) were included in a transition area from the first wave to the second wave as is clearly shown in FIGS. 29 and 32 in particular. Further, when the light sensitive film was selectively removed by exposure and development, edge portions of remaining portion of the light sensitive film were caused to have heavy convexo-concave shapes.

COMPARATIVE EXAMPLE 3

There was produced a bulb for a color cathode ray tube which satisfied the above expression (1) but did not, satisfy the expression (2). This Example employed $P \times LT \times GH^{-1/2} = 4.2 \times 10^{-2}$. Further, three exposure light sources were used. The nominal diagonal inchage X of the bulb 10 was 36 (X=36). Transmitted-light strength distributions of superposed Fresnel diffraction waves of the three exposure lights which passed through slits in coordinates (0,198), (0,0), (128,198), (128,0), (375,198) and (375,0) were measured, and FIGS. 35, 36, 37, 38, 39 and 40 show the results by a solid line each. In each drawing, the derivative of the first order ($\partial I/\partial x$) of the transmitted-light strength is shown by a dotted line.

The produced color cathode ray tube was used to display images, to show non-uniformity in displayed images, and the quality of the color cathode ray tube was partly degraded to a great extent. The image display non-uniformity was distinctively observed around the coordinate of (128,198). When the above phenomenon and the measurement results in FIGS. 35 to 40 were compared, edge portions of the exposed stripe-shaped light sensitive film (see a chain line c in parallel with the axis of ordinates) were included in a transition area from the first wave to the second wave as is clearly shown in FIG. 37 in particular. Further, when the light sensitive film was selectively removed by exposure and development, edge portions of remaining portion of the light sensitive film were caused to have heavy convexo-concave shapes.

COMPARATIVE EXAMPLE 4

There was produced a bulb for a color cathode ray tube which satisfied the above expressions (1) and (2). This Example employed $P \times LT \times GH^{-1/2} = 3.4 \times 10^{-2}$. However, differing from Example 1, Comparative Example 4 used one exposure light source. The nominal diagonal inchage X of the bulb 10 was 36 (X=36). Transmitted-light strength distributions of a Fresnel diffraction wave of the exposure light which passed through slits in coordinates (0,211), (0,0), (128,211), (128,0), (375,211) and (375,0) were measured, and FIGS. 41, 42, 43, 44, 45 and 46 show the results by a solid line each. In each drawing, the derivative of the first order ($\partial I/\partial x$) of the transmitted-light strength is shown by a dotted line.

The produced color cathode ray tube was used to display images, to show non-uniformity in displayed images, and the quality of the color cathode ray tube was partly degraded to a great extent. The image display non-uniformity was distinctively observed around the coordinate of (128,211). When the above phenomenon and the measurement results in FIGS. 41 to 46 were compared, edge portions of the exposed stripe-shaped light sensitive film (see a chain line c in parallel with the axis of ordinates) were included in a transition area from the first wave to the second wave as is clearly shown in FIG. 43 in particular. Further, when the light sensitive film was selectively removed by exposure and development, edge portions of remaining portion of the light sensitive film were caused to have heavy convexo-concave shapes.

The following Table 1 summarizes the numbers of the exposure light sources and the values of $P \times LT \times GH^{-1/2}$ in Examples 1 and 2 and Comparative Examples 1 to 4.

TABLE 1

| | Number of exposure light sources | $P \times LT \times GH^{-1/2}$ |
|---|---|---|
| Ex. 1 | 2 | $3.4 \times 10^{-2}$ |
| Ex. 2 | 3 | $3.4 \times 10^{-2}$ |
| CEx. 1 | 1 | $4.2 \times 10^{-2}$ |
| CEx. 2 | 2 | $4.2 \times 10^{-2}$ |
| CEx. 3 | 3 | $4.2 \times 10^{-2}$ |
| CEx. 4 | 1 | $3.4 \times 10^{-2}$ |

Ex. = Example, CEx. = Comparative Example

While the present invention has been explained with reference to Examples hereinabove, the present invention shall not be limited thereto. The structures of the bulb for a color cathode ray tube and the color cathode ray tube and the constitution of the exposure apparatus are shown as examples, and the methods for producing these are also shown as examples, so that they can be modified or altered as required. In Examples, the color selection members of aperture grille type have been explained. However, other dot-type or slot-type shadow mask type color selection members may be used. Further, the electron beam sweep direction shall not be limited to the horizontal direction (x-direction) of the face plate, and in some structures of the bulb for a color cathode ray tube and the color cathode ray tube, the electron beam sweep direction can be the vertical direction (y-direction) of the face plate.

In the present invention, the edge portions of the light sensitive film remaining after exposure and development are not caused to have convexo-concave shapes. Further, in the bulb for a color cathode ray tube or the color cathode ray tube of the present invention, no convexo-concave shapes are formed in the edge portions of the fluorescent material layer. Therefore, even if the bulb for a color cathode ray tube or the color cathode ray tube for digital broadcasting for which the pitch of the opening portions of the color selection member in the central portion of the bulb is an intermediate range between the pitch of the opening portions of the color selection member in a commercial color cathode ray tube and the pitch of the opening portions of the color selection member in a high-resolution color cathode ray tube for a computer display, no non-uniformity in displayed images is observed, and there can be provided color cathode ray tubes having stable high qualities.

What is claimed is:

1. A method for producing a bulb for a color cathode ray tube, the bulb having a face plate and a color selection member having a plurality of opening portions, the method comprising the step of exposing a light-sensitive film formed on an inner surface of the face plate based upon a transmitted-light strength distribution of superposed Fresnel diffraction waves of exposure light that are emitted from a plurality of exposure light sources arranged along an electron beam sweep direction and that pass through the opening portions formed in the color selection member to form exposed regions in the light sensitive film corresponding to the opening portions, wherein X is a nominal diagonal dimension of the bulb, P is a pitch of The opening portions along the electron beam sweep direction in a central portion of the bulb, and a transmitted-light strength of the superposed Presnel diffraction waves of two exposure lights of the plurality of exposure lights contributing to an exposure of edge portions of the light sensitive film corresponding to each opening portion satisfies:

a first-order derivative of the transmitted-light strength has an upward-convex area in an area of the transmitted-light strength in which the transmitted-light strength on the light sensitive film decreases along the electron beam sweep direction from a central portion of the exposed region of the light sensitive film corresponding to each opening portion;

the edge portions of the exposed light sensitive film corresponding to each opening portion are included in an area of the transmitted-light strength corresponding to the upward-convex area which appears first along the electron beam sweep direction from the central portion of the exposed region corresponding to each opening portion, out of the upward-convex areas of the first-order derivative of the transmitted-light strength; and $$0.0117X-0.0457<P<0.018X-0.0771.$$

2. The method for producing a bulb for a color cathode ray cube according to claim 1, wherein OH is a distance between the inner surface of the face plate and the color selection member in the central portion of the bulb; LI is a value obtained by dividing a size of the opening portion along the electron beam sweep direction in the central portion of the bulb by the pitch P; and $$2.8\times10^{-2}<P\times LT\times GH^{-1/2}<4.1\times10^{-2}.$$

3. The method for producing a bulb for a color cathode ray tube according to claim 1, wherein after formation of the exposed regions in the light sensitive film formed on the inner surface of the face plate corresponding to the openings, the method further comprises the steps of: selectively removing the light sensitive film by development; forming a light-absorption layer on the exposed inner surface of the face plate and removing a remaining portion of the light sensitive film; and forming a fluorescent material layer on the exposed inner surface of the face plate.

4. The method for producing a bulb for a color cathode ray tube according to claim 1, wherein a correction lens system is disposed between the exposure light sources and the color selection member.

5. The method for producing a bulb for a color cathode ray tube according to claim 1, claim 2, claim 3, or claim 4, wherein the number of the exposure light sources is two.

6. The method for producing a bulb for a color cathode ray tube according to claim 1, claim 2, claim 3, or claim 4, wherein the number of the exposure light sources is at least three $I_{CENTER}$ is the transmitted-light strength in the central portion of the exposed region corresponding to each opening portion; $I_{EDGE}$ is a transmitted-light strength in the edge portion of the light sensitive film corresponding to each opening portion; and the transmitted-light strength of superposed Fresnel diffraction waves of the exposure lights from all of the exposure light sources satisfies an expression $I_{CENTER}/I_{EDGE}1.2$.

7. A method for producing a color cathode ray tube having a bulb, the bulb having a face plate and a color selection member having a plurality of opening portions, the method comprising the step of exposing a light-sensitive film formed on an inner surface of the face plate based upon a transmitted-light strength distribution of superposed Fresnel diffraction waves of exposure light emitted from a plurality of exposure light sources arranged along the electron beam sweep direction and pass through the opening portions formed in the color selection member to form exposed regions in the light sensitive film which regions correspond to the opening portions, wherein X is a nominal diagonal dimension of the bulb, P is a pitch of the opening portions along an electron beam sweep direction in the central portion of the bulb, and a transmitted-light strength of superposed Presnel diffraction waves of two exposure lights out of the plurality of exposure lights emitted from two exposure light sources contributing to an exposure of edge portions of the light sensitive film corresponding to each opening portion satisfies:

a first-order derivative of the transmitted-light strength has at least one upward-convex area in an area of the transmitted-light strength where the transmitted-light strength on the light sensitive film decreases along the electron beam sweep direction from a central portion of the exposed region of the light sensitive film corresponding to each opening portion;

the edge portions of the exposed light sensitive film corresponding to each opening portion are included in an area of the transmitted-light strengch corresponding to the upward-convex area which appears first along the electron beam sweep direction from the central portion of the exposed region corresponding to each opening portion, out of the upward-convex areas of the derivative of the first order of the transmitted-light strength; and $$0.0117X-0.0457<P<0.018X-0.0771.$$

8. The method for producing a color cathode ray tube according to claim 7, wherein GH is a distance between the inner surface of the face plate and the color selection member in the central portion of the bulb; LT is a value obtained by dividing a size of the opening portion along the electron beam sweep direction in the central portion of the bulb by the pitch P; and $$2.8\times10^{-2}<P\times LT\times GH^{-1/2}<4.1\times10^{-2}.$$

9. The method for producing a color cathode ray tube according to claim 7 or claim 8, wherein the number of exposure light sources is two.

10. The method for producing a color cathode ray tube according to claim 7 or claim 8, wherein the number of exposure light sources is at least 3; $I_{CENTER}$ is the transmitted-light strength in the central portion of the exposed region corresponding to each opening portion; $I_{EDGE}$ is the transmitted-light strength in the edge portion of the light sensitive film corresponding to each opening portion; and the transmitted-light strength of the superposed Fresnel diffraction waves of the exposure light satisfies the expression: $I_{CENTER}/I_{EDGE}2^{1/2}$.

* * * * *